US007278591B2

(12) United States Patent
Clearman et al.

(10) Patent No.: US 7,278,591 B2
(45) Date of Patent: Oct. 9, 2007

(54) SPRAY APPARATUS

(76) Inventors: Joseph H. Clearman, 25833 Canyon Rd. Northwest, Poulsbo, WA (US) 98370; Jack F. Clearman, 2164 NW. Canal View Way, Poulsbo, WA (US) 98370

( * ) Notice: Subject to any disclaimer, the term of this patent is extended or adjusted under 35 U.S.C. 154(b) by 146 days.

(21) Appl. No.: 10/917,691

(22) Filed: Aug. 13, 2004

(65) Prior Publication Data

US 2006/0032945 A1 Feb. 16, 2006

(51) Int. Cl.
*B05B 1/34* (2006.01)
*B05B 3/04* (2006.01)
*B05B 3/02* (2006.01)

(52) U.S. Cl. ..... 239/380; 239/381; 239/214; 239/214.13; 239/214.15; 239/214.21; 239/215.19

(58) Field of Classification Search ..... 239/380, 239/381, 214, 214.13, 214.15, 215.19, 214.21, 239/222, 589.1, DIG. 12
See application file for complete search history.

(56) References Cited

U.S. PATENT DOCUMENTS

| | | | |
|---|---|---|---|
| 2,639,191 | A | 5/1953 | Hruby, Jr. |
| 2,848,276 | A | 8/1958 | Clearman |
| 3,009,648 | A | 11/1961 | Hait |
| 3,091,400 | A | 5/1963 | Aubert |
| 3,357,643 | A | 12/1967 | Kruby, Jr. |
| 3,691,584 | A | 9/1972 | Landers |
| 3,791,584 | A | 2/1974 | Drew et al. |
| 3,805,319 | A | 4/1974 | Evans |
| 3,880,357 | A | 4/1975 | Baisch |
| 3,929,287 | A | 12/1975 | Givier et al. |
| 4,018,385 | A | 4/1977 | Bruno |
| 4,068,801 | A | 1/1978 | Leutheuser |
| 4,073,438 | A | 2/1978 | Meyer |
| 4,117,979 | A | 10/1978 | Lagarelli et al. |
| 4,340,177 | A | 7/1982 | Huber |
| 4,420,951 | A | 12/1983 | Clearman et al. |

(Continued)

FOREIGN PATENT DOCUMENTS

DE 3044310 A1 6/1982

(Continued)

OTHER PUBLICATIONS

PCT International Search Report; PCT/DE 99/02640; Oct. 2, 2000; 3 pages.

(Continued)

*Primary Examiner*—Davis D. Hwu
(74) *Attorney, Agent, or Firm*—Jeffrey L. Streets; Streets & Steele

(57) ABSTRACT

A spray apparatus includes a housing having a fluid inlet and a plurality of fluid outlets, and a turbine carried for rotary movement within the housing under fluid flow from the fluid inlet to one or more of the fluid outlets. An integrating member is preferably operatively coupled to the turbine for oscillatory movement relative to the housing under rotary movement of the turbine, and a plurality of tubes are each disposed in one of the fluid outlets for dispensing fluid from the housing. At least a subset of the plurality of tubes are operatively-coupled to the integrating member for coordinated movement of the coupled tubes in the respective plurality of fluid outlets.

50 Claims, 39 Drawing Sheets

U.S. PATENT DOCUMENTS

| | | | | |
|---|---|---|---|---|
| 4,487,368 | A | | 12/1984 | Clearman |
| 4,629,404 | A | | 12/1986 | Raymond |
| 4,671,462 | A | * | 6/1987 | Badria ..... 239/227 |
| 4,773,594 | A | | 9/1988 | Clearman |
| 4,828,179 | A | | 5/1989 | Garner |
| 4,838,486 | A | | 6/1989 | Finkbeiner |
| 4,944,457 | A | | 7/1990 | Brewer |
| 5,108,035 | A | | 4/1992 | Friedrichs |
| 5,172,862 | A | | 12/1992 | Heimann et al. |
| 5,217,166 | A | | 6/1993 | Schulze et al. |
| 5,248,092 | A | | 9/1993 | Rankin |
| 5,332,155 | A | | 7/1994 | Jüger |
| 5,439,174 | A | | 8/1995 | Sweet |
| 5,467,927 | A | | 11/1995 | Lee |
| 5,551,635 | A | | 9/1996 | Jüger |
| 5,577,664 | A | | 11/1996 | Heitzman |
| 5,588,595 | A | | 12/1996 | Sweet et al. |
| 5,598,975 | A | | 2/1997 | Jüger |
| 5,647,537 | A | | 7/1997 | Bergmann |
| 5,671,885 | A | | 9/1997 | Davisson |
| 5,704,547 | A | | 1/1998 | Golan et al. |
| 6,092,739 | A | | 7/2000 | Clearman |
| 6,186,414 | B1 | | 2/2001 | Clearman et al. |
| 6,199,771 | B1 | | 3/2001 | Clearman et al. |
| 6,254,013 | B1 | | 7/2001 | Clearman et al. |
| 6,254,014 | B1 | | 7/2001 | Clearman et al. |
| 6,360,965 | B1 | | 3/2002 | Clearman et al. |
| 6,360,967 | B1 | | 3/2002 | Schorn |
| 6,439,477 | B1 | | 8/2002 | Sweet et al. |
| 6,454,186 | B2 | | 9/2002 | Haverstraw et al. |
| 6,527,204 | B2 | | 3/2003 | Heitzman |
| 6,533,194 | B2 | * | 3/2003 | Marsh et al. ..... 239/383 |
| 6,659,372 | B2 | | 12/2003 | Marsh et al. |
| 2003/0006304 | A1 | | 1/2003 | Cool et al. |
| 2004/0164189 | A1 | | 8/2004 | Berning |

FOREIGN PATENT DOCUMENTS

| | | |
|---|---|---|
| EP | 0 719 587 | 7/1996 |
| FR | 2 568 120 A | 1/1986 |
| WO | WO 00/03810 A | 1/2000 |
| WO | WO 00/10720 A | 3/2000 |
| WO | WO 01/66263 A1 | 9/2001 |

OTHER PUBLICATIONS

PCT International Search Report; PCT/US2005/028675; filing date Aug. 13, 2005; 6 pages.

* cited by examiner

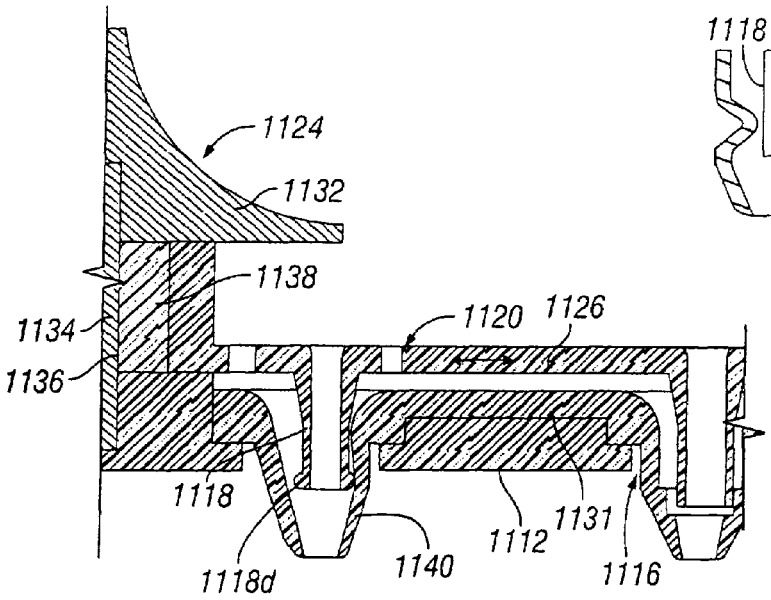
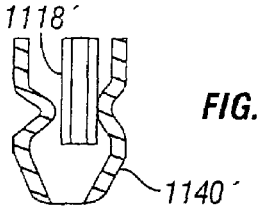
FIG. 11A
FIG. 11
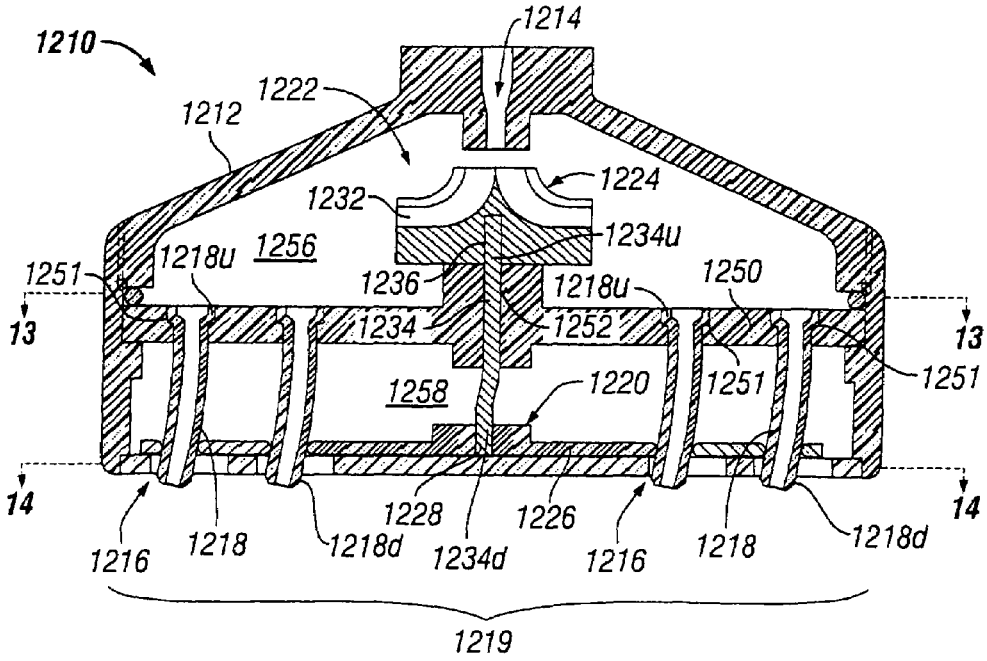
FIG.12

SPRAY APPARATUS

BACKGROUND OF THE INVENTION

1. Field of the Invention

The present invention relates to devices for distributing liquids such as water in desirable showering streams, such as showerheads for personal use.

2. Background of the Related Art

Showerheads are commercially available in numerous designs and configurations. While many showerheads are designed and sold for their decorative styling, there are many different showerhead mechanisms that are intended to improve or change one or more characteristic of the resulting water spray pattern. A particular spray pattern may be described by the characteristics of spray width, spray distribution or trajectory, spray velocity, and the like. Furthermore, the spray pattern may be adapted or designed for various purposes, including a more pleasant feeling to the skin, better performance at rinsing, massaging of muscles, and conservation of water, just to name a few.

The vast majority of showerheads may be categorized as being either stationary or oscillating, and having either fixed or adjustable openings or jets. Stationary showerheads with fixed jets are the simplest of all showerheads, consisting essentially of a water chamber and one or more jets directed to produce a constant pattern. Stationary showerheads with adjustable jets are typically of a similar construction, except that some may allow adjustment of the jet direction, jet opening size and/or the number of jets utilized. For example, a showerhead currently used in typical new residential home construction provides a stationary spray housing having a plurality of spray jets disposed in a circular pattern, wherein the velocity of the spray is adjustable by manually rotating an adjustment ring relative to the spray housing.

One example of a stationary showerhead is described in U.S. Pat. No. 5,172,862 (Heimann et al.). The Heimann showerhead has a body with a single fluid inlet and a plurality of fluid outlets. The fluid outlets are provided in the form of a plurality of flexible tubular extensions positioned in respective perforations of a lower elastomeric wall of the showerhead body. A movable disk or plate is provided to selectively deform or flick the flexible tubular extensions so as to "flake off" lime deposits that may have adhered to, or built up within, the extensions during operation. The movement of the disk is purely a manual operation, and the plate is not adapted to alter the direction, shape, or spray pattern of the water flow.

These stationary showerheads cause water to flow through its apertures and contact essentially the same points on a user's body in a repetitive fashion. Therefore, the user feels a stream of water continuously on the same area and, particularly at high pressures or flow rates, the user may sense that the water is drilling into the body, thus diminishing the effect derived from such a shower head. In order to reduce this undesirable feeling, various attempts have been made to provide oscillating showerheads.

Examples of oscillating spray heads include the showerheads disclosed in U.S. Pat. Nos. 3,791,584 (Drew et al.), 3,880,357 (Baisch), 4,018,385 (Bruno), 4,944,457 (Brewer), and 5,577,664 (Heitzman). U.S. Pat. No. 4,944,457 (Brewer) discloses an oscillating showerhead that uses an impeller wheel mounted to a gearbox assembly that produces an oscillating movement of the nozzle. Similarly, U.S. Pat. No. 5,577,664 (Heitzman) discloses a showerhead having a rotary valve member driven by a turbine wheel and gear reducer for cycling the flow rate through the housing between high and low flow rates. Both of these showerheads require extremely complex mechanical structures in order to accomplish the desired motion. Consequently, these mechanisms are prone to failure due to wear on various parts and mineral deposits throughout the structure.

U.S. Pat. No. 3,691,584 (Drew et al.) also discloses an oscillating showerhead, but utilizes a nozzle mounted on a stem that rotates and pivots under forces places on it by water entering through radially-disposed slots into a chamber around a stem. Although this showerhead is simpler than those of Brewer and Heitzman, it still includes a large number of piece requiring precise dimensions and numerous connections between pieces. Furthermore, the Drew showerhead relies upon small openings for water passageways and is subject to mineral buildup and plugging with particles.

U.S. Pat. No. 5,467,927 (Lee) discloses a showerhead with an apparatus having a plurality of blades designed to produce vibration and pulsation. One blade is provided with an eccentric weight that causes vibration and an opposite blade is provided with a front flange that causes pulsation by momentarily blocking the water jets. Again, the construction of this showerhead is rather complex and its narrow passageways are subject to mineral buildup and plugging with particulates.

U.S. Pat. No. 5,704,547 (Golan et al.) discloses a showerhead including a housing, a turbine and a fluid exit body, such that fluid flowing through the turbine causes rotation of the turbine. The rotating turbine can be used to cause rotation of the fluid exit body and/or a side-to-side rocking motion in a pendulum-like manner.

Therefore, there is a need for an improved apparatus that delivers water in a continually changing manner, such as wobbling, orbiting, rotating, and the like. It would be desirable if the apparatus provided a simple design and construction with minimal restriction to water flow and open conduits for reducing the possibility or extent of plugging. It would be further desirable if the apparatus employed a design that facilitated easy cleaning of the fluid discharge nozzles or jets, in the event that full or partial plugging (e.g., by mineral depositing) did occur. It would be further desirable if the apparatus could be housed within a smaller housing thereby providing a higher degree of design flexibility. Ultimately, it would be desirable to have a spin driver that would operate regardless of the extent to which the spin driver was allowed to tilt.

Most spray heads, whether they are stationary or oscillating, deliver fluids in a predetermined manner. The user is not allowed to effect changes in the fluid delivery characteristics of the spray head, except perhaps increasing or decreasing the fluid flow rate by turning the control valve that communicates fluid to the spray head. One such spray head which allows user adjustments between a vibrating (i.e., massage) mode and a non-vibrating mode is disclosed in U.S. Pat. No. 5,467,927 (Lee). However, spray heads that allow adjustment of other fluid delivery characteristics have not been available; Another such spray head which allows user adjustments concerning the shape of the resulting spray pattern is disclosed in U.S. Pat. No. 5,577,664 (Heitzman, also mentioned above). The Heitzman showerhead employs a control ring for selective rotation of a pair of cam rings, which ultimately produces twisting of bundled pluralities of orifice tubes to effect a desired spray width.

Therefore, there is also a need for an improved spray head or showerhead that allows a user to adjust or control the delivery of fluid. Characteristics of the fluid delivery that would be particularly desirable to adjust include the spray width, the spray velocity and spray flow rate. It would be desirable if the spray head were able to deliver water in the desired manner, even at low pressures or flow rates dictated or desirable for water conservation. It would be further desirable if the spray head provided a simple design and construction with minimal restriction to water flow, and enhanced fidelity such that each of a plurality of discharge nozzles or jets could be controlled.

DEFINITIONS

Certain terms are defined throughout this description as they are first used, while certain other terms used in this description are defined below:

"Nutating" means oscillatory movement by the axis of a rotating body, e.g., wobbling.

"Orbiting" means revolving in a generally circular or elliptical path.

"Oscillating" means to move or travel back and forth between two points by one or more various paths, and may include, e.g., at least one of circular, elliptical, and linear movement.

"Planar" means lying in a substantially flat or level surface, framework, or structure, and may include, e.g., plates, boards, lattices, and screens.

"Rotary" means characterized by turning or moving about an axis or a center, and may include, e.g., spinning, nutating, or a combination thereof.

"Spinning" means turning on or around an axis.

"Wobbling" means to move or proceed with an irregular rocking or staggering motion, and includes the motion of a circular member rolling on its edge along a surface following a circular path.

SUMMARY OF THE INVENTION

In one aspect, the present invention provides a spray apparatus, including a housing having a fluid inlet and a plurality of fluid outlets, and a turbine carried for rotary movement within the housing under fluid flow from the fluid inlet to one or more of the fluid outlets. An integrating member is operatively coupled to the turbine for oscillatory movement relative to the housing under rotary movement of the turbine, and a plurality of tubes are each disposed in one of the fluid outlets for dispensing fluid from the housing. At least a subset of the plurality of tubes are operatively-coupled to the integrating member for coordinated movement of the coupled tubes in the respective plurality of fluid outlets.

It is presently preferred that at least a portion of the housing is substantially cylindrical. In various embodiments, the fluid inlet of the housing directs fluid towards the turbine in a direction selected from axial, radial, tangential, and combinations thereof.

In particular embodiments of the inventive spray apparatus, the integrating member is operatively coupled to the turbine for oscillatory movement within the housing under rotary movement of the turbine. The rotary movement of the turbine may include spinning, nutating, or a combination thereof. The nutating of the turbine may include a wobbling motion. The oscillatory movement of the integrating member may include at least one of circular, elliptical, and linear movement.

In particular embodiments of the inventive spray apparatus, the fluid-dispensing tubes may be rigid or flexible, with the flexibility being preferably provided by manufacturing the tubes of materials including a natural polymer, a synthetic polymer, or a combination thereof. Additionally, the tubes may each be sealingly disposed in one of the fluid outlets, although this is not essential.

The subset of the plurality of tubes that are operatively-coupled to the integrating member are, in some embodiments, oriented with respect to one another in a configuration that is parallel, divergent, convergent, or a combination thereof.

In various embodiments of the inventive spray apparatus, the turbine includes a head having at least two angled or angled or curved vanes on an upper surface thereof and being radially symmetrical.

In particular embodiments, the integrating member includes a first planar member having a substantially central orifice. It will be appreciated by those skilled in the art, however, that the integrating member need not be characterized by a planar member (i.e., curved-shape members, among others, may also be used). The turbine includes a head having at least one angled or angled or curved vane on an upper surface thereof, and a shaft depending from the turbine head and extending at least partially through the orifice in the first planar member for operatively coupling the integrating member to the turbine. The turbine shaft is preferably disposed in an opening formed through a lower portion of the turbine head, and is preferably fixed for rotation with the turbine head. Alternatively, the turbine shaft may be integrally formed with the turbine head.

In certain of the fixed-shaft embodiments, the spray apparatus further includes a second planar member sealingly mounted against rotation within the housing between the integrating member and the fluid inlet. The second planar member includes a substantially central orifice within which the turbine shaft is carried for rotation, a plurality of first orifices therein, and a plurality of second orifices therein. An upstream portion of each of the coupled tubes is affixed in one of the first orifices of the second planar member, and a downstream portion of each of the coupled tubes extends at least partially through one of the fluid outlets. Thus, fluid flowing into the fluid inlet is directed through the coupled tubes via the first orifices.

In some of these certain embodiments, a second subset of the tubes are not coupled to the integrating member. Each of the non-coupled tubes has an upstream portion affixed in one of the second orifices of the second planar member, and a downstream portion that extends at least partially through one of the fluid outlets. Accordingly, fluid flowing into the fluid inlet is directed through the non-coupled tubes via the second orifices. The housing preferably defines a flow passage for selectively communicating with the first and second orifices of the second planar member. Accordingly, the spray apparatus of these certain embodiments preferably further includes a valve assembly for directing fluid in the flow passage to either: the first orifices of the second planar member; the second orifices of the second planar member; or a combination thereof.

The turbine shaft may be equipped with a cam portion positioned beneath and/or opposite the turbine head such that the cam portion rotates with the turbine head. The cam portion is carried within the orifice of the first planar member. The cam portion may optionally be integral with the turbine head.

In a particular one of these embodiments, the cam portion has a sloping vertical profile, and further includes a means for adjusting the elevation of the integrating member relative to the cam portion so as to induce engagement of the integrating member with varying elevations of the sloping vertical profile of the cam portion. This permits the range of oscillating of the integrating member resulting from rotation of the turbine to be adjusted.

In certain of these embodiments, the shaft is disposed for nutation within the orifice of the integrating member.

In other of these embodiments, the turbine further includes an eccentric portion carried about the shaft for rotation within the orifice of the integrating member, whereby spinning of the turbine about the axis of the shaft results in nutation of the turbine.

In still other of these embodiments, the shaft is a crankshaft having a first end portion mounted to the turbine head and a second end portion rotatably carried within the substantially central orifice in the first planar member. The second end portion of the crankshaft is axially offset from the axis of the crankshaft by a bend in the crankshaft intermediate the first and second end portions. The crankshaft is supported for rotation about a central axis within the housing by a second planar member sealingly mounted against rotation within the housing between the integrating member and the turbine head. The second planar member preferably includes a substantially central orifice within which the crankshaft is carried for rotation, and a plurality of noncentral orifices therein. An upstream portion of each of the tubes is affixed in one of the noncentral orifices of the second planar member, and a downstream portion of each of the tubes extends at least partially through one of the fluid outlets. Accordingly, fluid flowing into the fluid inlet is directed through the tubes via the noncentral orifices.

In a particular one of these embodiments, the inventive spray apparatus further includes an adjustable manifold disposed within the housing above the second planar member for directing fluid from the inlet to either: an outer sub-plurality of the noncentral orifices of the second planar member; an inner sub-plurality of the noncentral orifices of the second planar member; or a combination thereof.

In certain of these embodiments, the turbine includes an eccentric member carried about the turbine shaft opposite the turbine head such that the eccentric member rotates with the turbine head. The eccentric member is preferably carried within the orifice of the first planar member, and is nutated by rotation of the turbine head to induce orbiting of the integrating member.

In a particular one of these embodiments, a means for selectively pointing downstream end portions of the plurality of tubes is further provided. Accordingly, each of the coupled tubes preferably includes an elastomeric material. The pointing means preferably includes a set of spaced-apart protuberances on an outer surface of each of the coupled tubes defining a side recess between the protuberances. Each of the coupled tubes is disposed in one of a plurality of noncentral orifices formed in the first planar member, in such a manner that the first planar member is connected to the plurality of coupled tubes via the side recesses. An internally-threaded sleeve is carried for rotation about an externally-threaded sidewall portion of the housing. The sleeve has an annular groove formed in an inner surface thereof within which the first planar member is circumferentially carried. Thus, rotation of the sleeve induces vertical movement thereof that applies a vertical force to the coupled tubes at the respective side recesses.

As mentioned previously, particular embodiments of the inventive spray apparatus further include a second planar member sealingly mounted against rotation within the housing between the integrating member and the fluid inlet. The second planar member preferably includes a substantially central orifice within which the turbine shaft is carried for rotation, and a plurality of noncentral orifices therein. An upstream portion of each of the tubes is affixed in one of the noncentral orifices of the second planar member and a downstream portion of each of the tubes extends at least partially through one of the fluid outlets. Accordingly, fluid flowing into the fluid inlet is directed through the tubes via the noncentral orifices.

In certain of these embodiments, the housing defines a flow passage for communicating with the noncentral orifices of the second planar member, and the spray apparatus further includes a valve assembly for directing fluid in the flow passage to either: an outer sub-plurality of the noncentral orifices of the second planar member; an inner sub-plurality of the noncentral orifices of the second planar member; or a combination thereof. The valve assembly preferably includes a stop valve having a movable stem for closing portions of the flow passage, and an actuator for moving the stem as desired to direct the fluid flow.

In some of these flow-passage embodiments, the inventive spray apparatus further includes a third planar member for removably covering the inner sub-plurality of noncentral orifices of the second planar member. The third planar member has a sloped rim about at least a portion thereof. The movable valve stem is preferably equipped with a plug and a distal end, such that movement of the valve stem in a radially-inward direction results in the plug closing off a portion of the fluid passage communicating fluid to the outer sub-plurality of noncentral orifices of the second planar member. Movement of the valve stem in a radially-inward direction preferably results in the distal valve stem end engaging the sloped rim so as to remove the third planar member from the inner sub-plurality of noncentral orifices of the second planar member, prior to the plug closing off a portion of the fluid passage communicating fluid to the outer sub-plurality of noncentral orifices of the second planar member.

In a particular embodiment of the inventive spray apparatus, the integrating member includes stacked complementary upper and lower plates each having a plurality of slots therein. The slots of the upper plate overlie and are conversely oriented to respective slots of the lower plate, so as to effect a plurality of common constricted slot areas through the upper and lower plates for engaging the respective coupled fluid-dispensing tubes by the extension of portions of the respective coupled tubes through the common slot areas. Preferably, at least one of the complementary plates is rotatable with respect to the other of the complementary plates for moving the coupled tubes inwardly or outwardly with respect to the central axis.

Particular embodiments of the inventive spray apparatus include an additional planar member supported for limited rotation about the central axis within the housing. The additional planar member includes a plurality of noncentral angularly-oriented slots for engaging portions of the respective coupled fluid-dispensing tubes intermediate the downstream and upstream portions thereof by the extension of the coupled tube portions through the plurality of noncentral slots of the additional planar member. The additional planar member is rotatable with respect to the housing for moving the coupled tube portions inwardly or outwardly with respect to the central axis. This rotation is preferably achieved using an actuator carried on the housing.

In a particular embodiment of the inventive spray apparatus, the turbine shaft is carried in the orifices of the integrating member and the turbine such that the turbine is rotationally supported by the integrating member.

In particular embodiments of the inventive spray apparatus, the integrating member engages each of the coupled tubes at a similar location on each tube. The engagement location may be: at or near a downstream portion of each coupled tube; intermediate downstream and upstream portions of each coupled tube; or at or near an upstream portion of each coupled tube.

In the latter case, the integrating member preferably includes a plurality of orifices therein, and an upstream portion of each of the coupled tubes is affixed in one of the orifices of the integrating member. In this case, it is also preferable that a downstream portion of each of the tubes extends at least partially through one of the outlets, and that each of the outlets is equipped with an O-ring through which a portion of each of the tubes intermediate the upstream and downstream portions is pivotally carried. A plurality of sleeves are preferably each fitted about one of the tubes intermediate the integrating member and the outlet through which the tube extends.

It is further preferred that the oscillating of the integrating member effects a coordinated oscillating of the downstream portion of each of the coupled tubes. Such oscillating preferably includes at least one of circular, elliptical, and linear movement by the downstream portion of each of the coupled tubes.

In particular embodiments of the inventive spray apparatus, the tubes have downstream portions that extend at least partially through the respective fluid outlets. A plurality of flexible nozzles are preferably each carried within the fluid outlets about respective downstream portions of the tubes. The nozzles may have internal profiles that are sized and shaped to effect a desired range of nozzle movement under movement of the downstream portions of the coupled tubes within the fluid outlets. Alternatively, the downstream portions of the coupled tubes may have external profiles that are sized and shaped to effect a desired range of nozzle movement upon movement of the downstream portions of the coupled tubes with respect to the fluid outlets. Accordingly, in one particular embodiment, movement of downstream portions of the coupled tubes within the flexible nozzles results in a generally conical fluid spray pattern for each nozzle.

In particular embodiments of the inventive spray apparatus, the coupled fluid-dispensing tubes are integrally formed with the integrating member.

In particular embodiments of the inventive spray apparatus, the integrating member is planar and is supported for rotation about a central axis within the housing. The integrating member of certain of these embodiments includes a plurality of angularly-oriented slots for engaging portions of the respective coupled tubes intermediate the upstream and downstream portions thereof by the extension of the coupled tube portions through the angularly-oriented slots. The integrating member is rotatable with respect to the housing for moving the coupled tube portions. An actuator is preferably carried by the housing for rotating the integrating member.

In a particular embodiment, the inventive spray apparatus further includes an actuator for restricting oscillatory movement of the integrating member so as to restrict movement of the coupled tubes.

In another aspect, the present invention provides a spray apparatus, including a housing having a fluid inlet, and a plurality of tubes for dispensing fluid from the housing. An integrating member is operatively coupled to at least- a subset of the plurality of tubes for effecting coordinated movement of the coupled tubes in response to movement of the integrating member. An actuator is also provided for inducing movement of the integrating member.

In particular embodiments of the inventive spray apparatus, the integrating member includes a plurality of angularly-oriented slots for engaging portions of the respective coupled tubes intermediate the upstream and downstream portions thereof by the extension of the coupled tube portions through the plurality of angularly-oriented slots. The integrating member is rotatable by the actuator with respect to the housing for moving the coupled tube portions. The actuator preferably includes a slidable lever extending through a slot in a side wall of the housing. The lever has an inner portion that engages the integrating member and an outer portion disposed outside the housing.

In a further aspect, the present invention provides a spray apparatus, including a housing having a fluid inlet and a plurality of fluid outlets, and a plurality of tubes each exclusively disposed in one of the fluid outlets for dispensing fluid from the housing. An integrating member is operatively coupled to at least a subset of the plurality of tubes for effecting coordinated movement of the coupled tubes in the respective plurality of fluid outlets in response to movement of the integrating member. An actuator is also provided for inducing movement of the integrating member.

In various embodiments of the inventive spray apparatus, the actuator includes a turbine carried for rotary movement within the housing under fluid flow from the fluid inlet to one or more of the fluid outlets, and the integrating member is operatively coupled to the turbine for oscillatory movement relative to the housing under rotary movement of the turbine.

In a further aspect, the present invention provides a method of spraying fluid, including the steps of delivering pressurized fluid to a plurality of dispensing tubes (e.g., via a housing that carries the tubes), coupling together at least a subset of the plurality of tubes (e.g., via an integrating member) so that the coupled tubes move in a coordinated fashion under an actuating force, and applying an actuating force to the coupled tubes (e.g., via an actuator, such as a turbine, carried within a housing) to effect a desired fluid spray through the tubes.

In a still further aspect, the present invention provides a spray apparatus, including a housing having a fluid inlet, an actuator carried for rotary movement within the housing under fluid flow from the fluid inlet, an integrating member operatively coupled to the actuator for oscillatory movement relative to the housing under rotary movement of the actuator, and a plurality of tubes for dispensing fluid from the housing. At least a subset of the plurality of tubes is operatively-coupled to the integrating member for coordinated movement of the coupled tubes.

A still further aspect of the present invention provides a spray apparatus, including a housing having a fluid inlet, and a plurality of tubes for dispensing fluid from the housing. A means is further provided for converting energy from fluid delivered through the fluid inlet into coordinated movement of at least a subset of the plurality of tubes. The converting means preferably includes an actuator (e.g., a turbine) and an integrating member in accordance with one or more of the various embodiments described herein, as well as equivalents thereto.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

FIGS. 11-11A show detailed sectional side views of alternative fluid-dispensing tubes and elastomeric sleeve nozzles, compared to those shown in FIGS. 9-10.

FIGS. 12-14 show sectional side and top views of another embodiment of a spray apparatus employing an enclosed turbine and an integrating member positioned beneath the apparatus's flow chamber in accordance with the present invention.

DETAILED DESCRIPTION OF THE INVENTION

With reference now to FIGS. 1-45 (with "X" in the following reference numbers representing the number of the respective figure, e.g., "X10" means "1210" in FIG. 12), the present invention provides a spray apparatus X10, including a housing X12 having a fluid inlet X14 and a plurality of fluid outlets X16. The housing X12 is preferably made of a durable material known in the art to be suitable for use in showering applications, such as acrylonitrile butadiene styrene (ABS), acetal plastic, or an equivalent. It is presently preferred that at least a portion of the housing X12 is substantially cylindrical, as is shown more clearly in the housing embodiment 4112 of FIG. 41B.

A plurality of tubes X18 are further provided, each preferably being exclusively disposed in one of the fluid outlets X16, for dispensing fluid from the housing X12. An integrating member X20 is operatively coupled to at least a subset X19 of the plurality of tubes X18 for effecting coordinated movement of the coupled tubes X19 in the respective plurality of fluid outlets X16 in response to movement of the integrating member X20. Typically, no bearings are required since the contact forces are not significant and the moving parts are designed to be self-lubricated by the water flowing through the spray apparatus X10.

An actuator X22 is also provided for inducing movement of the integrating member X20. The actuator X22 preferably includes a turbine X24 carried for rotary movement within the housing X12 under fluid flow from the fluid inlet X14 to one or more of the fluid outlets X16. The fluid inlet X14 of the housing X12 preferably directs fluid towards the actuator X22 in a direction selected from axial, radial, tangential, and combinations thereof.

The integrating member X20 preferably includes a first planar member X26 having a substantially central orifice X28. The integrating member X20 is preferably operatively coupled to the turbine X24 for oscillatory movement relative to the housing X12 under rotary movement of the turbine X24. The rotary movement of the turbine may include spinning, nutating, or a combination thereof. The nutating of the turbine X24 may include a wobbling motion (see FIGS. 1-4, 20, 22).

Figure 1:
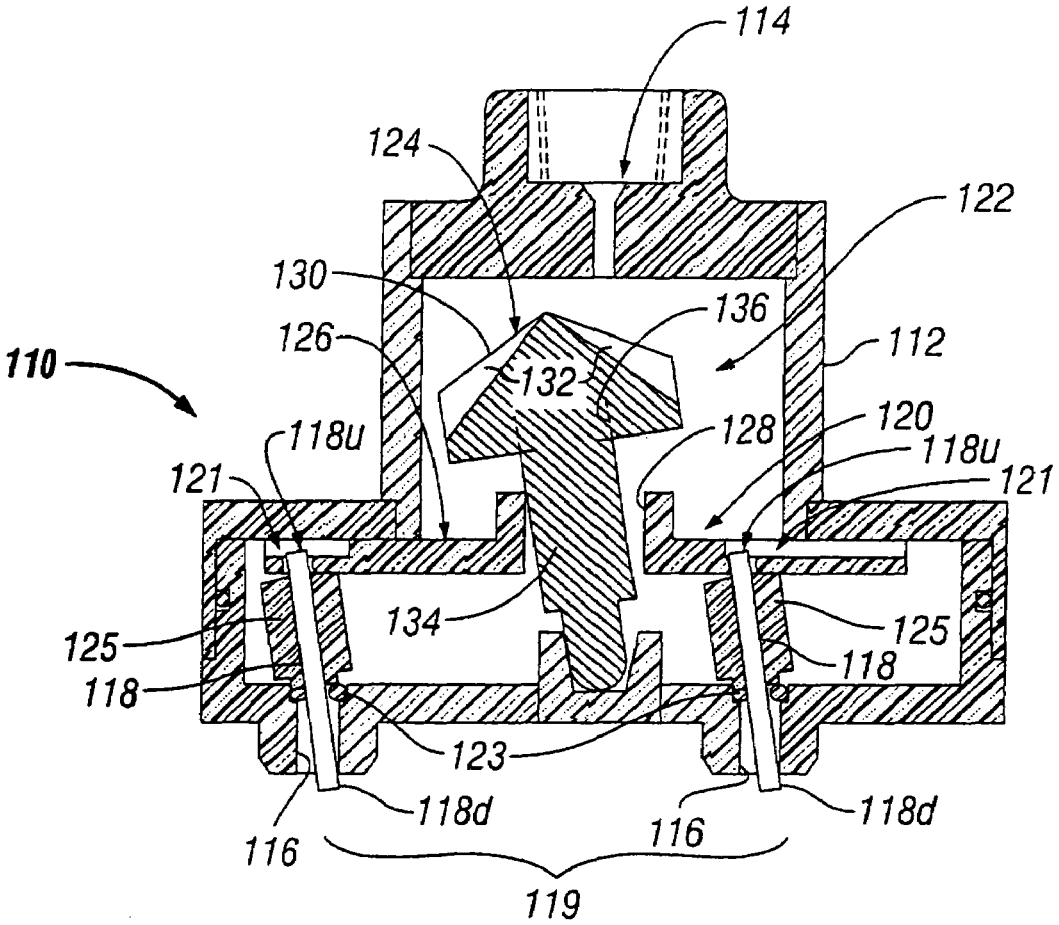
FIG. 1 shows a sectional side view of one embodiment of a spray apparatus employing a wobble turbine in accordance with the present invention.
Figure 45:
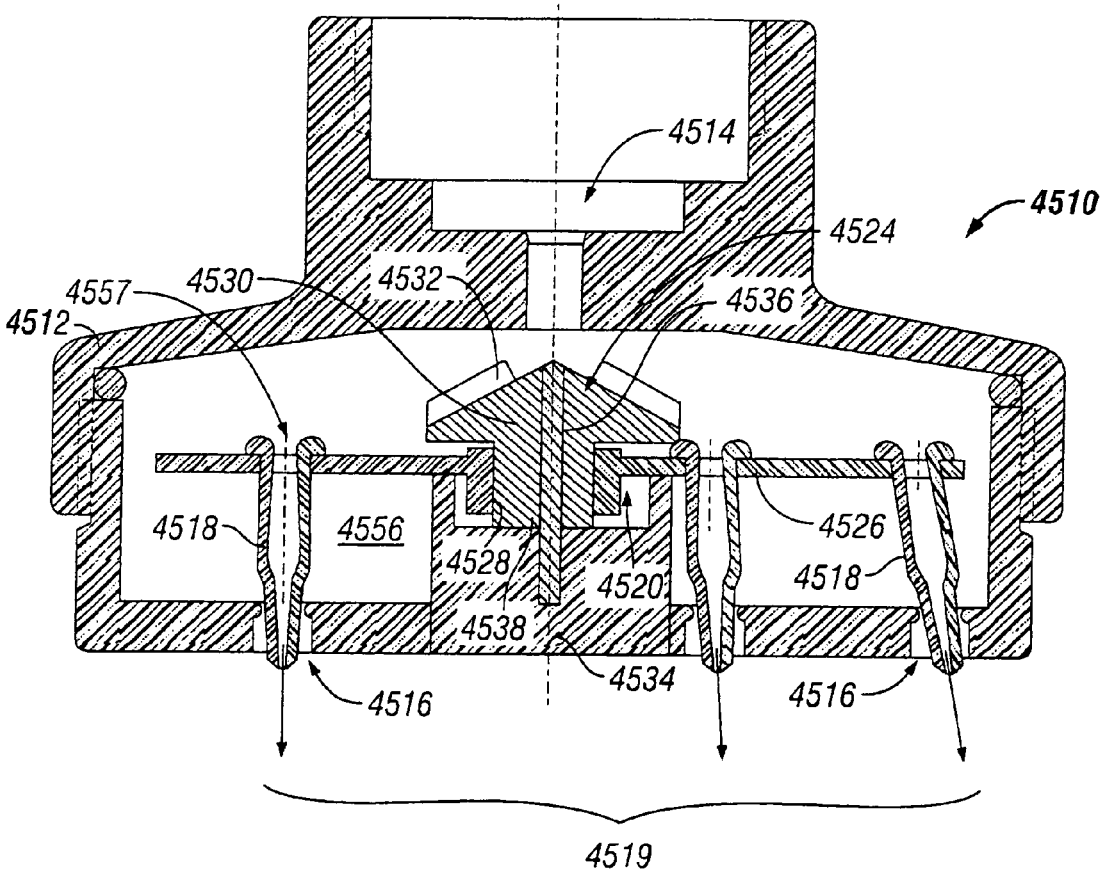
FIG. 45 shows a sectional side view of another, simplified alternative embodiment of a spray apparatus employing an integrating member disposed within the flow chamber.

The turbine X24 preferably includes a head X30 having at least one angled or angled or curved vane (and preferably two or more radially-symmetrical vanes) X32 on an upper surface thereof, and a shaft X34 depending from the turbine head X30 and extending at least partially through the orifice X28 in the first planar member X26 for operatively coupling the integrating member X20 to the turbine X24. The turbine shaft X34 is preferably disposed in an orifice X36 formed through a lower portion of the turbine head X30, and is preferably fixed for rotation with the turbine head X30. Alternatively, as shown in FIGS. 1 and 45, the turbine shaft X34 may be integrally formed with the turbine head X30.

The turbine shaft may be equipped with a cam portion X38 positioned beneath and/or opposite the turbine head X30, and affixed to the turbine shaft X34 such that the cam portion X38 rotates with the turbine head X30. The cam portion X38 is carried within the orifice X28 of the first planar member X26. The cam portion X38 may optionally be integral with the turbine head X30, as illustrated in FIGS. 5-8, 33, and 45.

The oscillatory movement of the integrating member X20 may include at least one of circular, elliptical, and linear movement. The oscillating of the integrating member X20 preferably effects a coordinated oscillating of the downstream portion of each of the coupled tubes X19. The coupled tubes X19 are preferably oriented with respect to one another in a configuration that is parallel, divergent, convergent, or a combination thereof. Such oscillating preferably includes at least one of circular, elliptical, and linear movement by the downstream portion of each of the coupled tubes X19.

The integrating member X20 preferably engages each of the coupled tubes X19 at a similar location on each tube. The engagement location may be: at or near a downstream portion of each coupled tube (see FIGS. 12-30, 35, and 37-44); intermediate downstream and upstream portions of each coupled tube (see FIGS. 33-34); or at or near an upstream portion of each coupled tube (see FIGS. 1-11, 45).

The fluid-dispensing tubes X18 may be rigid or flexible, with the flexibility being preferably provided by manufacturing the tubes of elastomeric materials including a natural polymer, a synthetic polymer, or a combination thereof. Additionally, the tubes X18 may each be sealingly disposed in one of the fluid outlets X16 (e.g., via O-rings, sleeves, etc.), although this is not essential since some leakage can be accommodated by the inventive spray apparatus X10.

Turning now to the particular figures, FIG. 1 shows a sectional side view of one embodiment of a spray apparatus 110 employing an actuator 122 in the form of a wobble turbine 124. The wobble turbine 124 is energized by water flowing through fluid inlet 114, in a manner that is known in the art (see, e.g., U.S. Pat. No. 6,092,739 to Clearman et al.), resulting in rotary movement of the turbine 124 which may include spinning, nutating, or a combination thereof about the central axis of the housing 112. Preferably, the output shaft 134 of the turbine is nutated by the rotary movement of the turbine 124 within the orifice 128 in the first planar member 126, resulting in oscillation of the integrating member 120 including the first planar member 126.

The integrating member 120 engages each of the coupled tubes 119 at or near an upstream portion of each coupled tube. For this purpose, the integrating member 120 preferably includes a plurality of orifices 121 therein, and an upstream portion 118*u* of each of the coupled tubes 119 is affixed in one of the orifices 121 of the integrating member 120. The oscillation of the integrating member 120 results in streams from the tubes moving thru substantially conical patterns. Similar structure is employed in other embodiments of the inventive spray apparatus (see, e.g., FIGS. 2-11), although the integrating member and coupled tubes are integrally formed in the embodiments of FIG. 7-11.

It is also preferable in certain embodiments (see, e.g., FIG. 1) that a downstream portion 118*d* of each of the tubes 118 (whether coupled or not) extends at least partially through one of the outlets 116 in the housing 112, and that each of the outlets 116 is equipped with an O-ring 123 through which a portion of each of the tubes intermediate the upstream and downstream portions 118*u*, 118*d* is pivotally carried. A plurality of sleeves 125 are preferably each fitted about one of the coupled tubes 119 intermediate the integrating member 122 and the fluid outlet 116 through which each tube 119 extends.

Figure 2A:
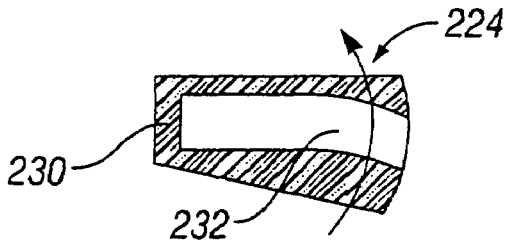
FIG. 2A shows a top view of the turbine employed by the spray apparatus of FIG. 2.
Figure 2:
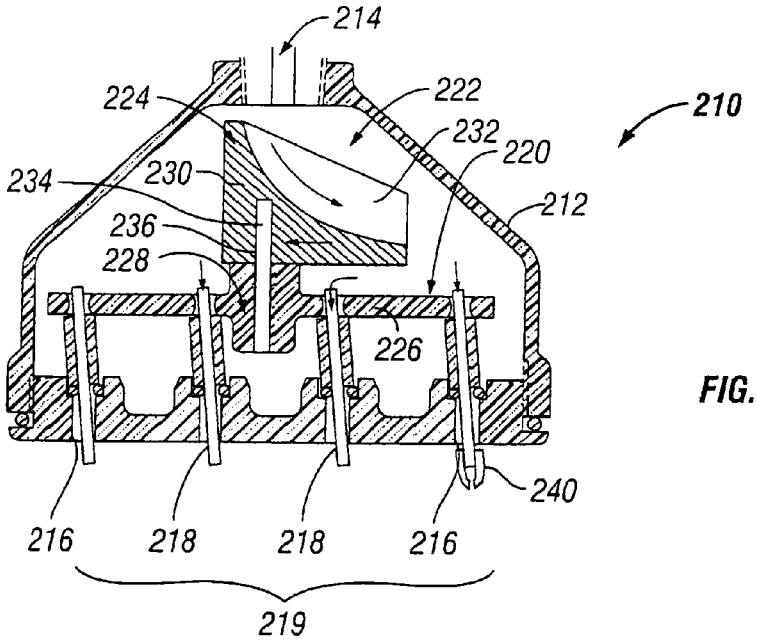
FIG. 2 shows a sectional side view of another embodiment of a spray apparatus employing a channel turbine to generate oscillatory movement of an integrating member in accordance with the present invention.

FIG. 2 shows a sectional side view of another embodiment of a spray apparatus 210 employing an actuator 222 in the form of a "channel" turbine 224 to generate oscillatory movement of an integrating member 220 having a first planar member 226. A turbine shaft 234 is carried in the orifices 228, 236 of the integrating member and the turbine, such that the turbine is rotationally supported by the integrating member (see also FIGS. 3-4, which employ similar support structure).

FIG. 2A shows a top view of the asymmetric turbine head 230 having a single angled or curved vane 232 for translating the energy of the water delivered through the fluid inlet 214 into rotary movement of the turbine 224. Since the integrating member 220 is free to move (within constraints) vertically as well as horizontally (this freedom of movement is shared by the embodiments of FIGS. 1-4), the integrating member undergoes fairly complex oscillating movement under the rotary movement of the turbine 224. The turbine 224 is known as a rotating channel turbine, wherein the force of the water applied via fluid inlet 214 against the angled or curved vane 232 pushes the turbine 224 and its supporting shaft 234 "back" off its nominal position. The continuous application of such force by the water results in an oscillating movement of the integrating member 220. Similar channel turbines are employed by the embodiments of FIGS. 3-4.

Figure 3:
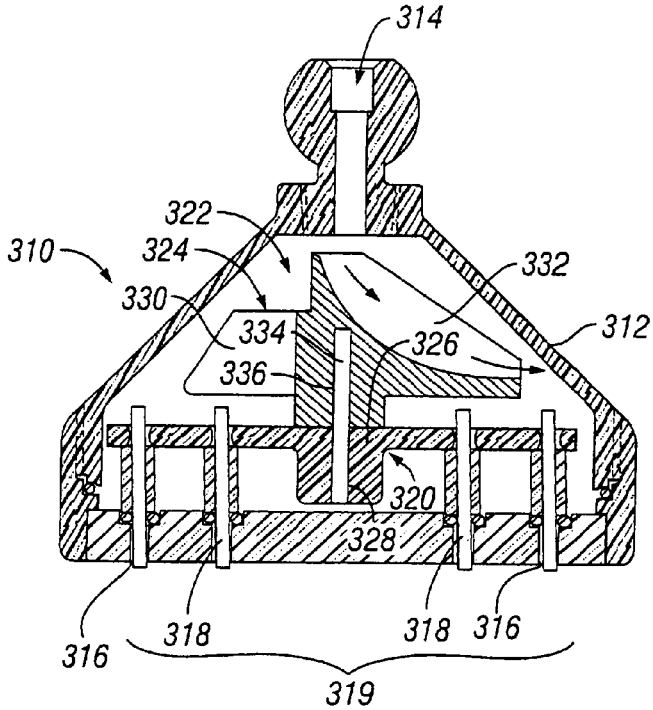
FIG. 3 shows a sectional side view of another embodiment of a spray apparatus that is similar to that of FIG. 2, but employing a different turbine design.

FIG. 3 shows a sectional side view of another embodiment of a spray apparatus that is similar to that of FIG. 2, but employing a different turbine design. More particularly, the turbine head 330 is equipped with a lateral component opposite the single angled or curved vane 332 to reduce the imbalance during rotary movement of the turbine 324, resulting in more controlled oscillation of the integrating member 320 including the first planar member 326. This in turn results in more controlled movement by the fluid-dispensing tubes 318. Alternatively, the turbine head 330 could employ a more conventional design shape (like that of FIGS. 5, 8, etc.), but nevertheless have a rotating imbalance (e.g., greater mass density on one side) to achieve the desired oscillation of the integrating member 320.

Figure 4:
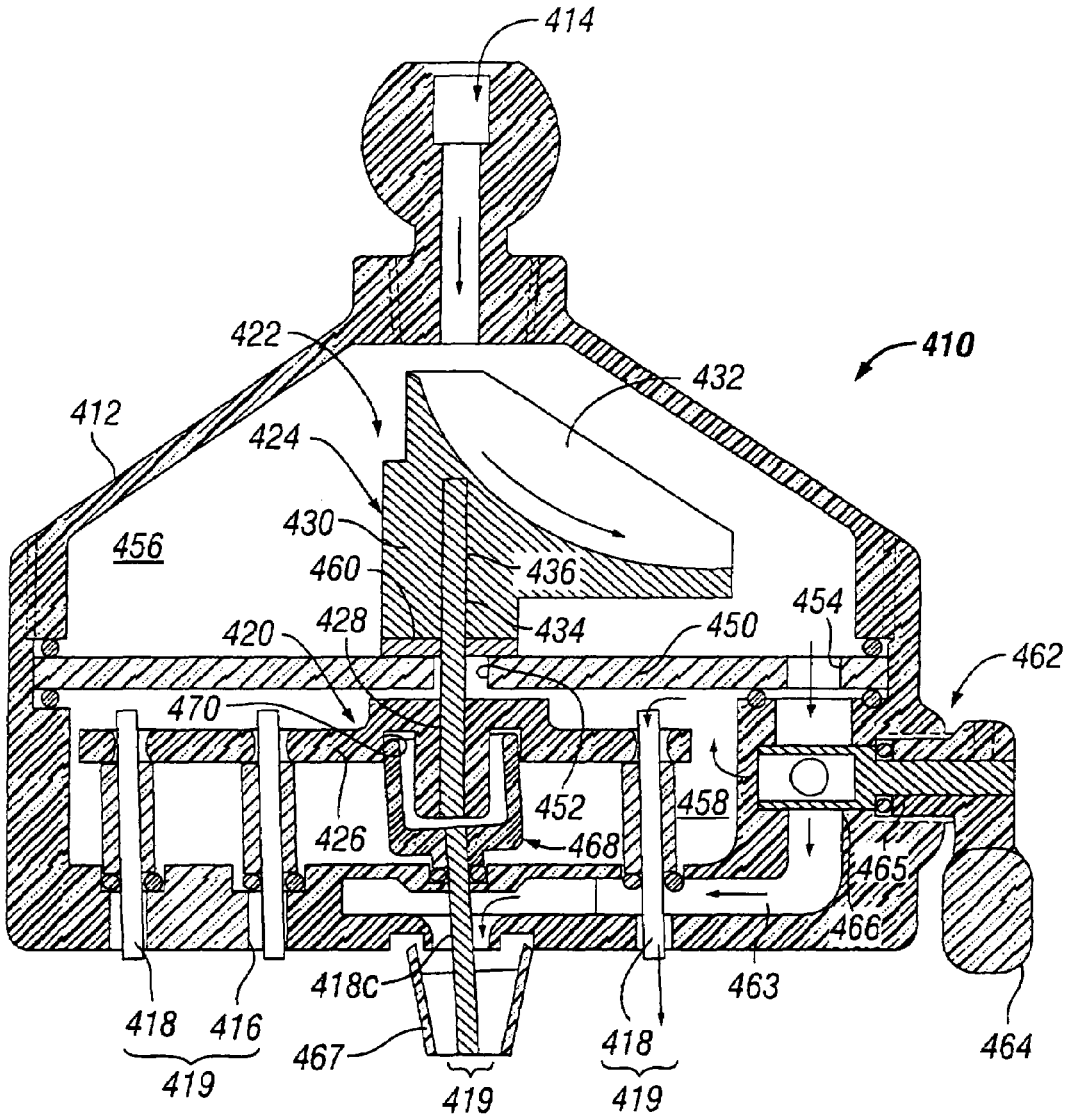
FIG. 4 a modified version of the spray apparatus of FIG. 2 wherein the apparatus is equipped with a flow diverter to create a massage effect.

FIG. 4 a modified version of the spray apparatus of FIG. 2 wherein the apparatus 410 is equipped with a flow diverter to create a massage effect. A second planar member 450 is mounted across the body 412 of the spray apparatus 410. The second planar member 450 is equipped with a first orifice 452 for conducting the turbine shaft 434 through the second planar member, and a second orifice 454 for conducting water in the upper flow chamber 456 to the lower flow chamber 458. The first orifice 452 is sealed with a gasket 460 to prevent water from passing therethrough, thereby ensuring that water flowing into the upper chamber 456 of the housing 412 via the fluid inlet 414 will subsequently pass through the second orifice 454.

A rotary valve assembly 462 directs water flowing through the second orifice 454 to either: the coupled plurality 419 of fluid-dispensing tubes 418; the central massage nozzle 467 (via conduit 463); or a combination thereof. The rotary valve assembly 462 includes an actuator handle 464, a plug valve body 466, and a shaft 465 connecting the two for transmission of applied torque from the handle 464 to the plug valve body 466.

A cup assembly 468 is restrained loosely in a recess 470 of the integrating member 420. A central rod 418*c* is affixed to the cup assembly 468, and is constrained so as to pivot in an integrated fashion with the tubes 418. Thus, central massage nozzle 467, which is affixed to central rod 418*c*, will experience movement that preferably includes at least one of circular, elliptical, and linear movement (along with the other coupled tubes 419) under oscillating motion of the integrating member 420.

Figure 5:
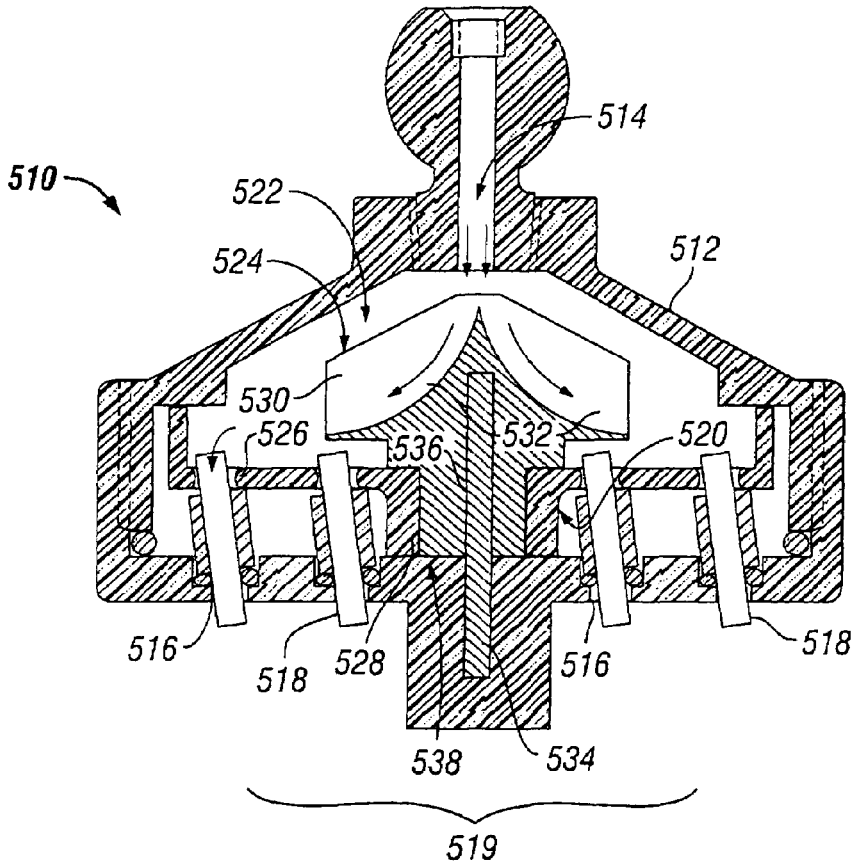
FIG. 5 a sectional side view of another embodiment of a spray apparatus having a turbine rotating on a central shaft and employing a cam action to generate oscillatory movement of an integrating member in accordance with the present invention.

FIG. 5 shows a sectional side view of another embodiment of a spray apparatus 510 having a turbine 524 rotating on a central shaft 534 and employing a cam portion 538 to generate oscillatory movement of an integrating member 520 in accordance with the present invention. The cam portion 538 is defined by an eccentric lower portion of the turbine 524 carried about the shaft 534 for rotation within the orifice 528 of the integrating member 520, whereby spinning of the turbine about the axis of the shaft 534 results in nutation of the turbine 538. Similar structure is employed in the embodiments of FIGS. 6-11 to achieve the camming action useful for oscillating the respective integrating members.

Figure 6A:
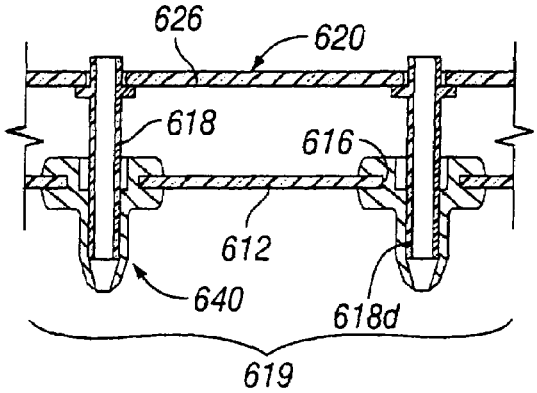
FIGS. 6A-B show examples of fluid-dispensing tubes each having elastomeric sleeve nozzles in accordance with the present invention.
Figure 6B:
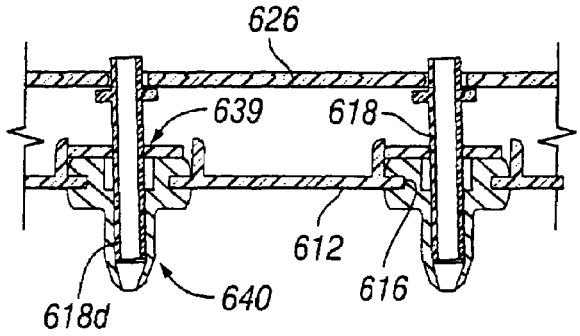

FIGS. 6A-B show examples of fluid-dispensing tubes 618 each having elastomeric sleeve nozzles 640 for focusing the water discharged through the fluid-dispensing tubes 618 to achieve a desirable spray pattern in accordance with the present invention. The sleeve nozzles 640 are preferably consistent with known rubber-tipped nozzles, but exhibit increased utility (e.g., easily deformable to dislodge lime deposits, etc.) in the inventive spray apparatus which employs sweeping sprays. The tubes 618 have downstream portions 618*d* that extend at least partially through the respective fluid outlets 616. Floating disks 639 are optionally applied (see FIG. 6B) to restrict the degree of non-linear flexing movement by the coupled tubes 619 (e.g., to reduce the vigorousness of the resulting shower).

FIGS. 7-11 illustrate a plurality of flexible nozzles (X40) each preferably being carried within the fluid outlets (X16) about respective downstream portions (X18*d*) of the coupled tubes (X19). The nozzles (X40) are integrally formed in a web or matrix (X31), and may have internal profiles that are sized and shaped (see, e.g., the stepped internal diameter of the nozzle 940*a* in FIG. 9) to effect a desired range of nozzle movement under movement of the downstream portions of the coupled tubes within the fluid outlets. Alternatively, the downstream portions (X18*d*) of the coupled tubes may have external profiles that are sized and shaped (see, e.g., FIG. 11) to effect a desired range of nozzle movement upon movement of the downstream portions of the coupled tubes with respect to the fluid outlets. Accordingly, movement of downstream portions (X18*d*) of the coupled tubes within the flexible nozzles (X40) results in a generally conical fluid spray pattern for each nozzle (similar to that shown in FIG. 19).

Figure 7:
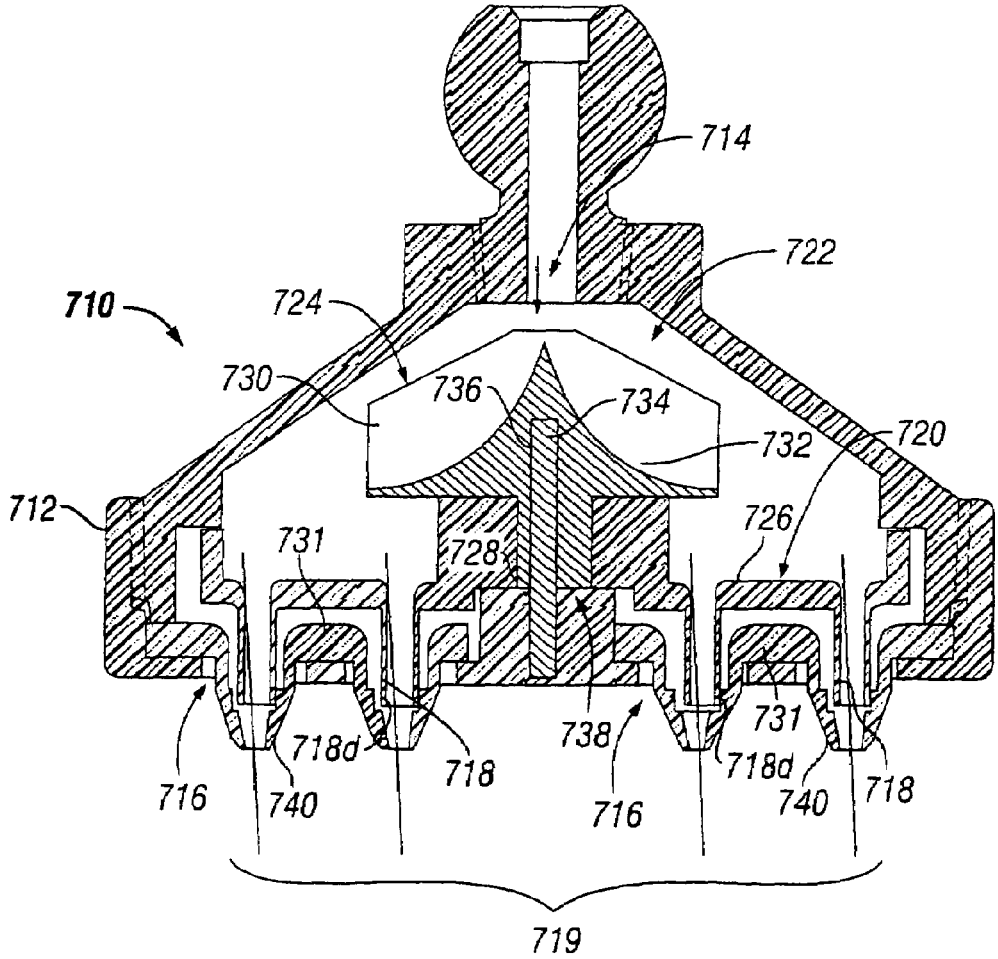
FIG. 7 shows a sectional side view of another embodiment of a spray apparatus that is similar to that of FIG. 5, but having fluid-dispensing tubes that are integrally formed with the integrating member and disposed within elastomeric sleeve nozzles like that of FIG. 6.
Figure 8:
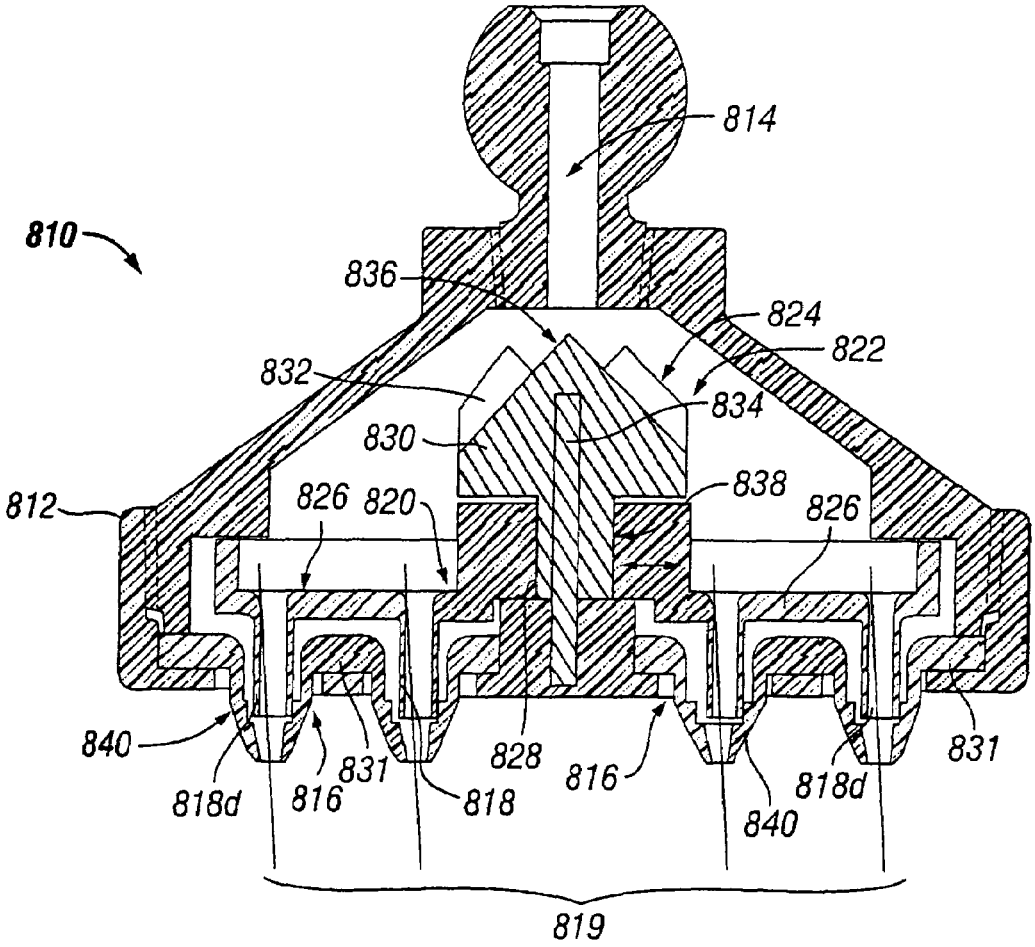
FIG. 8 shows a sectional side view of another embodiment of a spray apparatus that is similar to that of FIG. 7, but employing a multi-bladed turbine.
Figure 9:
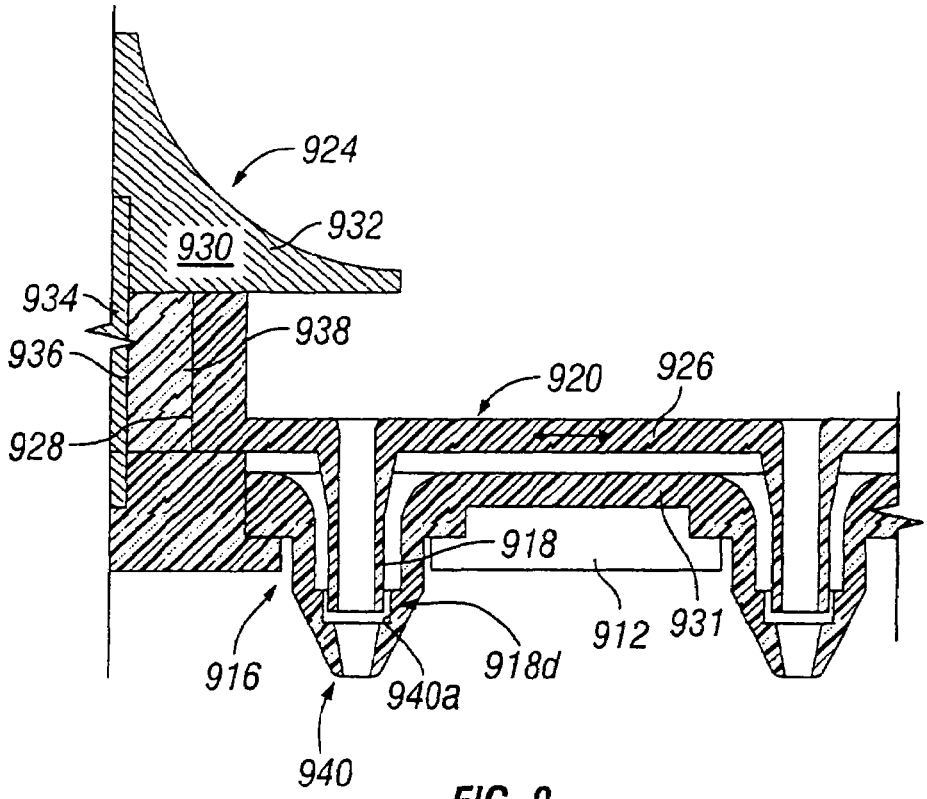
FIGS. 9 and 10 show detailed sectional side views of the fluid-dispensing tubes and elastomeric sleeve nozzles of the embodiments of FIGS. 7-8 in the nominal position (FIG. 9) and offset position (FIG. 10).
Figure 10:
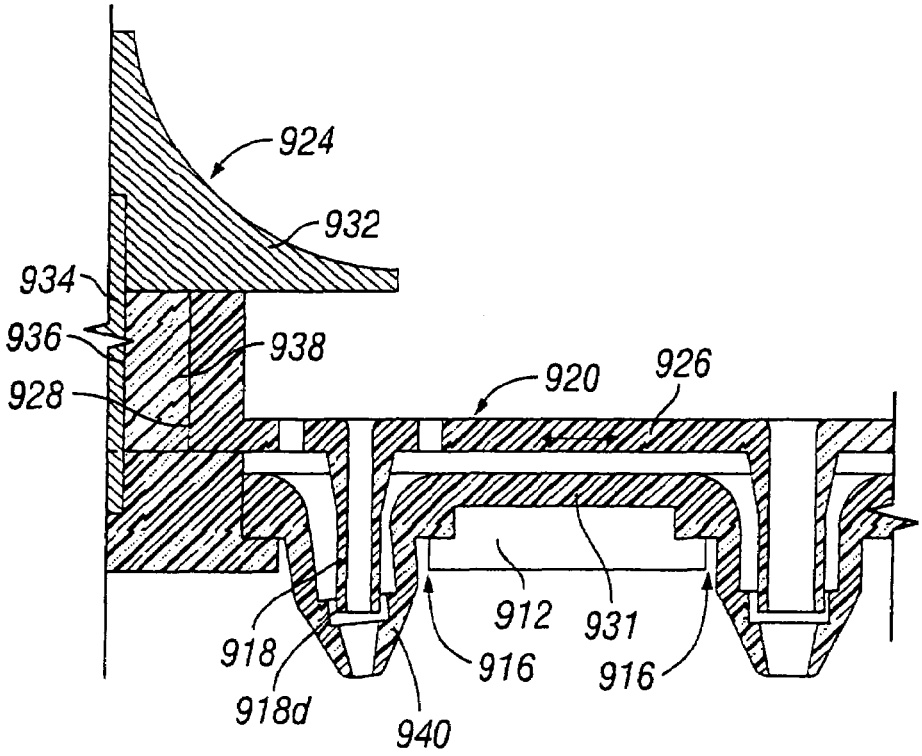

The embodiments shown in FIGS. 7 and 8 are quite similar, except for the respective turbine heads 730 (fewer vanes 732), 830 (more vanes 832).

Those skilled in the art and given the benefit of this disclosure will appreciate that FIGS. 1-11 employ integrating members disposed within a primary flow chamber within the housing (X12). Most of the figures that will now described, however, employ integrating members disposed beneath the primary flow chamber (unless otherwise indicated).

Figure 13:
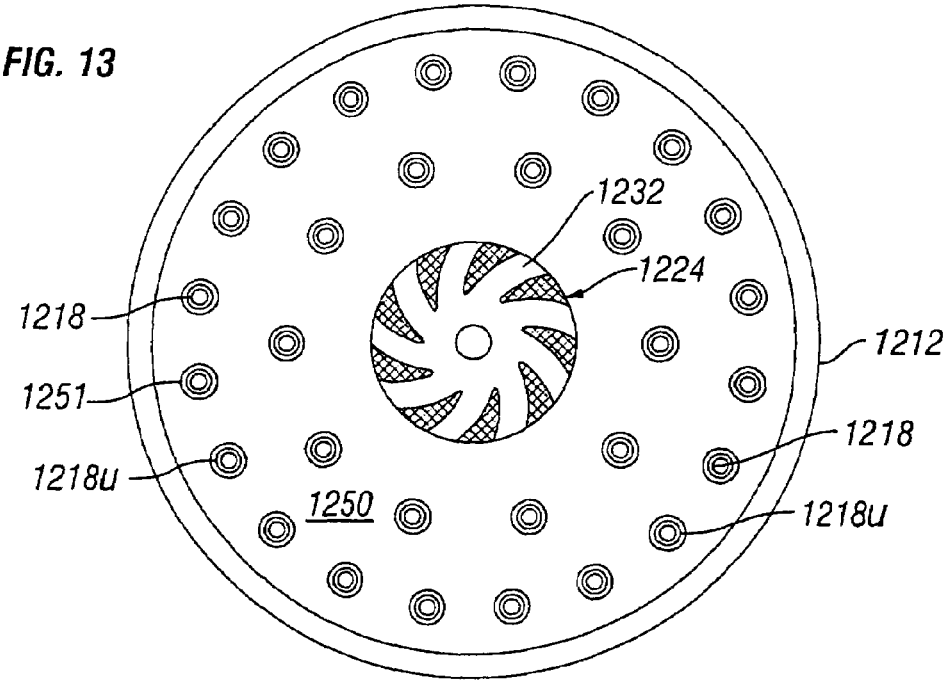
Figure 14:
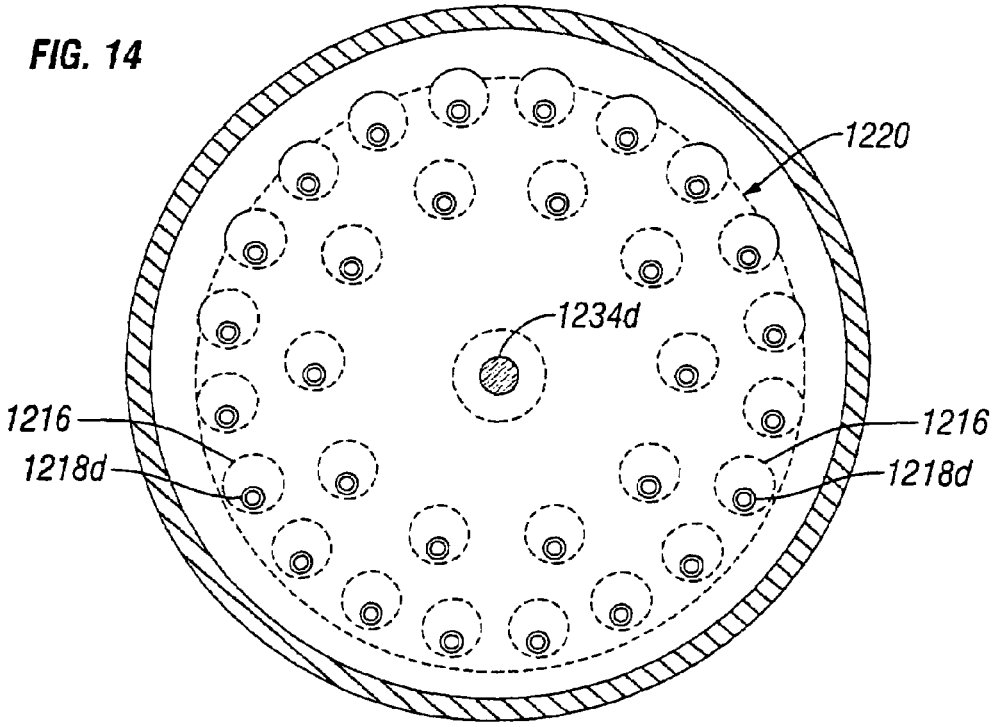

FIGS. 12-14 show an embodiment of a spray apparatus 1210 wherein the turbine 1224 is attached to a crankshaft 1234 that extends for rotation through a second planar member 1250. The rotating crankshaft 1234 drives the integrating member 1220 outside the flow chamber 1256. The integrating member 1220 including the first planar member 1226 is oscillated within the lower chamber 1258 to induce movement of the coupled fluid-dispensing tubes 1219 and achieve a desirable spray pattern. This embodiment, as well as others employing a second planar member (e.g., FIGS. 13-30) for carrying the upstream end of the fluid-dispensing tubes, has the advantage of imposing little or no pressure on the tubes 1218. The tubes 1218 serve to give the discharged water direction and shape (without discrete nozzles), but require little force to move. No seal is required for the crankshaft 1234, since leaks around the crankshaft 1234 can be absorbed into the shower streams.

The crankshaft has a first end portion 1234*u* mounted to the turbine head within orifice 1236, and a second end portion 1234*d* rotatably carried within the substantially central orifice 1228 in the first planar member 1226. The second end portion 1234*d* of the crankshaft 1234 is axially offset from the axis of the crankshaft by a bend in the crankshaft intermediate the first and second end portions. The crankshaft 1234 is supported for rotation about a central axis within the housing by the second planar member 1250 which is sealingly mounted against rotation within the housing between the integrating member 1220 and the turbine head 1230. The second planar member 1250 preferably includes a substantially central orifice 1252 within which the crankshaft 1234 is carried for rotation, and a plurality of noncentral orifices 1251 therein. An upstream portion 1218*u* of each of the tubes 1218 is affixed in one of the noncentral orifices 1251 of the second planar member 1250. A downstream portion 1218*d* of each of the tubes 1218 extends at least partially through one of the fluid outlets 1216. Accordingly, water flowing into the fluid 1214 inlet is directed through the tubes 1218, via the noncentral orifices 1251, to produce a showering spray.

Figure 15:
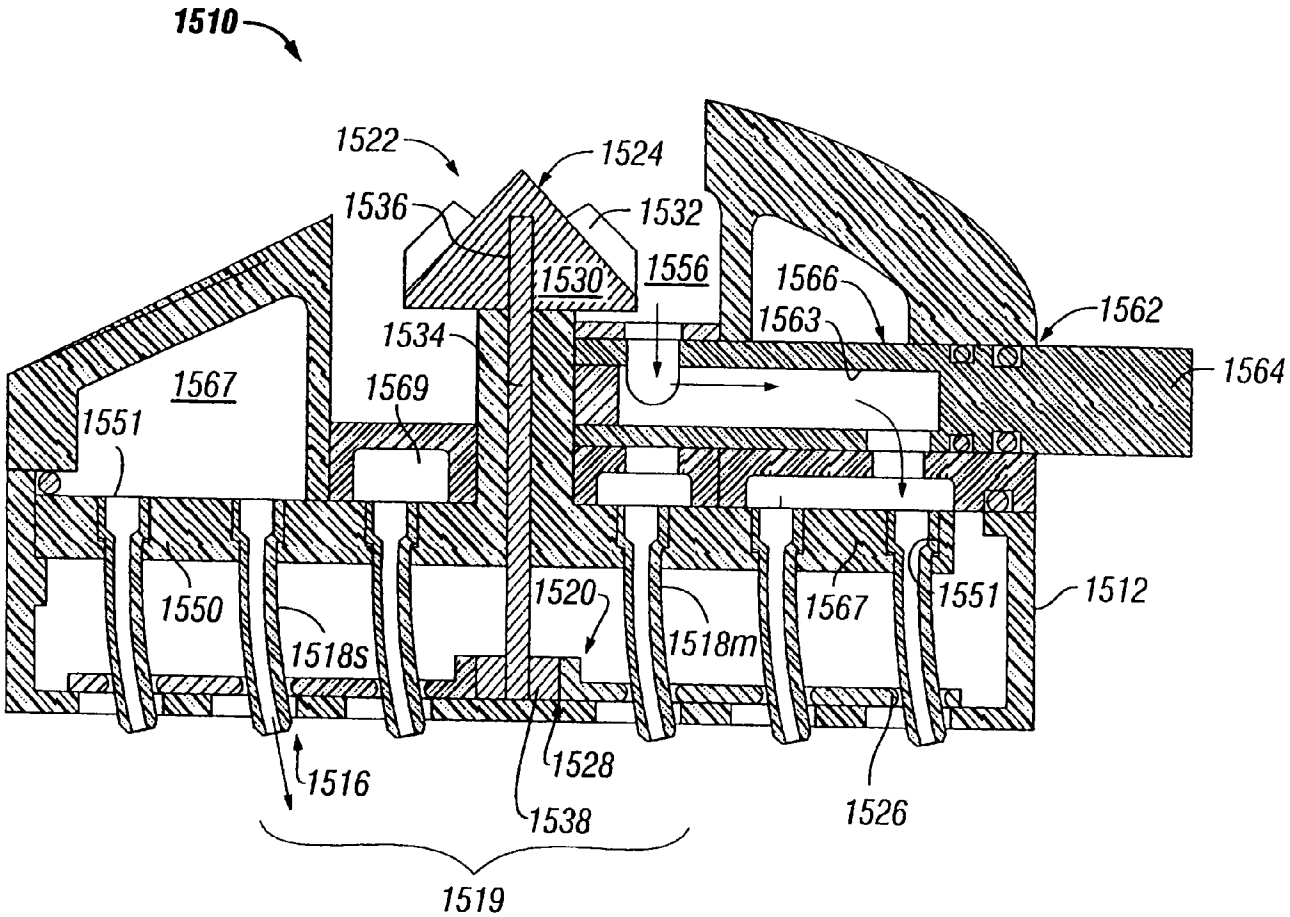
FIGS. 15-15A show sectional side views of another embodiment of a spray apparatus that is similar to that of FIG. 12, but employing a camshaft rather than a crankshaft and being further equipped with a flow diverter system for achieving a massage effect in accordance with the present invention.
Figure 15A:
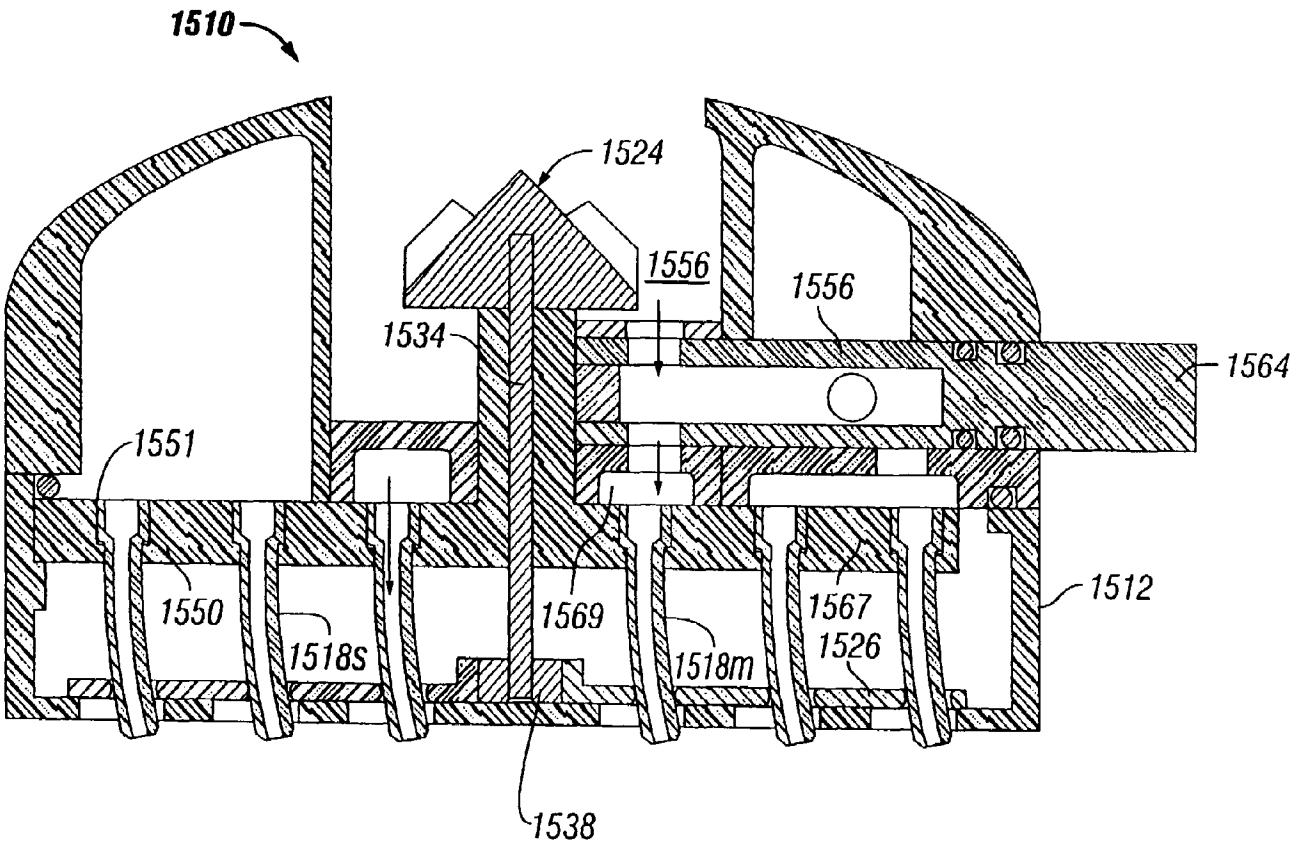

FIGS. 15 and 15A show sectional side views of another embodiment of a spray apparatus 1510 that is similar to that of FIG. 12, but employing a camshaft 1534 rather than a crankshaft. The turbine thus employs an eccentric or cam portion 1538 carried about the shaft 1534 for rotation within the orifice 1528 of the integrating member 1520. Accordingly, spinning of the turbine 1524 about the axis of the shaft 1534 results in nutation of the turbine 1538 sufficient to oscillate the integrating member 1520.

The spray apparatus 1510 is further equipped with a flow diverter system 1562 for achieving a massage effect. The flow diverter system 1562 includes an adjustable manifold or plug valve body 1566 disposed within a cylindrical bore in the housing above the second planar member for directing fluid in the flow chamber 1556 to either: an outer subplurality of the noncentral orifices 1551 of the second planar member 1550, via shower chamber 1567; an inner subplurality of the noncentral orifices 1551 of the second planar member 1550, via massage chamber 1569; or a combination thereof. The plug valve body 1566 is actuated by a handle 1564 that selectively rotates that plug valve body 1566 about its axis to achieve the desired flow configuration. Thus, in the configuration depicted in FIG. 15, the plug valve body 1566 has been rotated to open flow chamber 1556 to a conduit 1563 in the valve body 1566 whereby the fluid flows into channel or chamber 1567 to provide pressurized water to the outer sets of fluid-dispensing tubes 1518*s*. In the configuration depicted in FIG. 15A, the plug valve body 1566 has been rotated to open flow chamber 1556 to the channel or chamber 1569 to provide pressurized water to the inner sets of fluid-dispensing tubes 1518*m*.

Figure 16:
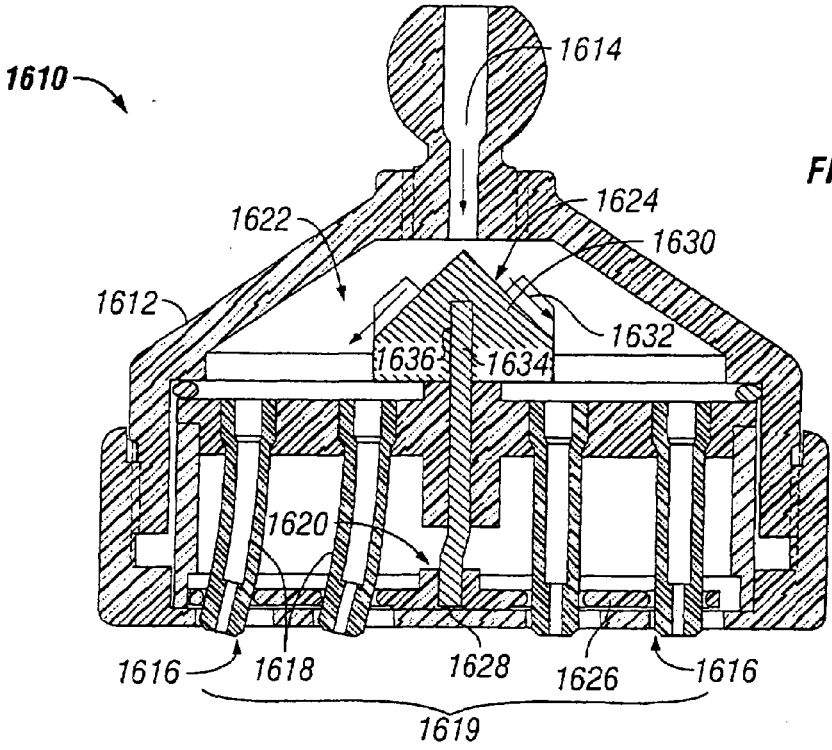
FIG. 16 shows a sectional side view of another embodiment of a spray apparatus that is similar to that of FIG. 12, but employing a semi-open turbine design instead of an enclosed turbine design, in accordance with the present invention.
Figure 17A:
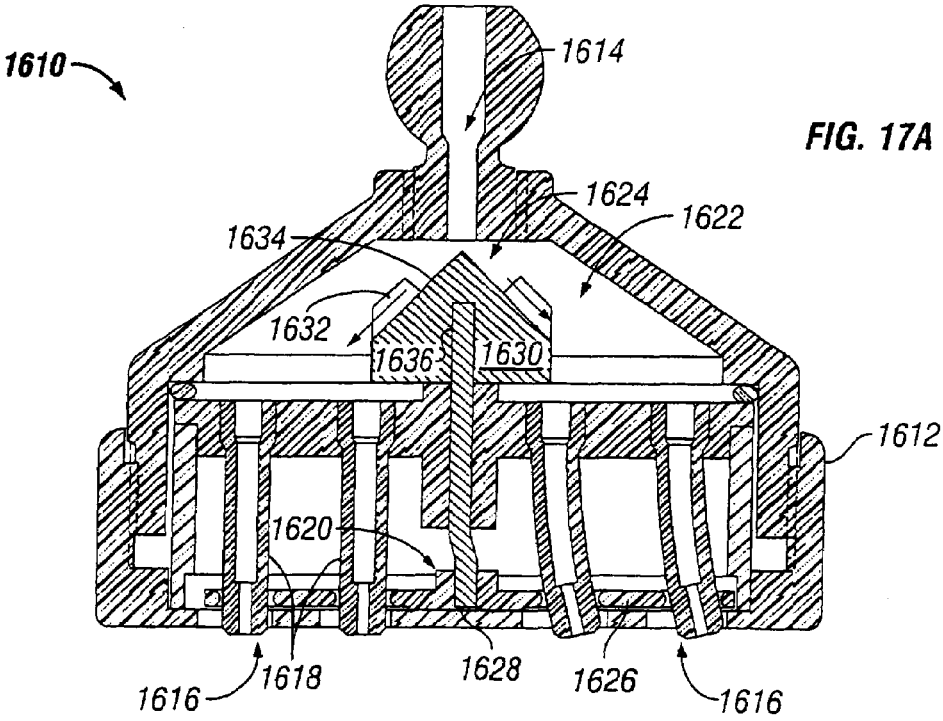
FIGS. 17A-B are sequential views of the spray apparatus of FIG. 16, showing the movement of the fluid-dispensing tubes under rotation of the turbine crankshaft and oscillation of the integrating member.
Figure 17B:
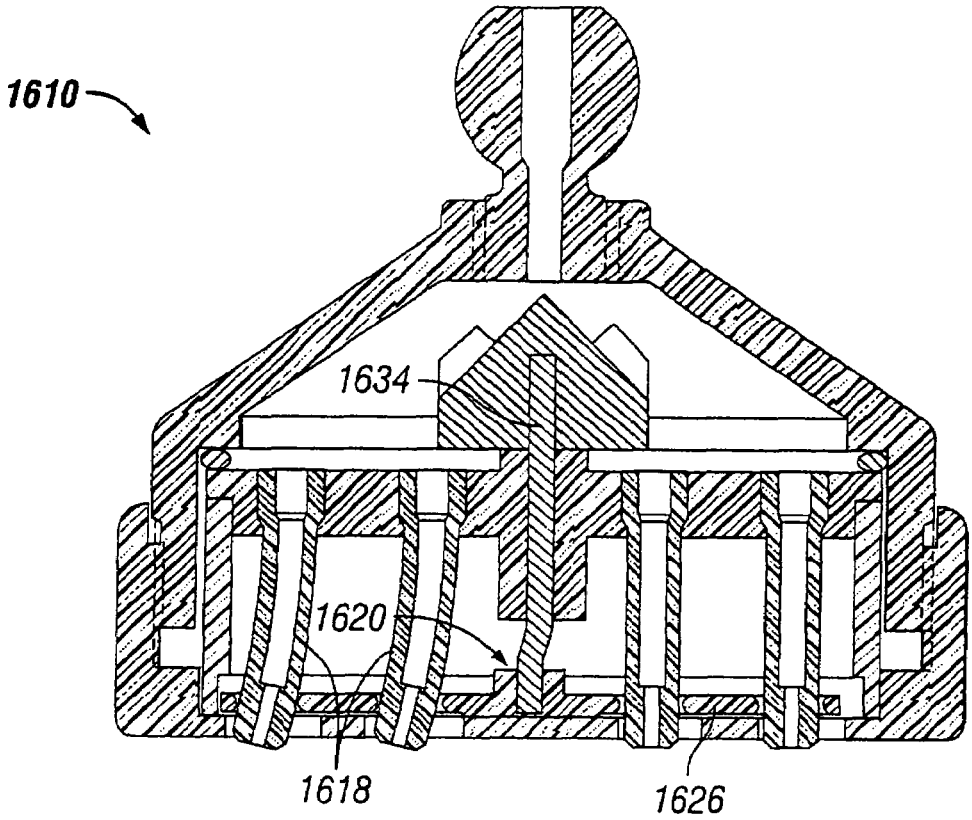
Figure 18:
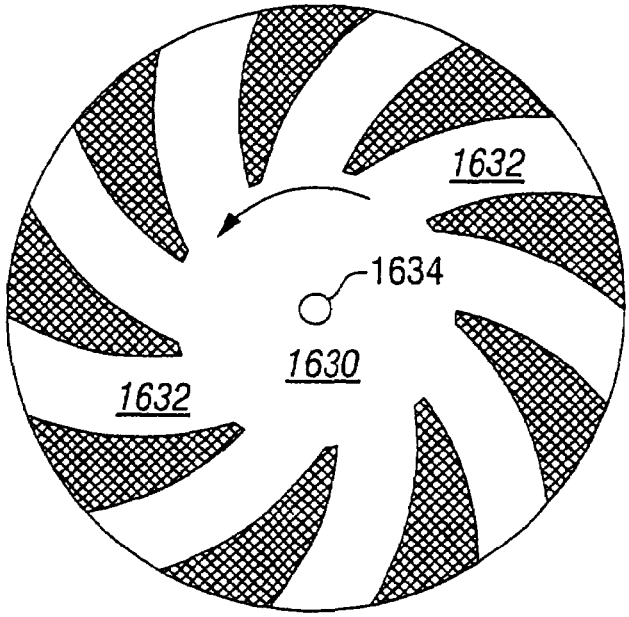
FIG. 18 shows a top view of the turbine employed by the spray apparatus of FIG. 16.

FIG. 16 shows a sectional side view of another embodiment of a spray apparatus 1610 that is similar to that of FIG. 12, but employing a semi-open turbine 1624 instead of an enclosed turbine design like the design of turbine 1224. FIGS. 17A-B are sequential views of the spray apparatus 1610 of FIG. 16, showing the movement of the fluid-dispensing tubes 1618 under rotation of the turbine crankshaft 1634 and oscillation of the integrating member 1620. In this manner, a "sweeping" shower effect is achieved. FIG. 18 shows a top view of the turbine employed by the spray apparatus of FIG. 16. The multiple angled or curved vanes 1632 of the turbine head 1630 are clearly visible.

Figure 19:
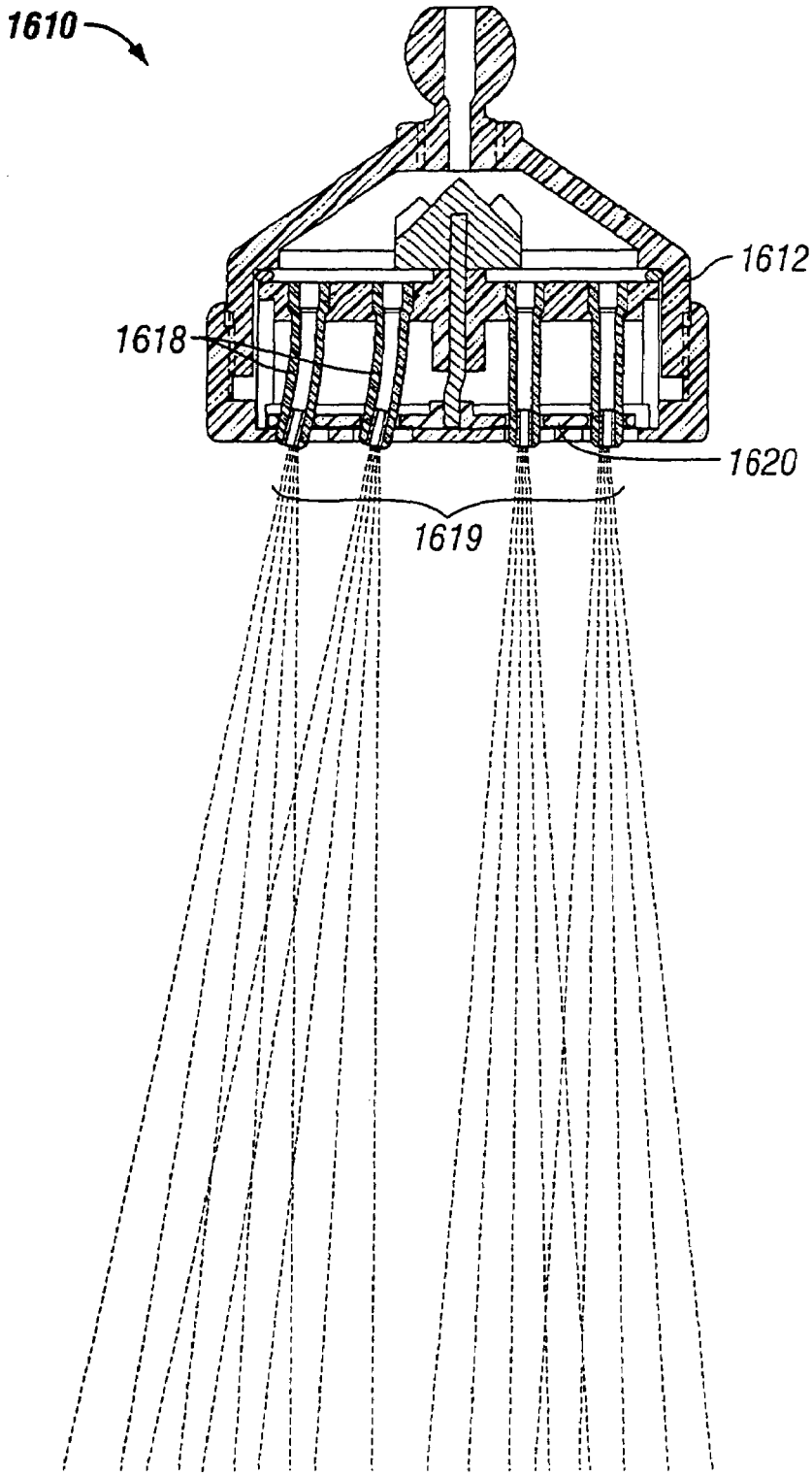
FIG. 19 shows an example of a typical conical spray pattern achievable with the fluid-dispensing tubes of the spray apparatus of FIG. 16.

FIG. 19 shows an example of a typical conical spray pattern achievable with the fluid-dispensing tubes 1618 of the spray apparatus of FIG. 16. As the integrating member 1620 oscillates within the housing 1612, each of the conical spray patterns emerging from the downstream end portions of the coupled tubes 1619 will also move in an oscillating pattern (i.e., sweep).

Figure 20:
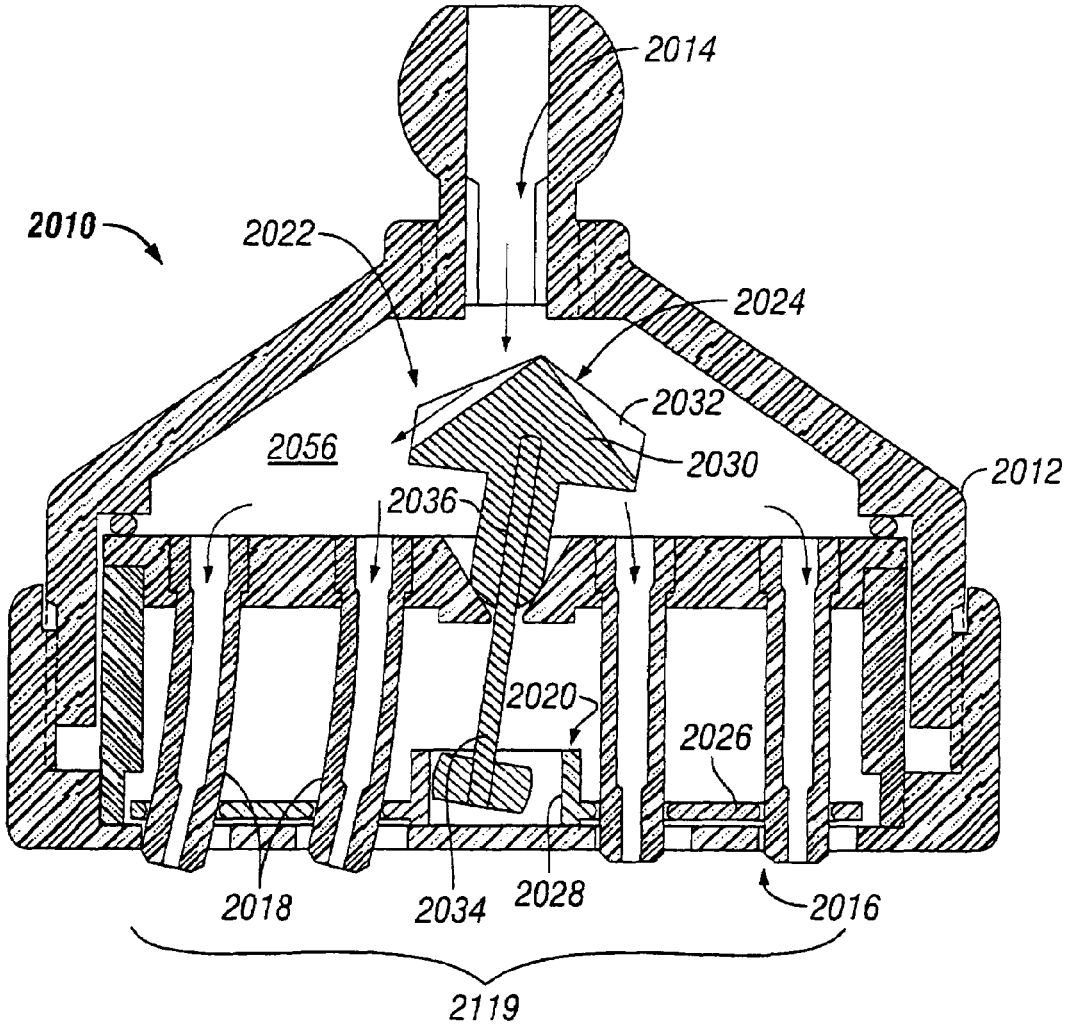
FIG. 20 shows a sectional side view of another embodiment of a spray apparatus employing a wobble turbine for oscillation of an integrating member positioned beneath the apparatus's flow chamber in accordance with the present invention.

FIG. 20 shows a sectional side view of another embodiment of a spray apparatus 2010 employing a wobble turbine 2024 for oscillation of an integrating member 2020 positioned beneath the apparatus's flow chamber 2056 in accordance with the present invention. In this embodiment, the turbine shaft 2034 is disposed for nutation within the flanged orifice 2028 of the integrating member's first planar member 2026.

Figure 21:
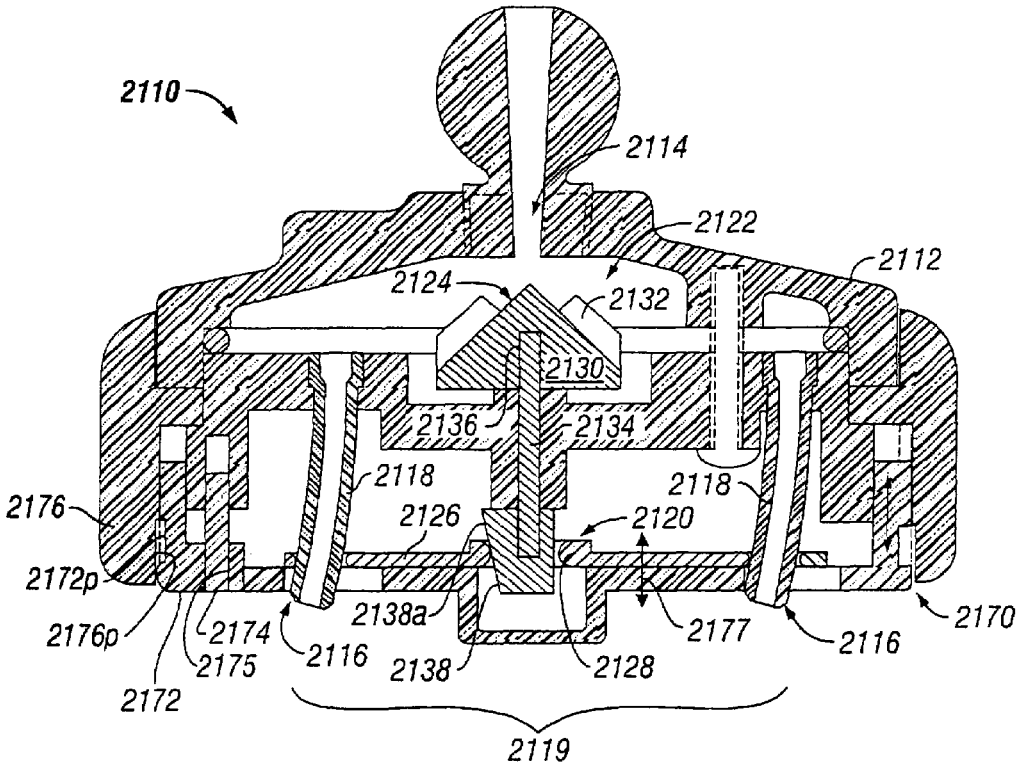
FIG. 21 shows a sectional side view of another embodiment of a spray apparatus that is similar to FIG. 16, except a camshaft is employed instead of a crankshaft and being further equipped with a system for varying the degree of oscillation by the integrating member and the resulting sprays from the fluid-dispensing tubes.

FIG. 21 shows a sectional side view of another embodiment of a spray apparatus 2110 that is similar to FIG. 16, except a camshaft 2134 is employed instead of a crankshaft. This embodiment is further equipped with a system 2170 for varying the degree of oscillation by the integrating member 2120 and the resulting sprays from the coupled fluid-dispensing tubes 2119. A cam member 2138 has a sloping vertical profile 2138*a*. The system 2170 presents a means for adjusting the elevation of the integrating member 2120 relative to the cam member 2138 so as to induce engagement of the integrating member 2120 with varying elevations of the sloping vertical profile 2138*a* of the cam member 2138. This permits the range of oscillation of the integrating member resulting from rotation of the turbine to be adjusted. More particularly, the system 2170 includes a base plate 2172 that is threaded on its periphery 2172*p*, and is prevented from rotating by one or more alignment pins 2174 disposed in one or more complementing orifices 2175 through the base plate 2172. Threads 2176*p* on the inner periphery of an adjusting sleeve 2176 engage base plate threads 2172*p*, so that rotation of the adjusting sleeve 2176 moves the base plate 2172 up or down as indicated by two-way directional line 2177. As the base plate 2172 moves up, it positions the integrating member 2120 higher on the cam profile 2138*a*, oscillating the resulting spray pattern over a wider area. Conversely, downward movement of the base plate 2172 results in a narrower oscillating range of the spray pattern. When the base plate 2172 reaches its bottom position, the rotating cam 2138 makes no contact with the integrating member 2120, and the coupled fluid-dispensing tubes 2119 have no movement. It will be further appreciated by those having skill in the art that this embodiment does not produce a change in the overall spray pattern, but is useful for varying the radius of oscillation by the integrating member 2120 so as to vary the overall shower width (i.e., oscillation area of the spray pattern).

Figure 22A:
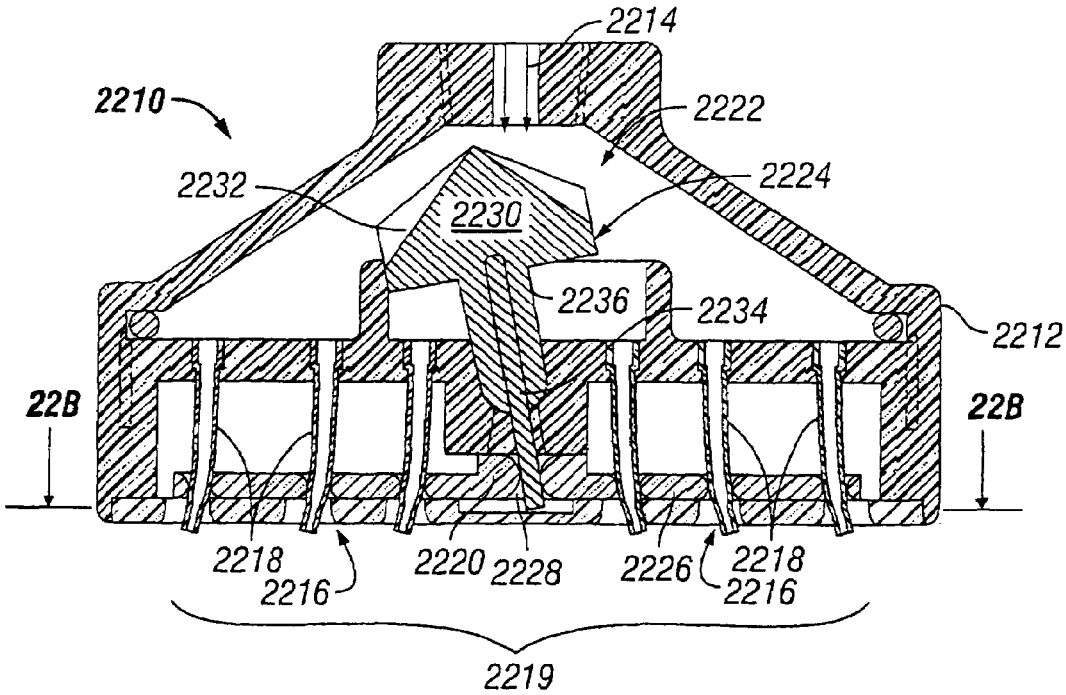
FIGS. 22A-B show sectional side and top views of another embodiment of a spray apparatus that is similar to that of FIG. 20, but employing a different wobble turbine.
Figure 22B:
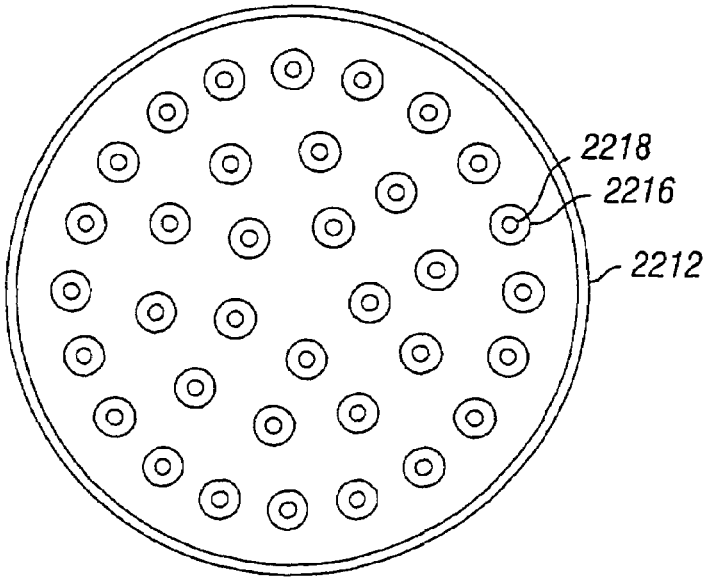

FIGS. 22A-B show sectional side and top views of another embodiment of a spray apparatus 2210 that is similar to that shown in FIG. 20, but employing a different wobble turbine 2224. The turbine shaft 2234 is disposed for nutation within the orifice 2228 of the integrating member 2220, so as to oscillate the integrating member 2220 and induce movement of the coupled fluid-dispensing tubes 2219.

Figure 23A:
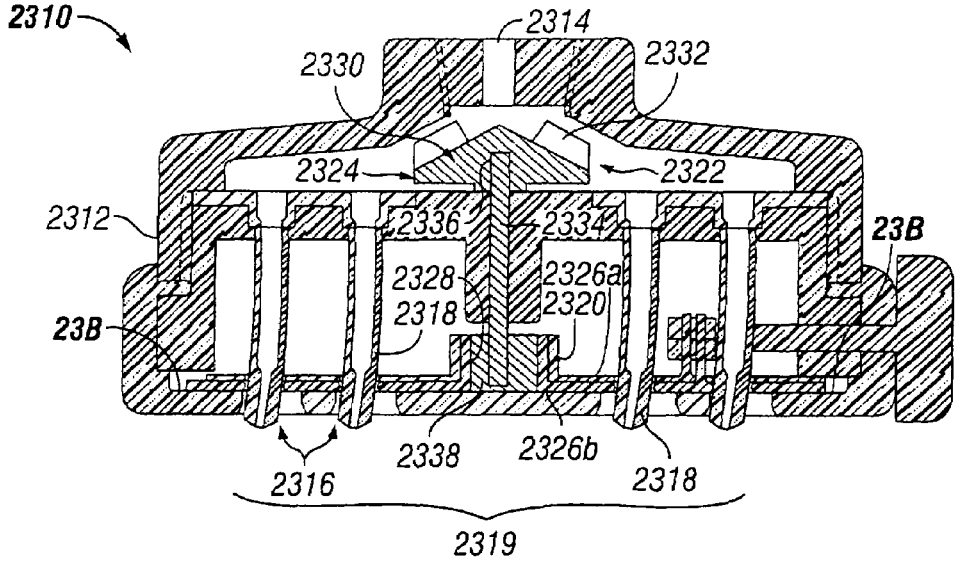
FIGS. 23A-B show sectional side and top views of another embodiment of a spray apparatus that employs an integrating member having two slotted plates for pointing the fluid-dispensing tubes to one of a plurality of nominal radial positions.
Figure 23B:
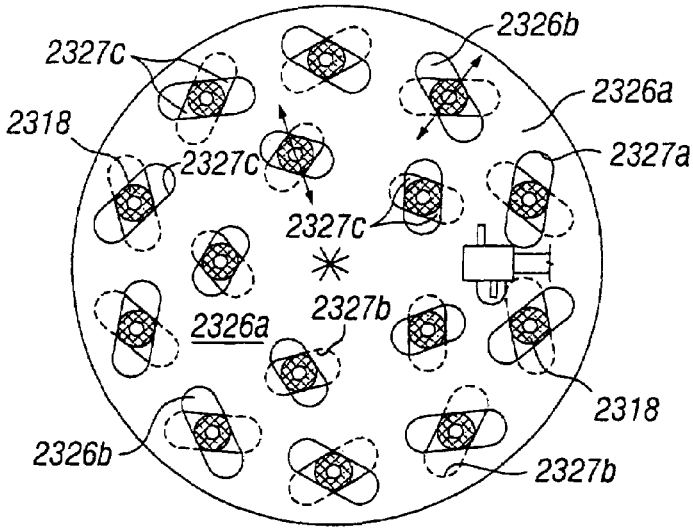

FIGS. 23A-B show sectional side and top views of another embodiment of a spray apparatus 2310 that employs an integrating member 2320 having two stacked complementary upper and lower plates 2326*a*, 2326*b* each having a plurality of slots therein for pointing the coupled fluid-dispensing tubes 2319 to one of a plurality of nominal radial positions. The slots 2327*a* of the upper plate 2326*a* overlie and are conversely oriented to respective slots 2327*b* of the lower plate 2326*b*, so as to effect a plurality of common constricted slot areas 2327*c* through the upper and lower plates for engaging the respective coupled fluid-dispensing tubes 2318 by the extension of portions of the respective coupled tubes through the common slot areas 2327*c*. Preferably, at least one of the complementary plates is rotatable with respect to the other of the complementary plates for moving the coupled tubes inwardly or outwardly with respect to the central axis.

Although the plates 2326*a*, 2326*b* of the integrating member 2320 are shown being positioned at or near the bottom of the housing 2312, an alternative embodiment of the inventive spray apparatus (not shown) positions such a control member at an elevated location within the housing, much like the location for the planar member 2482 in FIGS. 24-26 (described below). Such embodiments will employ another member to serve as the integrating member (like the integrating member 2420 of FIGS. 24-26), while the member 2320 serves to point or focus the fluid dispensing tubes 2318 without oscillating (much like the additional planar member 2482 of FIGS. 24-26).

Figure 23C:
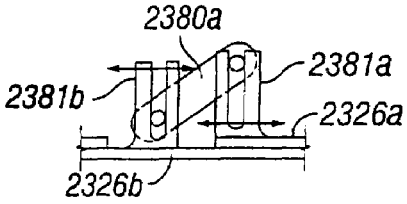
FIGS. 23C-D show alternative embodiments of cam configurations, for achieving the pointing function with the two plates of the integrating member of FIG. 23A.
Figure 23D:
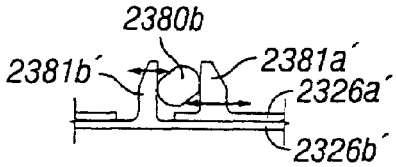

FIGS. 23C-D show alternative embodiments of cam configurations for inducing rotation of the plates 2326*a*, 2326*b* in relation to each other for achieving the desired pointing function. The respective cam configurations include cams 2380*a*, 2380*b* for engaging and adjusting the separation distance between respective boss members 2381*a-b* (FIG. 23C) and 2381*a'-b'* (FIG. 23D). As the plates 2326*a*, 2326*b* rotate in relation to each other, the tubes 2318 are moved (i.e., pointed) either toward or away from the center of the housing 2312. When pointed inwardly, the steams emerging from the fluid-dispensing tubes 2318 are focused to a relatively narrow diameter, thereby achieving a massage effect. When the tubes 2318 are pointed outwardly, the resulting streams are moved outwardly to a diameter preferred by the bather.

Particular embodiments of the inventive spray apparatus include an additional planar member supported for limited rotation about the central axis within the housing. Thus, with reference first to FIGS. 24-26, the additional planar member 2482 includes a plurality of noncentral angularly-oriented, inner and outer slots 2483, 2484 for engaging portions 2418*c* of the respective coupled fluid-dispensing tubes 2419 intermediate the downstream and upstream portions of the tubes 2419 by the extension of the coupled tube portions 2418*c* through the plurality of noncentral slots 2483, 2484 of the additional planar member 2482—which may also be considered an additional integrating member in view of (first) integrating member 2420. The additional planar member 2482 is rotatable with respect to the housing 2412 for moving the coupled tube portions 2418*c* inwardly or outwardly with respect to the central axis of the housing 2412. Upper retaining sleeves 2450*a* depend from the second planar member 2450 for constraining the motion of the tubes 2418 to radially inward or radially outward motion (as opposed to tangential motion) under engagement with the additional planar member 2482. This rotation is preferably achieved using an actuator 2485 carried on the housing. The actuator 2485 includes a handle 2486 connected to a shaft 2487 extending through a slot 2412*a* in the body 2412 and carrying a key 2488. The key 2488 is disposed in a further slot 2482*s* in the planar member 2482, such that sliding movement of handle 2486 sideways along the periphery of the body 2412 (i.e., in or out of the page in FIG. 25) induces rotation of the planar member 2482 about a central axis within the housing 2412.

Figure 24A:
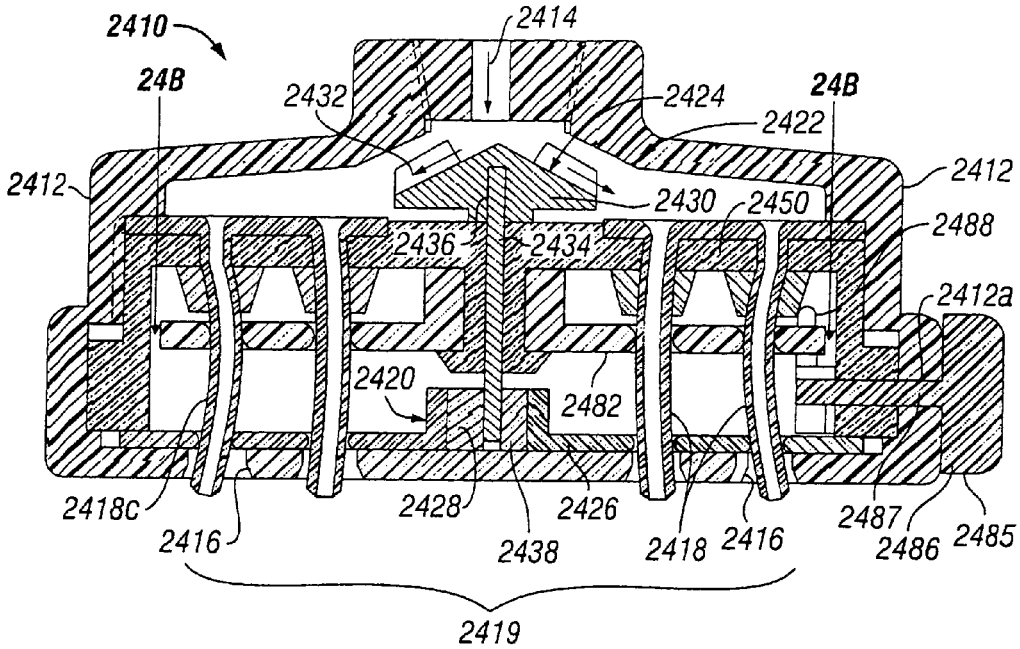
FIGS. 24A-B show sectional side and top views of another embodiment of a spray apparatus that employs an integrating member having a slotted plate for pointing the fluid-dispensing tubes to one of a plurality of nominal radial positions in accordance with the present invention.
Figure 24B:
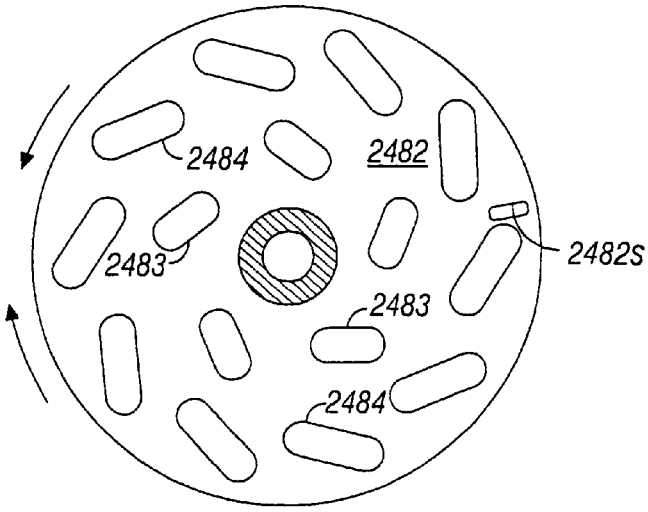
Figure 25:
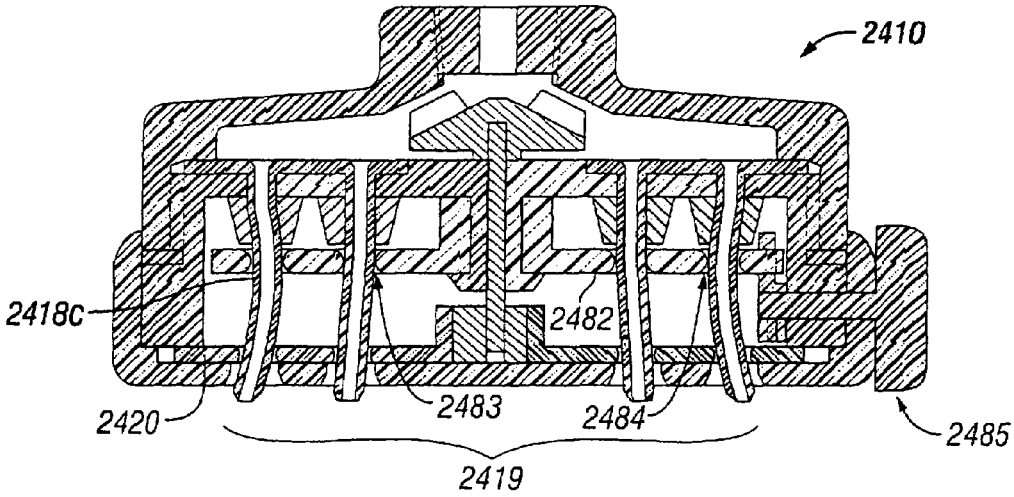
FIGS. 25-26 show the spray apparatus of FIG. 24 wherein the fluid-dispensing tubes are pointed to achieve wide (FIG. 25) and narrow (FIG. 26) nominal spray widths.
Figure 26:
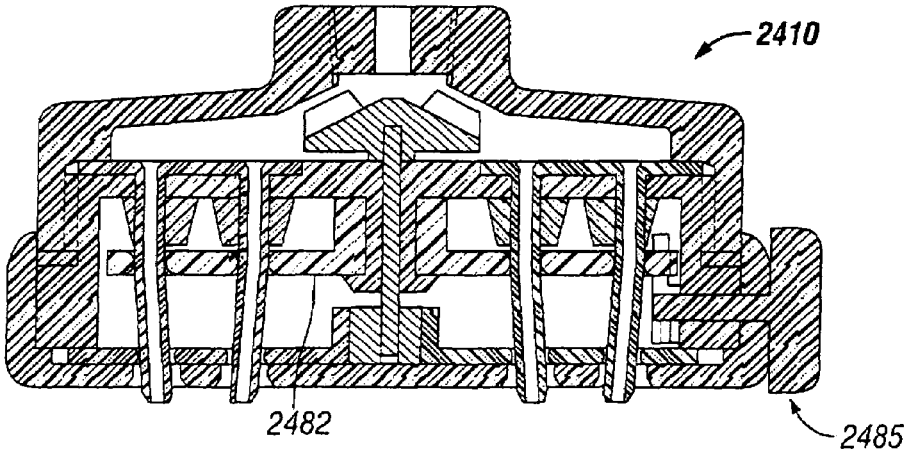
Figure 27:
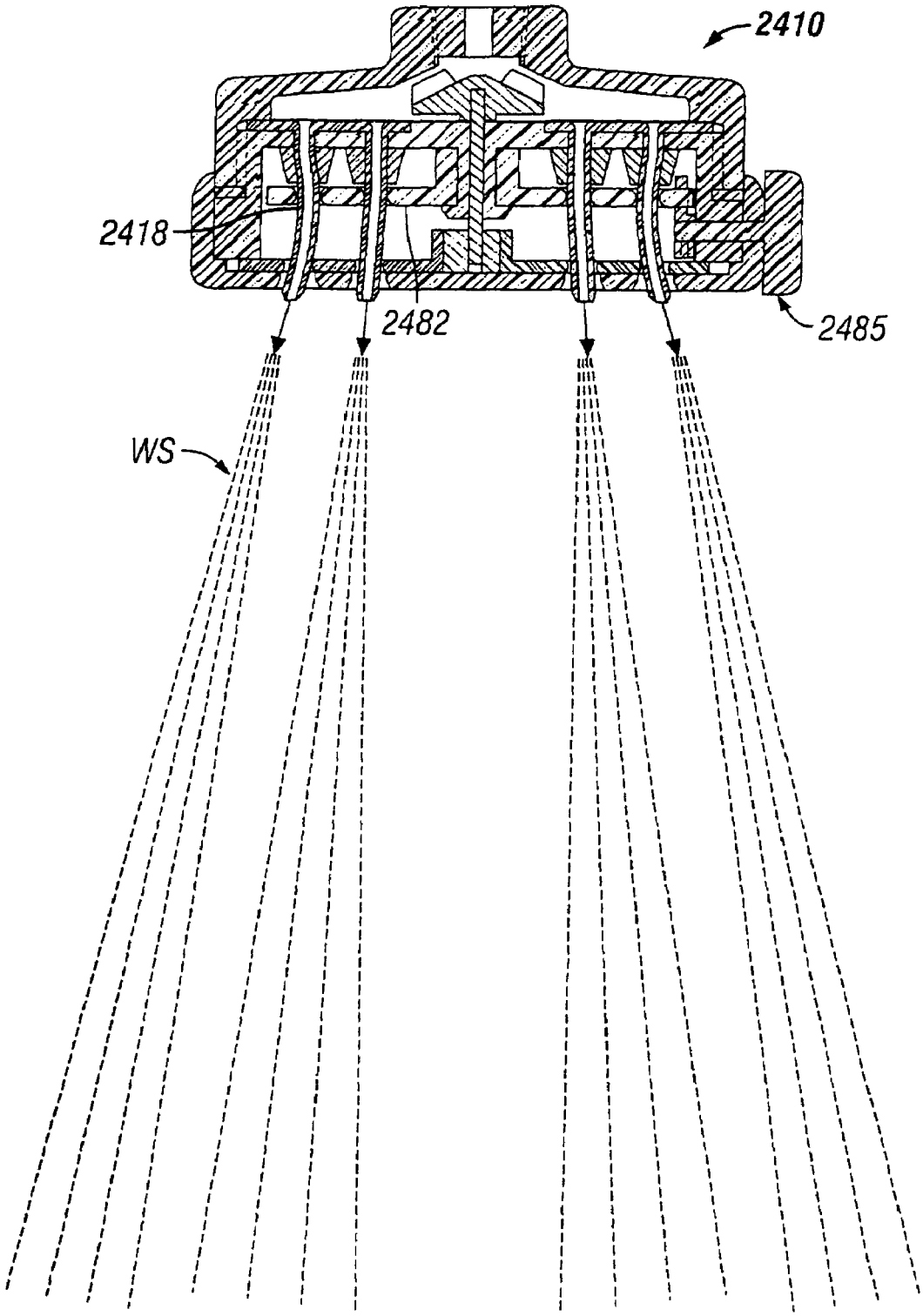
FIGS. 27-28 show the respective wide and narrow nominal spray widths achievable with the spray apparatus of FIG. 24.
Figure 28:
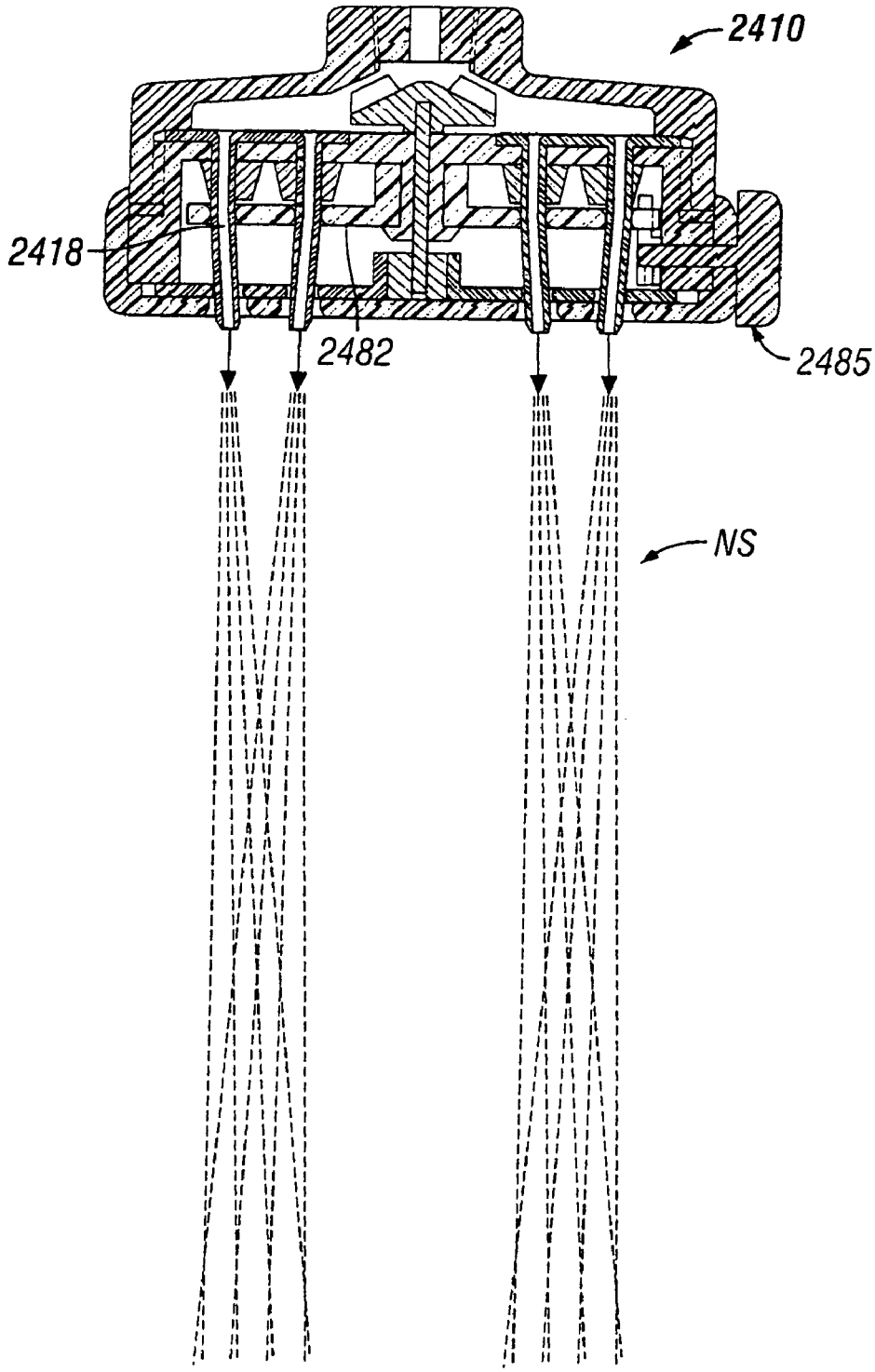

FIGS. 25-26 show the spray apparatus of FIG. 24 wherein the fluid-dispensing tubes are pointed, or focused, by selective rotation of the additional planar member 2482 with the actuator 2485 to achieve wide (FIG. 25) and narrow (FIG. 26) nominal spray widths from the tubes 2418. FIGS. 27-28 show the respective wide and narrow nominal spray widths WS, NS achievable with the spray apparatus of FIG. 24.

Figure 29A:
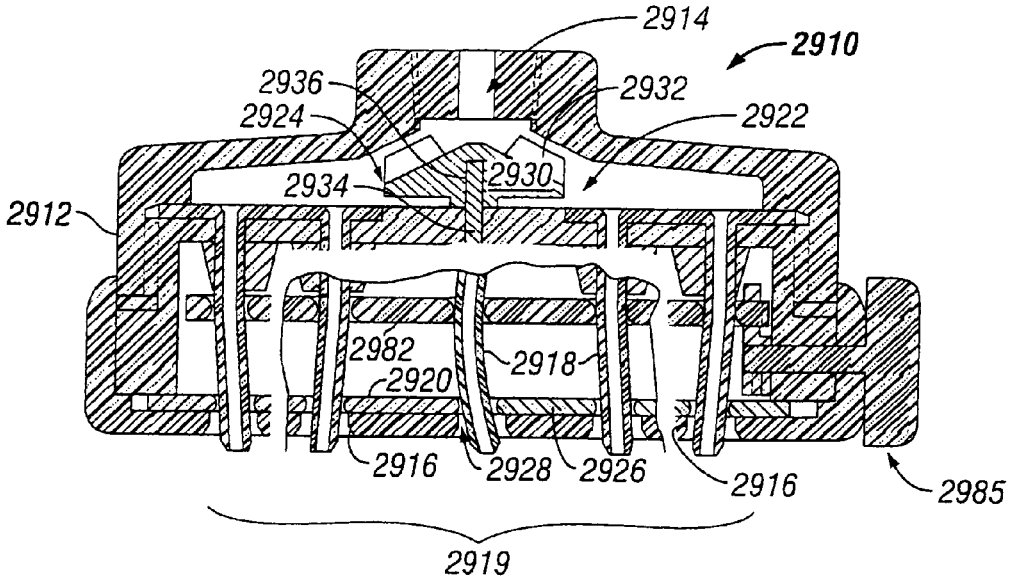
FIGS. 29A-B show sectional side views, in respective wide and narrow spray positions, of another embodiment of a spray apparatus that is similar to FIG. 24, except the fluid-dispensing tubes are not equipped with upper retaining sleeves as in FIG. 24, in accordance with the present invention.
Figure 29B:
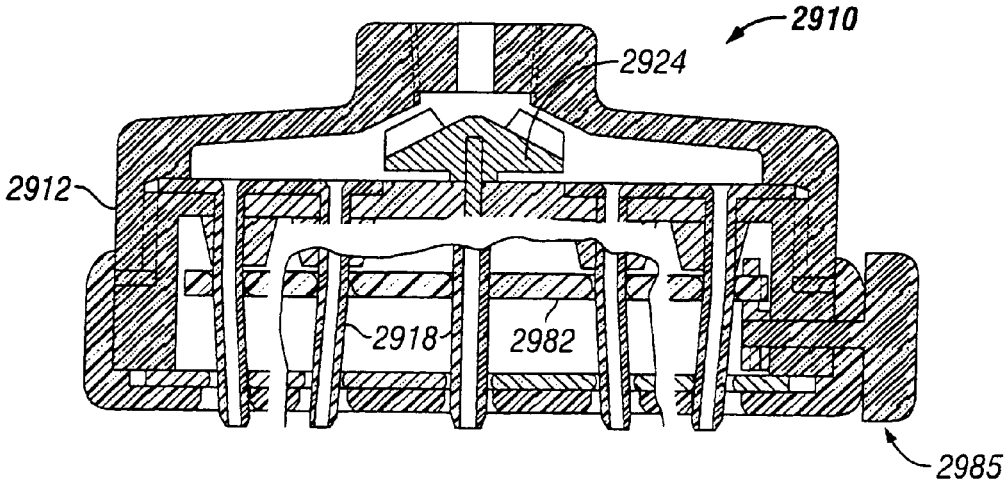
Figure 30:
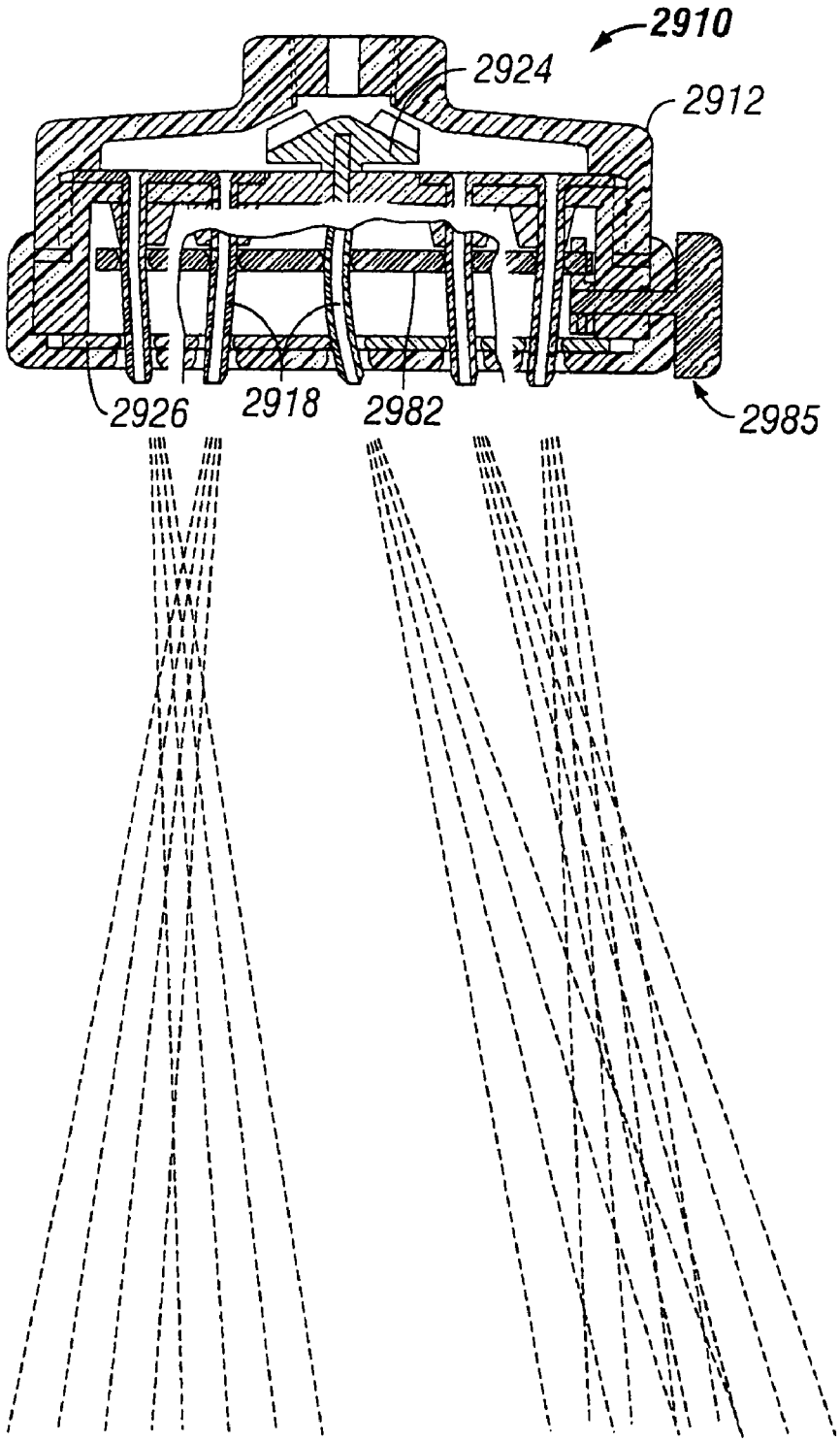
FIG. 30 is similar to FIG. 29A, but showing the spray patterns emerging from various fluid-dispensing tubes.

FIGS. 29A-B show sectional side views, in respective wide and narrow spray positions, of another embodiment of a spray apparatus 2910 that is similar to the embodiment of FIG. 24, except the fluid-dispensing tubes are not equipped with upper retaining sleeves 2450*a* as in FIG. 24. The embodiment of FIGS. 29A-B is therefore adapted for applying a particular tangential force component to the fluid-dispensing tubes 2918 via the additional planar member 2982 and actuator 2985 for width adjustment of the resulting spray. In the nominal position, when the tubes 2918 have no tangential force component applied, the resulting spray exhibits its minimum width, focusing to the preferred cross section (similar to that shown in FIG. 28). Rotation of the focusing disk puts a tangential component on the nozzles, whereby the spray may be set to its maximum width as shown in the expanded view of FIG. 30.

In a further alternative embodiment (not shown) to the embodiment described above, the additional planar member 2982 is eliminated and the integrating member 2920 is relocated to a more centrally elevated position within the housing 2912 (i.e., to the position of the eliminated planar member 2982). In this embodiment, the outlets 2916 would be sized and shaped to fit snugly about the tubes 2918 so as to ensure that the downstream ends of the tubes are pointed in the desired direction under engagement by the elevated integrating member 2920.

Figure 31A:
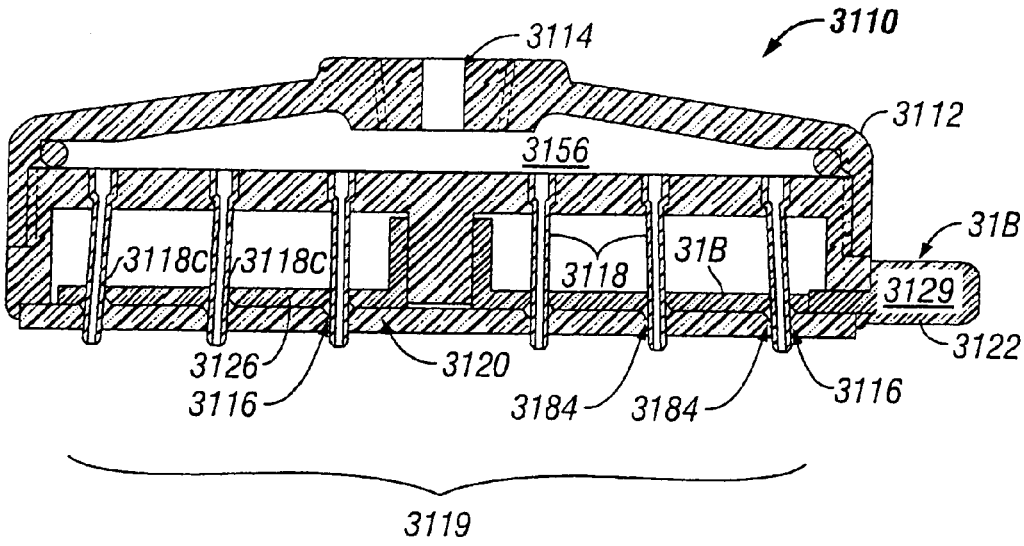
FIGS. 31A-B show sectional side and (partial) top views another embodiment of a spray apparatus employing an integrating member positioned beneath the apparatus's flow chamber, but having no turbine, in accordance with another aspect the present invention.
Figure 31B:
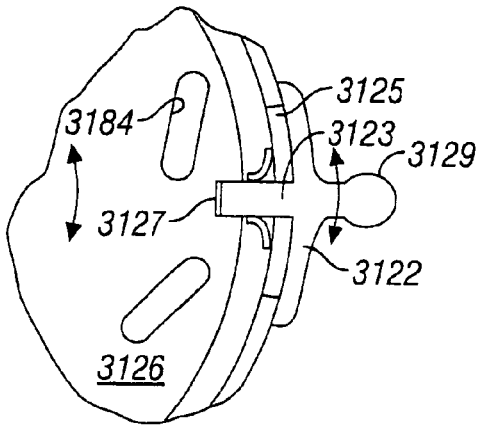

FIGS. 31A-B show sectional side and (partial) top views another embodiment of a spray apparatus 3110 employing an integrating member 3120 positioned beneath the apparatus's flow chamber 3156, but having no turbine, in accordance with another aspect the present invention. The spray apparatus 3110 including a housing 3112 having a fluid inlet 3114 and a plurality of fluid outlets 3116. A plurality of tubes 3118 are each disposed in one of the fluid outlets 3116 for dispensing fluid from the housing 3112. The integrating member 3120 is operatively coupled to at least a subset 3119 of the plurality of tubes 3118 at locations 3118*c* between the fluid inlet 3114 and fluid outlets 3116 for effecting coordinated movement of the coupled tubes 3119 in the respective plurality of fluid outlets 3116 in response to movement of the integrating member 3120. An actuator 3122 is also provided for inducing movement of the integrating member.

The first planar member 3126 of the integrating member 3120 includes a plurality of angularly-oriented slots 3184 for engaging portions 3118*c* of the respective coupled tubes 3119 by the extension of the coupled tube portions 3118*c* through the plurality of angularly-oriented slots 3184. The integrating member 3120 is rotatable by the actuator 3122 with respect to the housing 3112 for moving the coupled tube portions 3118*c*. The actuator 3122 preferably includes a slidable lever 3129, best shown in FIG. 31B, extending through a slot 3125 formed in a side wall of the housing 3112. The lever 3129 is disposed outside the housing 3112, and has an inner portion 3123 that engages the first planar member 3126 of the integrating member 3120 at a peripheral slot 3127.

Figure 32:
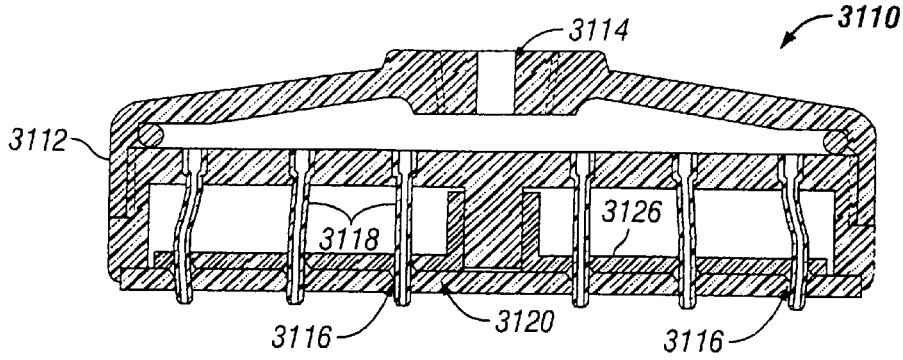
FIG. 32 shows the spray apparatus of FIG. 31A set in a narrow spray position, as contrasted with the normal spray position of FIG. 31A.

FIG. 32 shows the spray apparatus of FIG. 31A set in a narrow spray position using the actuator 3122 (not shown in FIG. 32), as contrasted with the nominal (wide) spray position of FIG. 31A. Other than movement provided by the actuator 3122, the fluid-dispensing tubes 3118 of this embodiment are stationary since there is no other continuous actuation like that provided by the turbine of the other embodiments described herein.

Figure 33A:
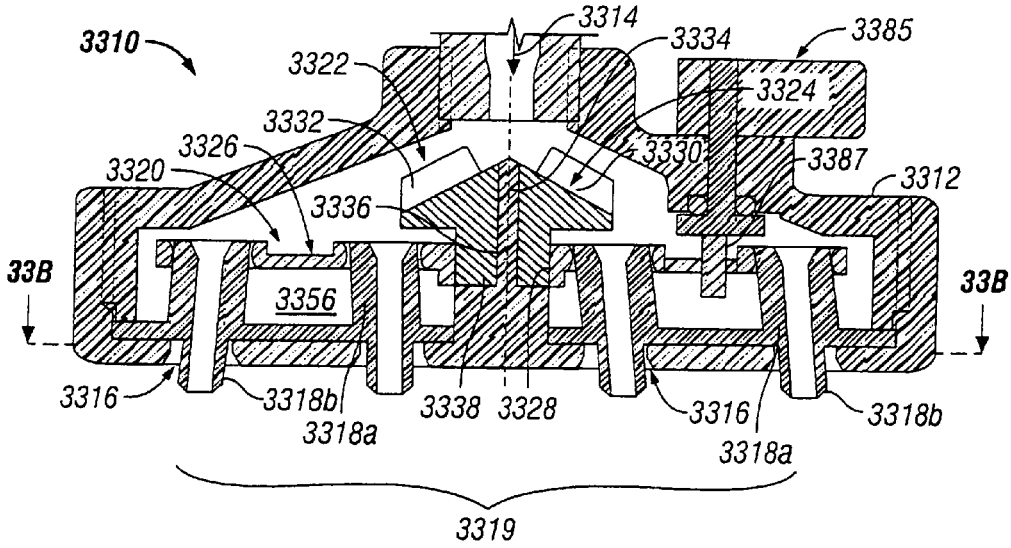
FIGS. 33A-B show sectional side and top views of an alternative embodiment of a spray apparatus employing an integrating member disposed inside the flow chamber in accordance with the present invention.
Figure 33B:
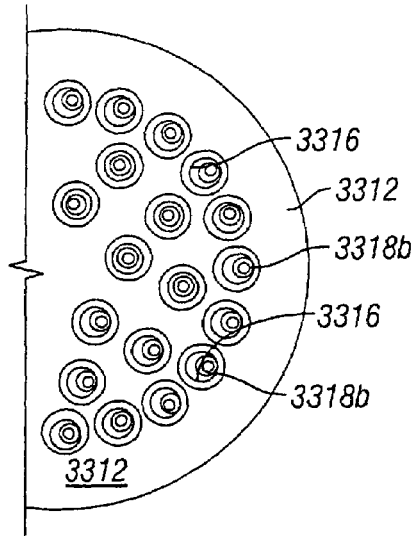

FIGS. 33A-B show sectional side and top views of an alternative embodiment of a spray apparatus 3310 employing an integrating member 3320 disposed inside the flow chamber 3356 of the housing 3312. The fluid-dispensing tubes 3318 are integrally formed, preferably by a single elastomer molding, so as to have upper wider portions 3318*a* and lower narrower portions 3318*b*. The thicker section of elastomer at tube portions 3318*a* provides sufficient stiffness to reliably move the thinner section of rubber at the tube portions 3318*b* and maintain a substantially straight centerline for each tube 3318. A supplemental actuator 3385 employs a rotatable lever 3387 to selectively stop or freeze the movement of the coupled tubes 3319. More particularly, the actuator 3385 restricts oscillatory movement of the integrating member 3320 so as to restrict movement of the coupled tubes 3319 when the bather desires non-moving (i.e., non-sweeping) shower streams.

Figure 34:
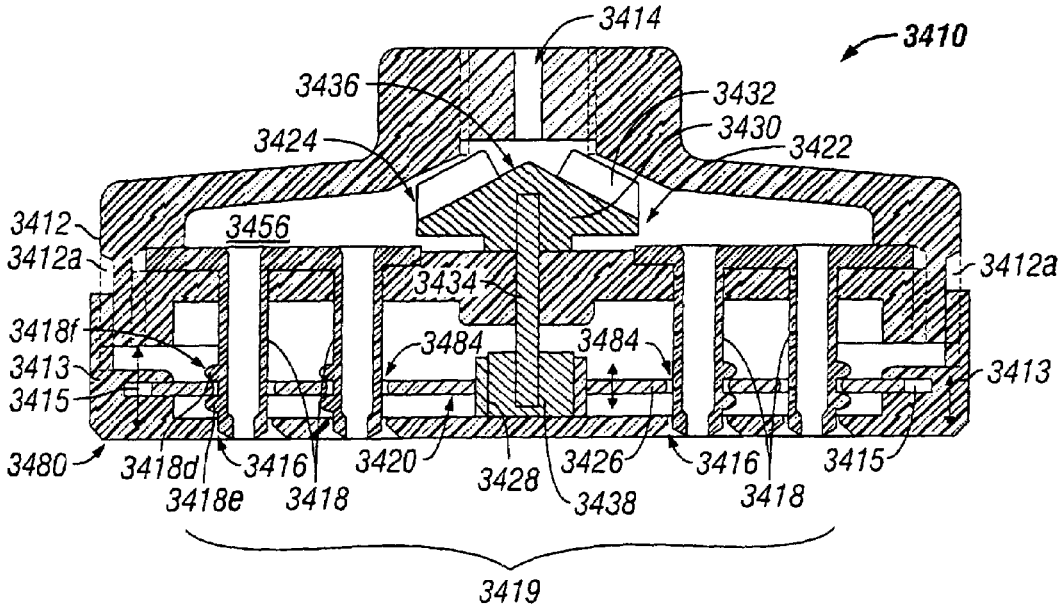
FIG. 34 shows a sectional side view of an alternative embodiment of a spray apparatus employing an integrating member disposed beneath the flow chamber and an alternative system for pointing the fluid-dispensing tubes in accordance with the present invention.

FIG. 34 shows a sectional side view of an alternative embodiment of a spray apparatus 3410 employing an integrating member 3420 disposed beneath the flow chamber 3456. The turbine 3424 includes an eccentric member or cam portion 3438 affixed about the turbine shaft 3434 opposite the turbine head 3430 such that the cam portion 3438 rotates with the turbine head 3430. The cam portion 3438 is carried within the orifice 3428 of the first planar member 3426 of the integrating member 3420, and is nutated by rotation of the turbine head 3430 to induce orbiting of the integrating member 3420.

Figure 34A:
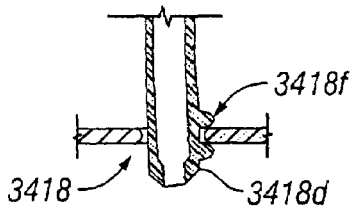
FIGS. 34A-B show detailed sectional side views of a fluid-dispensing tube being positioned for respective widened and narrowed spray patterns.
Figure 34B:
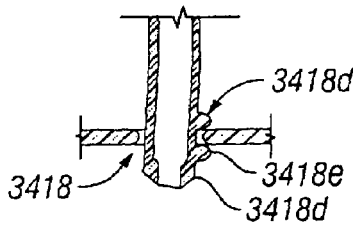

A means 3480 is further provided in this embodiment of the present invention for selectively pointing downstream end portions 3418*d* of the plurality of coupled tubes 3419. Accordingly, each of the coupled tubes 3419 preferably includes an elastomeric material such as a suitable rubber material. The pointing means 3480 preferably includes a set of spaced-apart protuberances 3418*d-e* on an outer surface of each of the coupled tubes 3419 defining a side recess 3418*f* between the protuberances. Each of the coupled tubes 3419 is disposed in one of a plurality of noncentral orifices 3484 formed in the first planar member 3426, in such a manner that the first planar member 3426 is connected to the plurality of coupled tubes 3419 via the side recesses 3418*d-e*. An internally-threaded sleeve 3413 is carried for rotation about an externally-threaded sidewall portion 3412*a* of the housing 3412. The sleeve 3413 has an annular groove 3415 formed in an inner surface thereof within which the first planar member 3426 is circumferentially carried. Thus, rotation of the sleeve 3413 induces vertical movement of the first planar member 3426 that applies a vertical force to the coupled tubes 3419 at the respective side recesses 3418*f*. FIGS. 34A-B show detailed sectional side views of a fluid-dispensing tube 3418 being positioned for respective widened and narrowed spray patterns.

Figure 35:
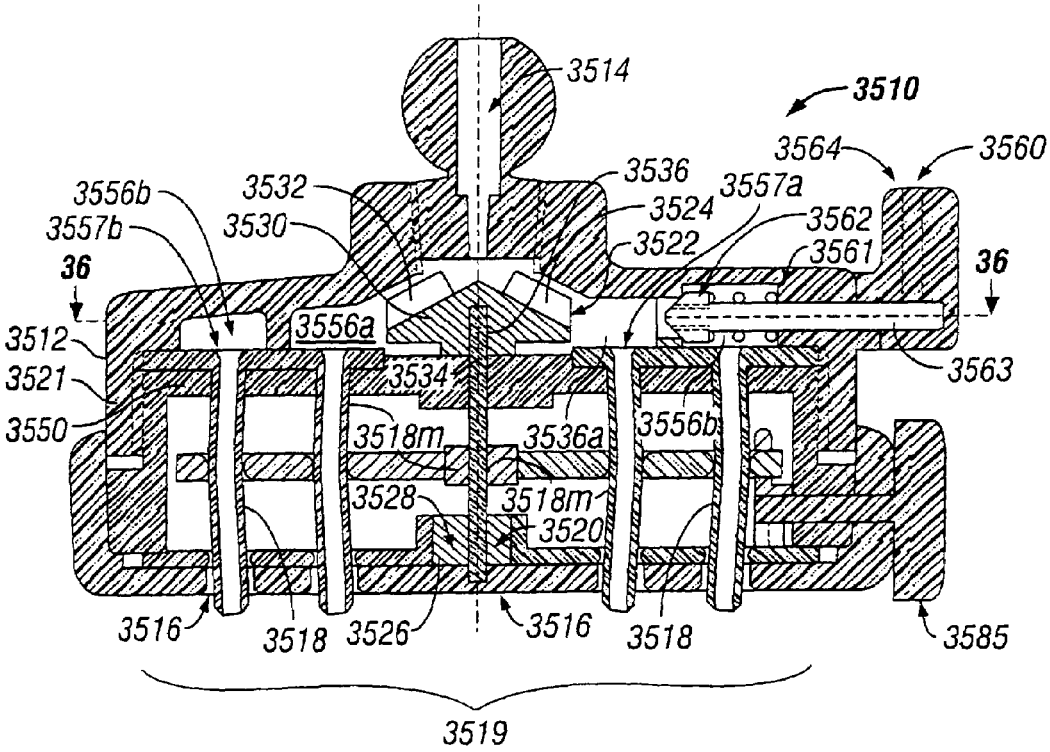
FIG. 35 shows an alternative embodiment of a spray apparatus that is similar to that of FIG. 29, but being further equipped with a diverter system for achieving a massage effect.
Figure 36:
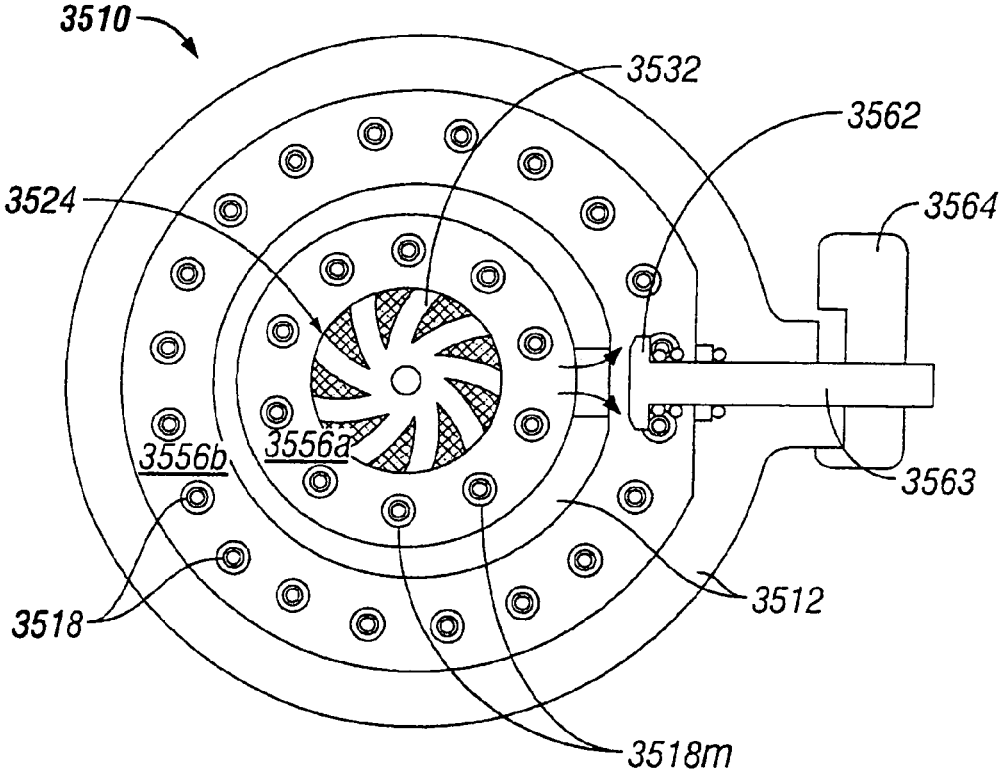
FIG. 36 is a sectional top view of the spray apparatus of FIG. 35.

FIGS. 35-36 show an alternative embodiment of a spray apparatus 3510 that is similar to that of FIG. 29, but being further equipped with a diverter system 3560 for achieving a massage effect. The housing 3512 defines inner and outer flow chambers or passages 3556*a-b* for communicating with inner and outer sub-pluralities of the noncentral orifices 3557*a-b* of the second planar member 3550. The diverter system 3560 includes a valve assembly 3561 for directing fluid through the flow passages 3556*a-b* to either: the outer sub-plurality of the noncentral orifices 3557*b* of the second planar member 3550; the inner sub-plurality of the noncentral orifices 3557*a* of the second planar member 3550; or a combination thereof. The valve assembly preferably includes a stop valve 3562 having a movable stem 3563 for closing flow passage 3556*b* off from flow passage 3556*a*. An actuator lever 3564 is useful for moving the valve stem 3563 and stop valve 3562 as desired to direct the fluid flow. This embodiment uses the center tubes 3518*m* fed by inner orifices 3557*a* for achieving a massage effect. When the valve 3561 is closed, no water reaches the outer tubes fed by the outer orifices 3557*b*. As a result, pressure builds up on the inner tubes. Accordingly, when the tubes 3518 are focused to achieve a narrow spray using actuator 3585 (as in FIG. 28) while the valve 3561 is closed, the inner tubes will experience relatively high water pressure to create a focused massage effect.

Figure 37:
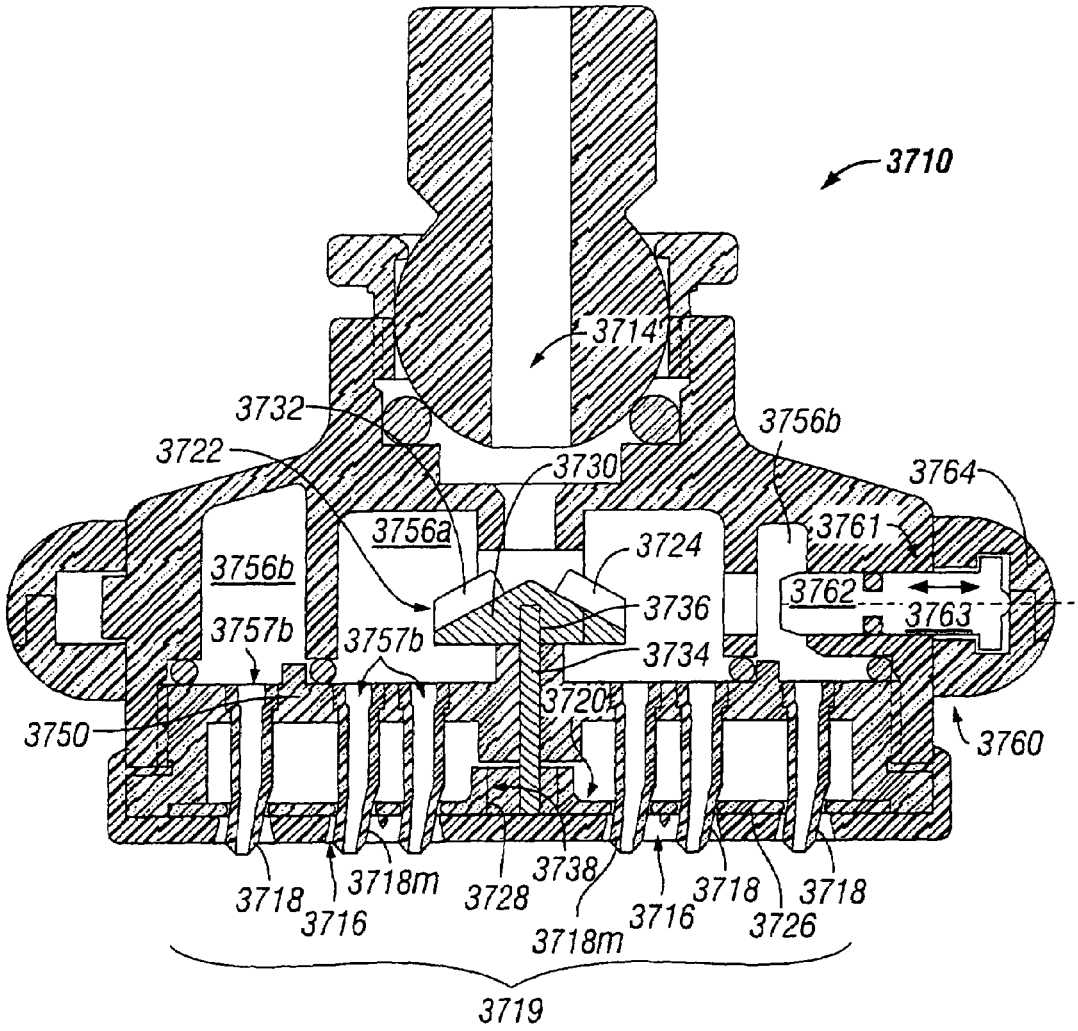
FIG. 37 shows a sectional side view of another embodiment of a spray apparatus that is similar to that of FIG. 15, but employing an alternative flow diverter system for achieving a massage effect-in accordance with the present invention.

FIG. 37 shows a sectional side view of another embodiment of a spray apparatus 3710 that is similar to that of FIG. 15, but employing an alternative flow diverter system 3760 for achieving a massage effect in accordance with the present invention. The flow diverter system 3760 is analogous to that shown in FIG. 35, and includes a valve assembly 3761 for directing fluid through the flow chambers or passages 3756*a-b* to either: an outer sub-plurality of noncentral orifices 3757*b* of the second planar member 3750; an inner sub-plurality of noncentral orifices 3757*a* of the second planar member 3750; or a combination thereof. The valve assembly preferably includes a stop valve 3762 having a movable stem 3763 for closing flow passage 3756*b* off from flow passage 3756*a*. An actuator ring 3764 is useful for moving the valve stem 3763 and stop valve 3762 as desired to direct the fluid flow. The actuator ring 3764 has an inside track with a smoothly-varying radius (like that of FIG. 40C), which forces the valve stem 3763 inwardly or outwardly as the ring 3764 is rotated. This embodiment thus uses the center tubes 3718*m* fed by inner orifices 3757*a* for achieving a massage effect. When the valve 3761 is closed, no water reaches the outer tubes fed by the outer orifices 3757*b*. As a result, pressure builds up on the inner tubes 3718*m*.

Figure 38:
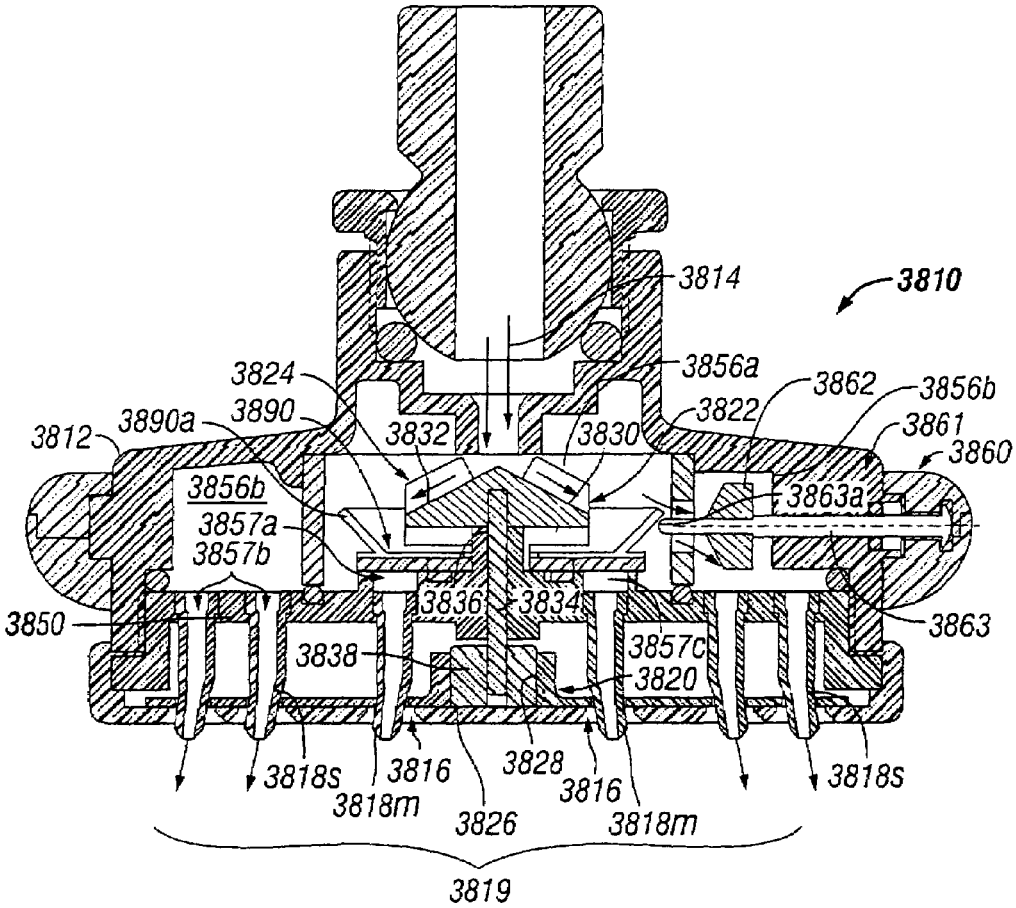
FIGS. 38-39 show sequential, sectional side views of another embodiment of a spray apparatus that is similar to that of FIG. 37, but employing an alternative flow diverter system for achieving a massage effect in accordance with the present invention.
Figure 39:
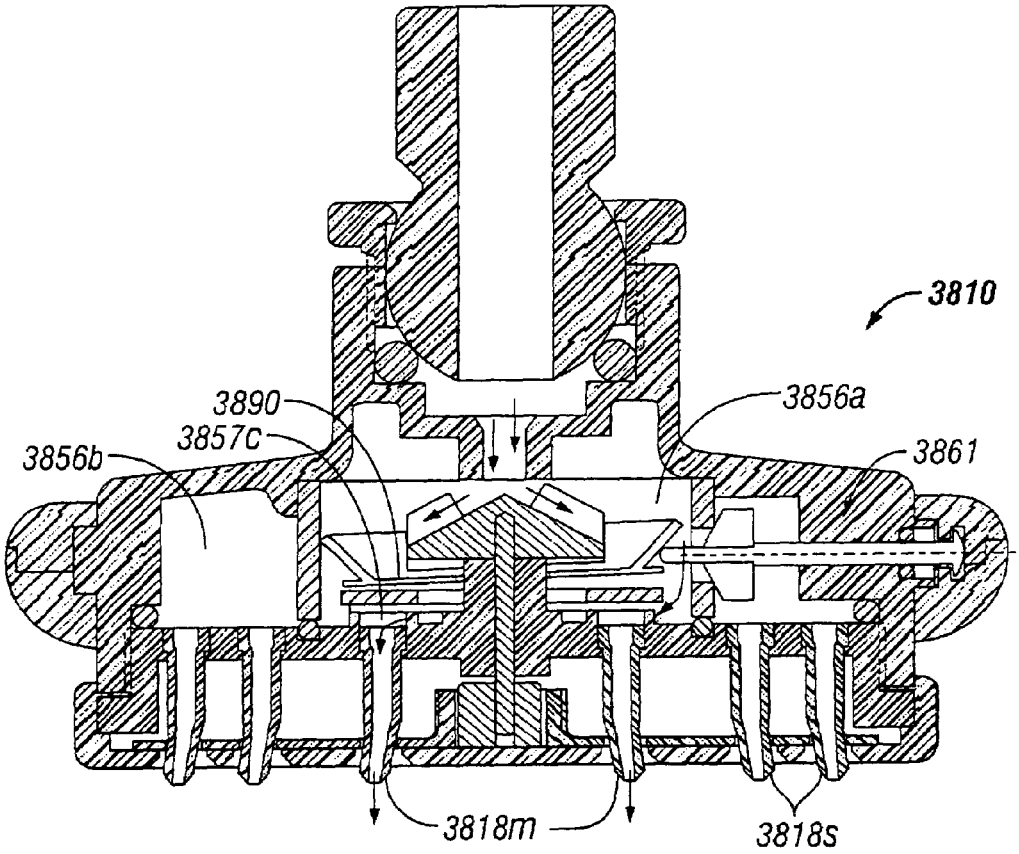

FIGS. 38-39 show sequential, sectional side views of another embodiment of a spray apparatus 3810 that is similar to that of FIG. 37, but employing an alternative flow diverter system 3860 for achieving a massage effect in accordance with the present invention. In this embodiment, the inventive spray apparatus further includes a third planar member 3890 for removably covering the inner sub-plurality of noncentral orifices 3857*a*—interconnected by a channel 3857*c*—of the second planar member 3850. The third planar member 3890 has a sloped rim 3890*a* about at least a portion thereof. A valve system 3861 includes a movable valve stem 3863 equipped with a plug 3862 and a distal end 3863*a*, such that movement of the valve stem 3863 in a radially-inward direction results in the plug 3862 closing off the fluid chamber or passage 3856*b* communicating fluid to the outer sub-plurality of noncentral orifices 3857*b* of the second planar member 3850. This movement of the valve stem 3863 in a radially-inward direction also results in the distal valve stem end 3863*a* engaging the sloped rim 3890*a* so as to remove the third planar member 3890 from the inner sub-plurality of noncentral orifices 3857*a* and channel 3857*c* of the second planar member 3850. This occurs prior to the plug 3862 closing off the fluid chamber or passage 3856*b* communicating fluid to the outer sub-plurality of noncentral orifices 3857*b* of the second planar member 3850, so that transition from the shower mode to the massage mode is gradual. When the third planar member 3890 is down, water pressure in the flow chamber or passage 3856*a*applies a downward force to the third planar member, preventing water from entering, whereby only the outer sub-plurality of noncentral orifices 3857*b* are exposed to the water pressure. When the shower valve 3861 is closed (see FIG. 39), the distal valve stem end 3863*a* tips the third planar member 3890 upwardly, opening the water supply in flow chamber 3856*a*to the inner sub-plurality of noncentral orifices 3857*a* and the massage tubes 3818*m* and closing the flow to outer orifices 3857*b*. Since there are substantially fewer of the inner orifices 3857*a* than of the outer orifices 3857*b*, the water pressure in central tubes 3818*m* (during massage mode) will be correspondingly higher than the water pressure in outer tubes 3818*s* (during shower mode).

Figure 40A:
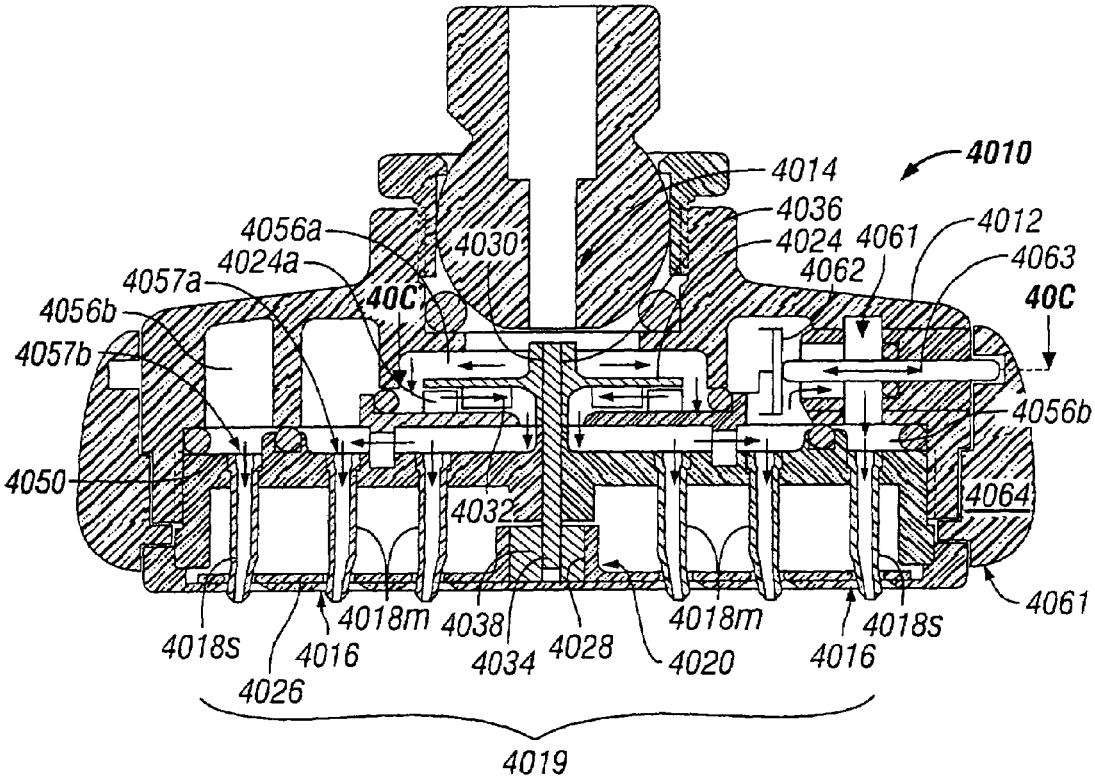
FIGS. 40A-B show sequential, sectional side views of an alternative spray apparatus employing an enclosed, peripherally-driven turbine and an alternative flow diverter system for achieving a massage effect in accordance with the present invention.
Figure 40C:
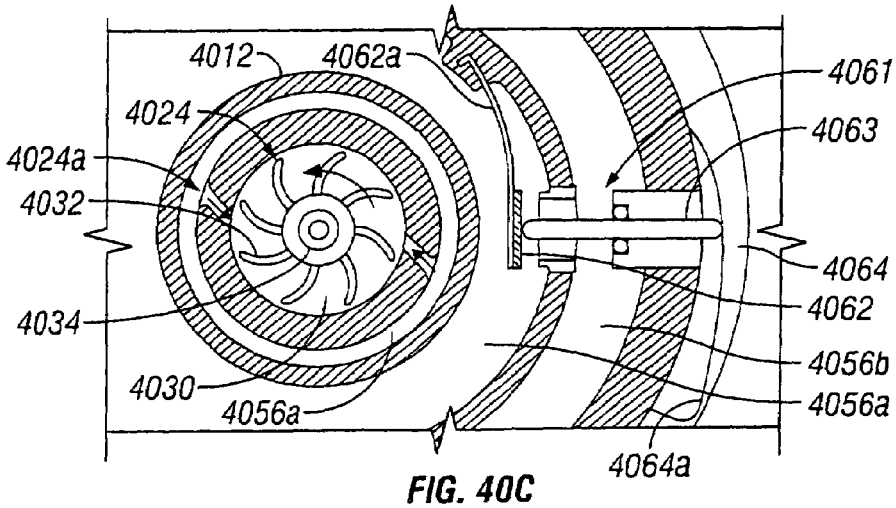
FIG. 40C shows a sectional top view of the spray apparatus of FIGS. 40A-B.
Figure 40B:
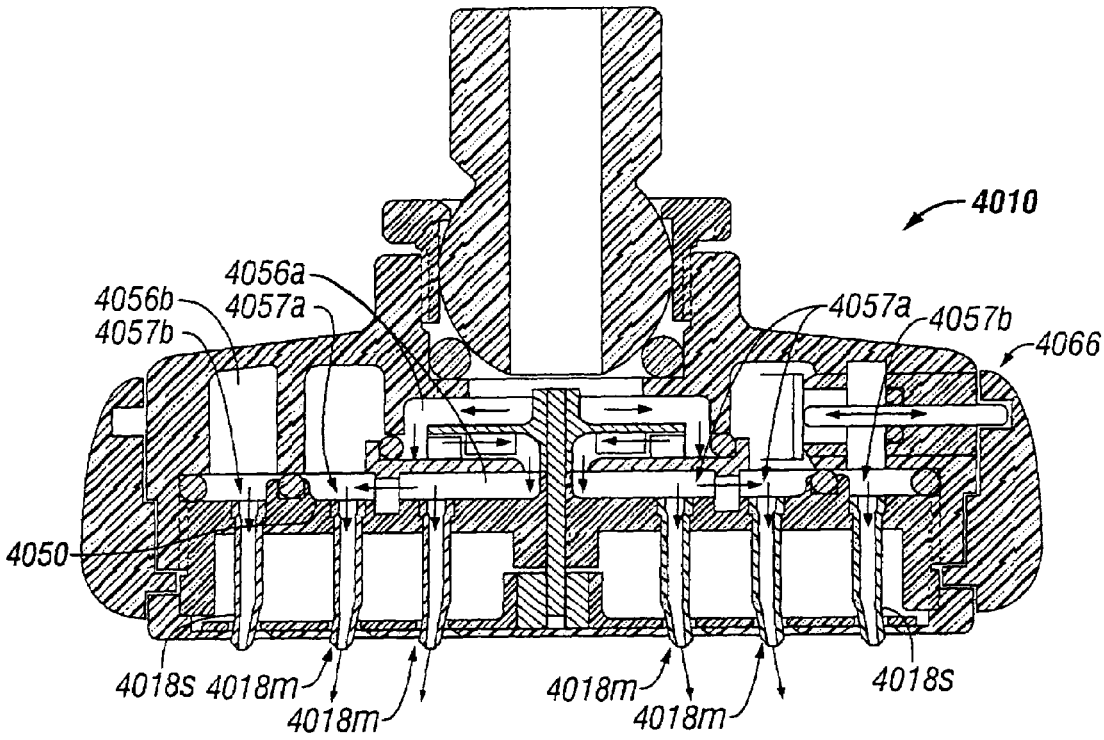
Figure 40D:
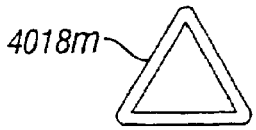
FIGS. 40D-E show cross-sections of a central fluid-dispensing tube according to the spray apparatus of FIGS. 40A-B, in respective shower and massage settings.
Figure 40E:
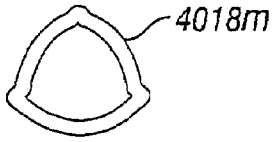

FIGS. 40A-B show sequential, sectional side views of an alternative spray apparatus 4010 employing an enclosed, peripherally-driven turbine 4024 and an alternative flow diverter system 4060 for achieving a massage effect in accordance with the present invention. FIG. 40C shows a sectional top view of the spray apparatus of FIGS. 40A-B. The housing 4012 of the spray apparatus 4010 includes a flow chamber or passage 4056*a*that is shaped to deliver water from fluid inlet 4014 to the turbine feed channels 4024*a* for energizing the multiple angled or curved vanes 4032 and creating torque at the turbine shaft 4034. The flow diverter system 4060 is analogous to that shown in FIG. 37, and includes a valve assembly 4061 for directing fluid through the flow chambers or passages 4056*a-b* to either: an outer sub-plurality of the noncentral orifices 4057*b* of the second planar member 4050; an inner sub-plurality of the noncentral orifices 4057*a* of the second planar member 4050; or a combination thereof. The valve assembly 4061 preferably includes a valve gate 4062 biased by a spring arm 4062*a* (see FIG. 40C) towards a closed position. A movable valve stem 4063 is provided for selectively opening flow passage 4056*b* to flow passage 4056*a*(as shown in FIGS. 40A and 40C). An actuator ring 4064 is useful for moving the valve stem 4063 and valve gate 4062 between the open and closed positions as desired to direct the water flow for shower and/or massage effects. The actuator ring 4064 has an inside track 4064*a* with a smoothly-varying radius (see FIG. 40C), which forces the valve stem 4063 inwardly or outwardly (under the force of spring arm 4062*a*) as the ring 4064 is rotated. This embodiment thus uses the center tubes 4018*m* fed by inner orifices 4057*a* for achieving a massage effect. The center tubes 4018*m* are (nominally) slightly smaller in cross-sectional flow area than the outer tubes 4018*s*, so as to regulate the water pressure flowing through the center tubes 4018*m*—which might otherwise exhibit a pressure higher than desired for bather comfort. The water flowing into the center tubes 4018*m* would otherwise tend to be at higher pressure than the water flowing into outer tubes 4018*s*, because of the shorter flow path and fewer frictional losses between the fluid inlet 4014 and the tubes 4018*m*. When the valve 4061 is closed, no water reaches the outer tubes 4018*s* fed by the outer orifices 4057*b*. As a result, pressure builds up on the inner tubes 4018*m*, and flexes the walls of the inner tubes 4018*m* from the nominal shape shown in FIG. 40D to the expanded shape shown in FIG. 40E.

Figure 41:
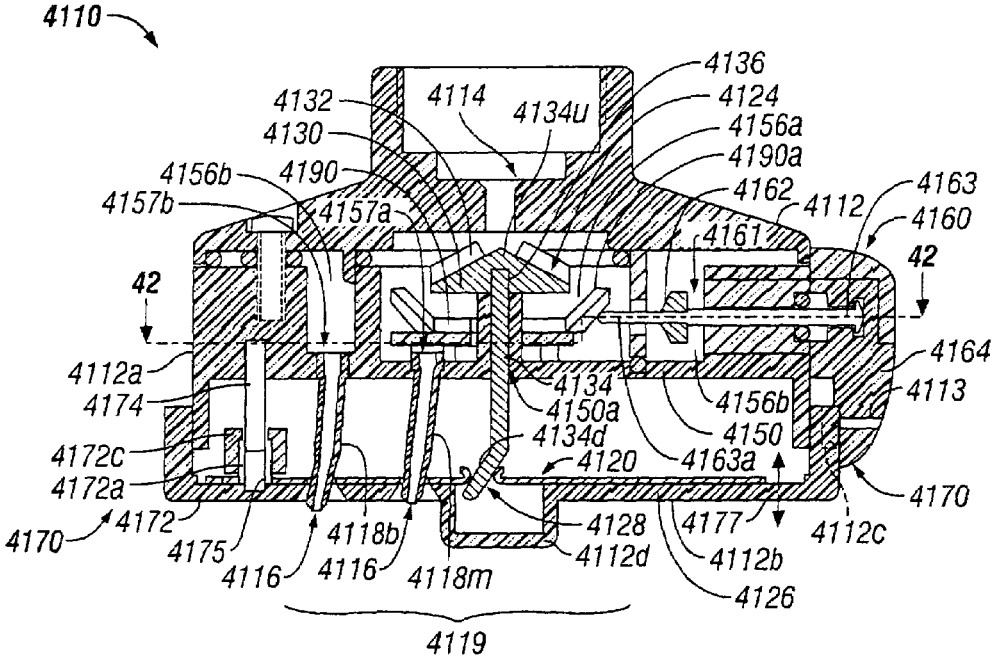
FIGS. 41-42 show sectional side and top views of an alternative spray apparatus that is similar to that of FIGS. 38-39, but employing a crankshaft instead of a camshaft and an alternative diverter system for achieving a massage effect in accordance with the present invention.
Figure 42:
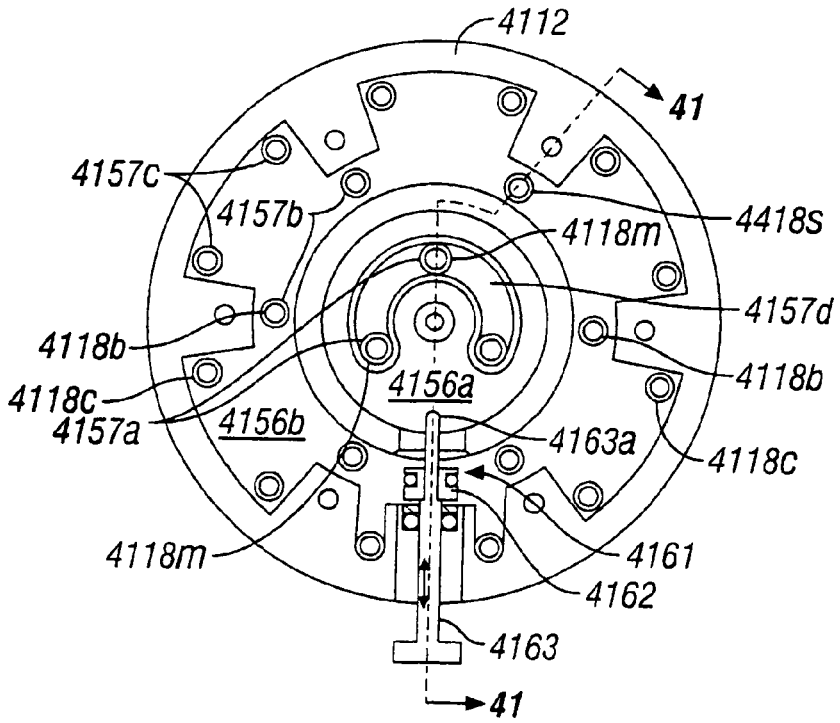

FIGS. 41-42 show sectional side and top views of an alternative spray apparatus 4110 that is similar to that of FIGS. 38-39, but employing a crankshaft 4134 instead of the camshaft 3834 (see FIG. 38) and an alternative diverter system 4160 for achieving a massage effect in accordance with the present invention. The crankshaft 4134 has a first end portion 4134*u* mounted to the turbine head 4130 and a second end portion 4134*d* rotatably carried within the substantially central orifice 4128 in the first planar member 4126 of the integrating member 4120. The second end portion 4134*d* of the crankshaft 4134 is axially offset from the axis of the crankshaft 4134 by a bend in the crankshaft intermediate the first and second end portions 4134*u-d*. The crankshaft 4134 is supported for rotation about a central axis within the housing 4112 by a second planar member 4150 sealingly mounted against rotation within the housing 4112 between the integrating member 4120 and the turbine head 4130.

The second planar member 4150 includes a substantially central orifice 4150*a* within which the crankshaft 4134 is carried for rotation, and a plurality of inner, intermediate, and outer noncentral orifices 4157*a*, 4157*b*, and 4157*c* (see FIG. 42) therein. An upstream portion of each of the tubes 4118*m*, 4118*b*, and 4118*c* is affixed in one of the respective noncentral orifices 4157*a*, 4157*b*, and 4157*c* of the second planar member 4150. A downstream portion of each of the tubes 4118 extends at least partially through one of the fluid outlets 4116. Accordingly, fluid flowing into the fluid inlet 4114 is directed through the tubes 4118*m,b,c* via the noncentral orifices 4157*a,b,c*.

The diverter system 4160 includes a rotating control ring 4164 that is useful for sequentially changing the resulting shower from a wide shower to a narrow shower, then to a shower/massage combination, then to a wide massage setting, and then to narrow massage setting. A third planar member 4190 removably covers the inner sub-plurality of noncentral orifices 4157*a*—interconnected by a channel 4157*d*—of the second planar member 4150. The third planar member 4190 has a sloped rim 4190*a* about at least a portion thereof. A valve system 4161 includes a movable valve stem 4163 equipped with a sealable plug 4162 and a distal end 4163*a*, such that movement of the valve stem 4163 in a radially-inward direction results in the plug 4162 closing off the fluid chamber or passage 4156*b* communicating fluid to the outer sub-pluralities of noncentral orifices 4157*b-c* of the second planar member 4150. More particularly, movement of the valve stem 4163 in a radially-inward direction results in the distal valve stem end 4163*a* first engaging the sloped rim 4190*a* so as to begin removing the third planar member 4190 from the inner sub-plurality of noncentral orifices 4157*a* and channel 4157*d* of the second planar member 4150. This initiates the massage effect and occurs prior to the plug 4162 closing off the fluid chamber or passage 4156*b* communicating fluid to the outer sub-plurality of noncentral orifices 4157*b* of the second planar member 4150. As the plug 4162 is moved towards its closing position, the shower effect is diminished and the massage effect increases. When the third planar member 4190 is completely opened, the massage effect via tubes 4118*m* is maximized. When the third planar member 4190 is down, water pressure in the flow chamber or passage 4156*a* applies a downward force to the third planar member, preventing water from entering and disabling the massage effect.

Figure 41A:
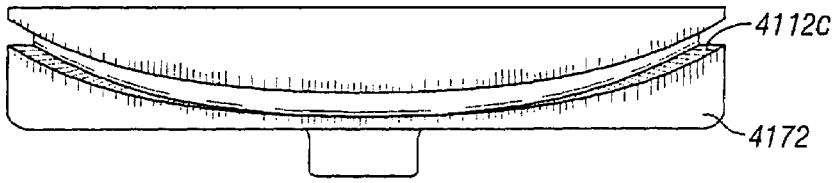

The spray apparatus 4110 further includes a means 4170 for adjusting the elevation of the integrating member 4120 relative to the crankshaft end 4134*d* so as to induce engagement of the integrating member 4120 with varying elevations of the sloping profile adjacent the crankshaft end 4134*d*. This permits the range of oscillation of the integrating member 4120 resulting from rotation of the turbine 4124 to be adjusted. More particularly, the system 4170 includes a substantially cylindrical base plate 4172 that is fitted about the substantially cylindrical upper portion 4112*a* of the housing 4112, so as to define the lower portion 4112*b* of the housing. The base plate 4172 includes a groove or recess 4112*c* for receiving a retaining pin 4113 carried in the control ring 4164. The groove 4112*c* is shaped (see FIG. 41A) such that rotation of the control ring 4164 about the upper housing portion 4112*a* imparts a force to the walls of the groove 4112*c*, via the retaining ring 4113, for selectively raising or lowering the base plate 4172 as indicated by two-way directional line 4177. As the base plate 4172 moves up, it positions the integrating member 4120 higher on the crankshaft profile 4134*d*, oscillating the resulting spray pattern over a narrower area. Conversely, downward movement of the base plate 4172 results in a wider oscillating range of the spray pattern. When the base plate 4172 reaches its upper-most position, the crankshaft profile 4134*d* makes no contact with the integrating member 4120, and the coupled fluid-dispensing tubes 4119 have no movement. Thus, rotation of the control ring 4164 affects the degree of oscillation by the integrating member 4120 as well as the shower/massage effect produced using valve assembly 4161 (described above). The base plate 4172 is prevented from rotating by one or more alignment pins 4174 disposed in one or more complementing orifices 4175 formed in a flanged portion 4172*a* of the base plate 4172. A collar 4172*c* is affixed to the flange 4172*a* for preventing separation of the integrating member 4120 from the base plate 4172 under the force applied by crankshaft end 4134*d*. It will be further appreciated by those having skill in the art that this embodiment does not produce a change in the overall spray pattern, but is useful for varying the radius of oscillation by the integrating member 4120 so as to vary the overall shower width (i.e., oscillation area of the spray pattern).

Figure 41B:
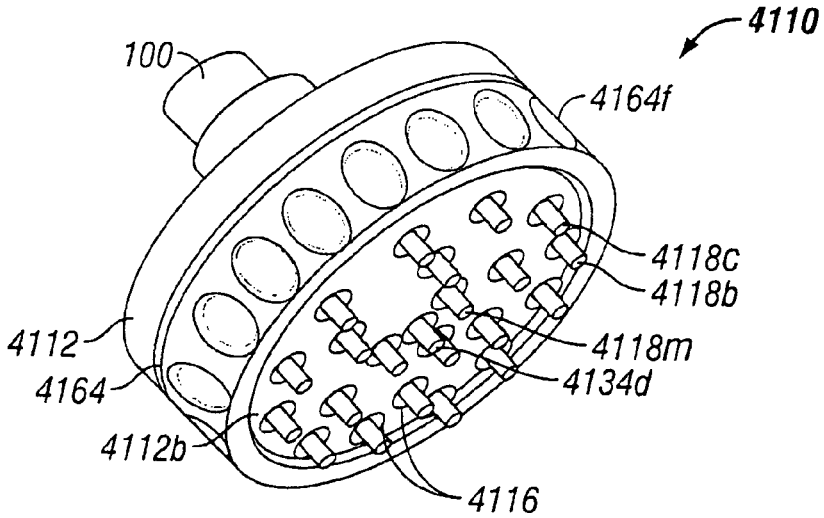

FIG. 41B shows a perspective view of the housing 4112 of the spray apparatus 4110, with a shower pipe or neck 100 delivering water into the fluid inlet 4114 (not shown in FIG. 41B) in a conventional manner. The outer control ring 4164 is shown being radially symmetrical and generally cylindrically-shaped, and includes finger indentions 4164*f* for easy gripping and rotating by a bather. The ends of the fluid dispensing tubes 4118*m*, 4118*b*, 4118*c* are shown extending partially through the fluid outlets 4116 formed in the lower portion 4112*b* of the housing. The lower housing extension 4112*d* (see FIG. 41) is removed in FIG. 41B for clarity, thereby showing the end 4134*d* of the crankshaft 4134 protruding slightly through the lower housing portion 4112*b*.

Figure 43:
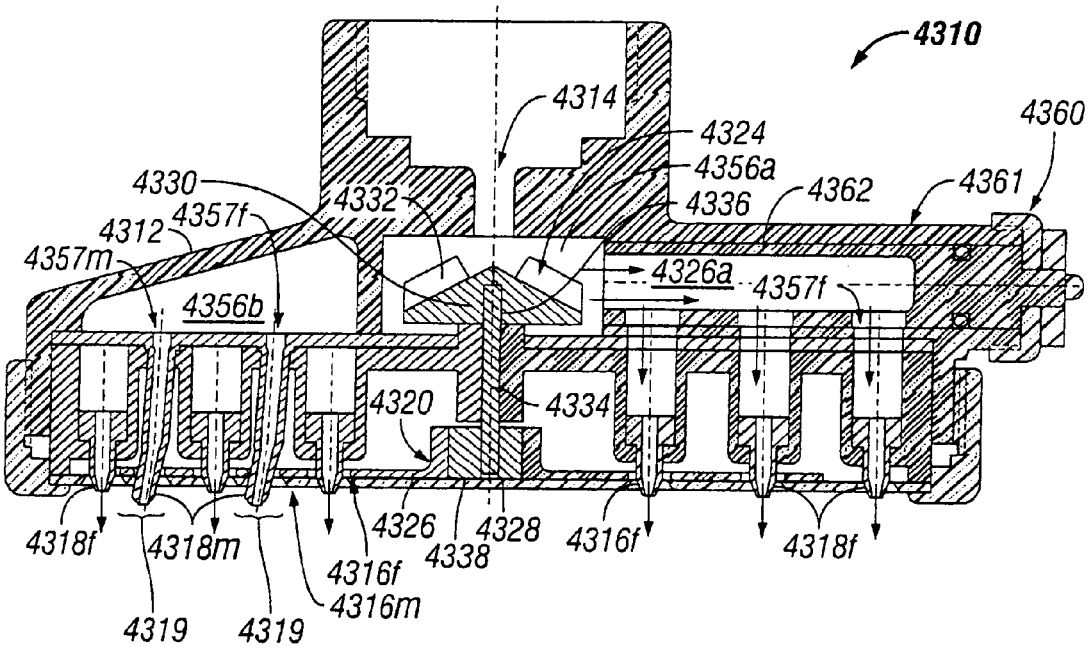
FIGS. 43-44 show sequential, sectional side views, in respective fixed and sweeping spray modes, of an alternative spray apparatus employing a combination of fixed and movable fluid-dispensing tubes and an alternative flow diverter system for achieving a massage effect in accordance with the present invention
Figure 44:
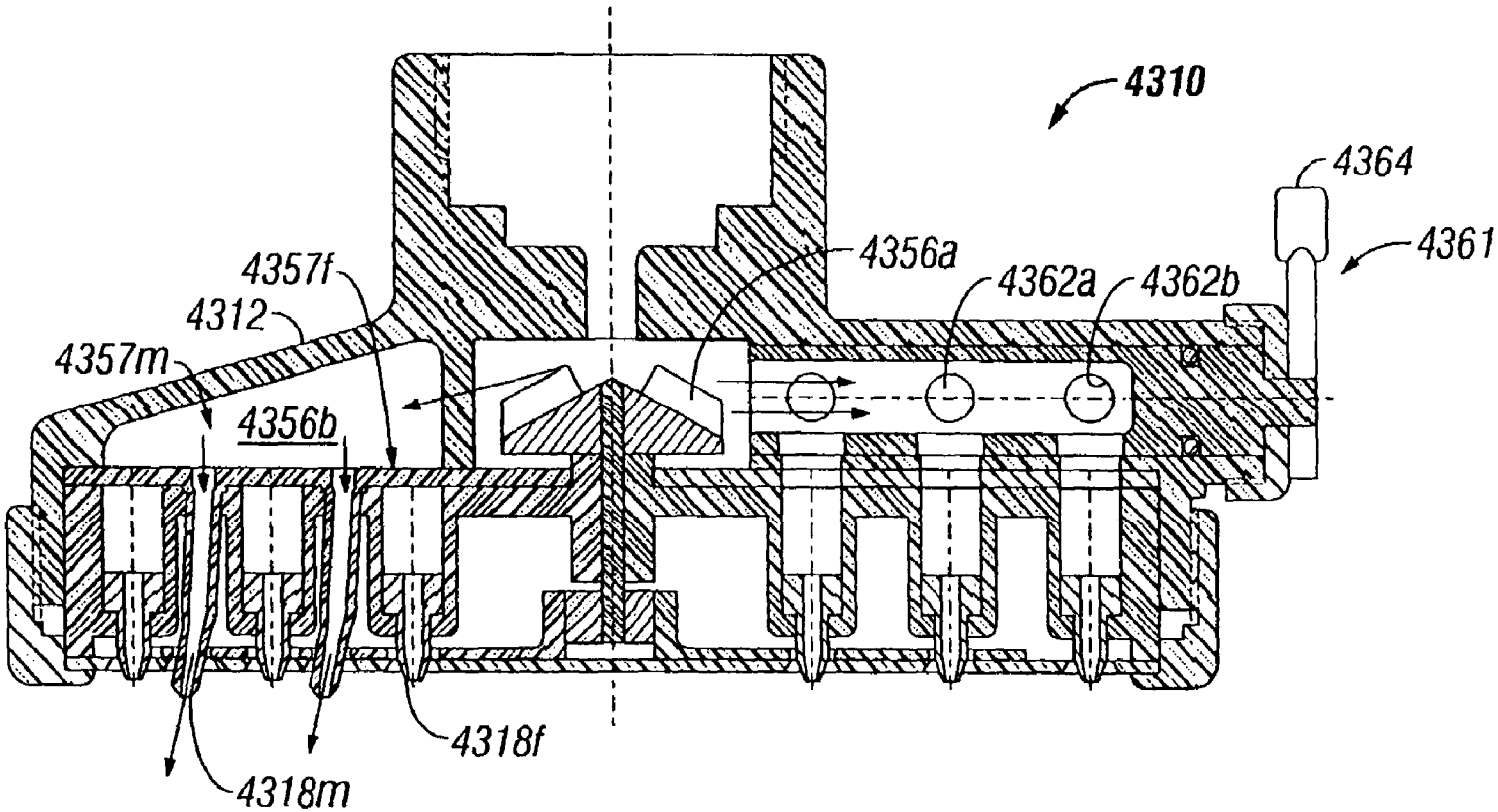

FIGS. 43-44 show sequential, sectional side views, in respective fixed and sweeping spray modes, of an alternative spray apparatus 4310 employing a combination of fixed and movable fluid-dispensing tubes 4318*f*, 4318*m* and an alternative flow diverter system 4360 for achieving a massage effect in accordance with the present invention. The movable fluid-dispensing tubes are those tubes 4319 that are coupled to the integrating member 4320. In this embodiment, tubes 4318*m* are integrally formed with the second planar member 4350, e.g., by a single rubber molding.

The fixed fluid-dispensing tubes 4318*f* are not coupled to the integrating member 4320. Each of the non-coupled tubes 4318*f* has an upstream portion affixed in one of a second set of orifices 4357*f* of the second planar member 4350, and a downstream portion that extends at least partially through one of the fluid outlets 4316. Accordingly, water flowing into the fluid inlet 4314, when the diverter system is positioned as shown in FIG. 43, is directed through the non-coupled tubes 4318*f* via the second orifices 4357*f*. The housing preferably defines flow chambers or passages 4356*a-b* for selectively communicating with the first and second orifices 4357*m,f* of the second planar member 4350. Accordingly, the diverter system 4360 includes a valve assembly 4361 for directing fluid in the flow chamber or passage 4356*a* to at least one of the first orifices 4357*m* or the second orifices 4357*f* of the second planar member 4350. The valve assembly 4361 includes a plug valve body 4362 actuated by a handle 4364 (see FIG. 44) that selectively rotates that valve body 4362 about its axis to achieve the desired flow configuration. In the valve position of FIG. 44, water is directed from flow chamber or passage 4356*a* into the valve chamber 4362*a* for delivery to flow chamber or passage 4356*b*, whereby the water passes through the first orifices 4357*m* into fluid-dispensing tubes 4318*m* for producing a sweeping spray. When the valve 4361 is moved to the position of FIG. 43, water is directed from flow chamber or passage 4356*a*into the valve chamber 4362*a* for delivery through valve orifices 4362*b* to second orifices 4357*f* and into fluid-dispensing tubes 4318*f* (i.e., bypassing flow chamber or passage 4356*b*) for producing a fixed spray. Accordingly, the bather can achieve a fixed or sweeping shower spray with this embodiment.

FIG. 45 shows a sectional side view of another, simplified alternative embodiment of a spray apparatus 4510 employing an integrating member 4520 disposed within the flow chamber 4556. Inside the housing 4512, the first planar member 4526 of the integrating member 4520 carries the fluid-dispensing tube entrances 4557. The turbine 4524, cam member 4538, and turbine shaft 4534 are all integrally formed, preferably of a plastic material. No seals are presently provided around the tubes 4518 at the outlets 4516, although that is an option. Leakage joins the shower stream exiting the tubes 4518.

It will be understood from the foregoing description that various modifications and changes may be made in the preferred and alternative embodiments of the present invention without departing from its true spirit.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A spray apparatus, comprising:

a housing having a fluid inlet and a plurality of fluid outlets;

a turbine carried for rotary movement within the housing under fluid flow from the fluid inlet to one or more of the fluid outlets, wherein the turbine has an eccentric member fixed for rotation with the turbine;

an integrating member operatively coupled to the eccentric member for oscillatory movement of the integrating member relative to the housing under rotary movement of the turbine;

a planar member sealingly mounted against rotation within the housing between the integrating member and the fluid inlet, the planar member comprising a plurality of orifices; and a plurality of flexible tubes each disposed in one of the fluid outlets for dispensing fluid from the housing, each of the plurality of flexible tubes having an upstream portion affixed in one of the plurality of orifices and having a downstream portion operatively-engaging the integrating member for coordinated movement of the plurality of flexible tubes.

2. The spray apparatus of claim 1, wherein the oscillatory movement of the integrating member comprises at least one of circular, elliptical, and linear movement.

3. The spray apparatus of claim 1, wherein the integrating member is operatively coupled to the turbine for oscillatory movement within the housing under rotary movement of the turbine.

4. The spray apparatus of claim 1, wherein the flexible tubes comprise a natural polymer, a synthetic polymer, or a combination thereof.

5. The spray apparatus of claim 1, wherein the tubes are oriented with respect to one another in a configuration that is parallel, divergent, convergent, or a combination thereof.

6. The spray apparatus of claim 1, wherein the fluid inlet directs fluid towards the turbine in a direction selected from axial, radial, tangential, and combinations thereof.

7. The spray apparatus of claim 1, wherein at least a portion of the housing is substantially cylindrical.

8. The spray apparatus of claim 1, wherein the rotary movement of the turbine comprises spinning, nutating, or a combination thereof.

9. The spray apparatus of claim 8, wherein the nutating comprises a wobbling motion.

10. The spray apparatus of claim 1, wherein the turbine comprises a head having at least two angled or curved vanes on an upper surface thereof and being radially symmetrical.

11. The spray apparatus of claim 1, wherein:

the integrating member comprises a substantially central orifice; and the turbine comprises:

a head having at least one angled or curved vane on an upper surface thereof; and a shaft depending from the turbine head and extending at least partially through the planar member for fixing the eccentric member to the turbine.

12. The spray apparatus of claim 11, wherein the turbine shaft is disposed in an opening formed through a lower portion of the turbine head.

13. The spray apparatus of claim 12, wherein the turbine shaft is fixed for rotation with the turbine head.

14. The spray apparatus of claim 13, wherein the eccentric member is carried within the orifice of the integrating member.

15. The spray apparatus of claim 14, wherein the eccentric member is integral with the turbine head.

16. The spray apparatus of claim 13, wherein the planar member comprises a substantially central orifice within which the turbine shaft is carried for rotation.

17. The spray apparatus of claim 16, wherein the housing defines a flow passage for communicating with noncentral orifices of the planar member; and further comprising:

a valve assembly for directing fluid in the flow passage to a member selected from the group consisting of:

an outer sub-plurality of the noncentral orifices of the planar member;

an inner sub-plurality of the noncentral orifices of the planar member; and a combination thereof.

18. The spray apparatus of claim 17, wherein the valve assembly comprises:

a stop valve having a movable stem for closing portions of the flow passage; and an actuator for moving the stem as desired to direct the fluid flow.

19. The spray apparatus of claim 18, further comprising:

a flow diverter for removably covering the inner sub-plurality of noncentral orifices of the planar member, the flow diverter having a sloped rim about at least a portion thereof; and wherein the movable valve stem is equipped with a plug, and a distal end, such that movement of the valve stem in a radially-inward direction results in the plug closing off a portion of the fluid passage communicating fluid to the outer sub-plurality of noncentral orifices of the planar member and the distal end engaging the sloped rim so as to remove the flow diverter from the inner sub-plurality of noncentral orifices of the planar member.

20. The spray apparatus of claim 19, wherein movement of the valve stem in a radially-inward direction results in the distal end engaging the sloped rim so as to remove the flow diverter from the inner sub-plurality of noncentral orifices of the planar member, prior to the plug closing off a portion of the fluid passage communicating fluid to the outer sub-plurality of noncentral orifices of the planar member.

21. The spray apparatus of claim 13, wherein the integrating member comprises stacked complementary upper and lower plates each having a plurality of slots therein, the slots of the upper plate overlying and being conversely oriented to respective slots of the lower plate so as to effect a plurality of common constricted slot areas through the upper and lower plates for engaging the respective flexible tubes by the extension of portions of the respective flexible tubes through the common slot areas, at least one of the complementary plates being rotatable with respect to the other of the complementary plates for moving the flexible tubes.

22. The spray apparatus of claim 21, wherein at least one of the complementary plates is rotatable with respect to the other of the complementary plates for moving the flexible tubes inwardly or outwardly with respect to the central axis.

23. The spray apparatus of claim 13, wherein the planar member further comprises a second plurality of orifices, wherein a second portion of tubes are not operatively-engaged to the integrating member, each of the second portion of tubes having an upstream portion affixed in one of the second plurality of orifices and a downstream portion that extends at least partially through one of the fluid outlets, such that fluid flowing into the fluid inlet is directed through the second portion of tubes via the second plurality of orifices.

24. The spray apparatus of claim 23, wherein the housing defines a flow passage for selectively communicating with the first and second plurality of orifices of the planar member; and further comprising:

a valve assembly for directing fluid in the flow passage to a member selected from the group consisting of:

the first plurality of orifices of the second planar member;

the second plurality of orifices of the second planar member; and a combination thereof.

25. The spray apparatus of claim 12, wherein the shaft is carried in the substantially central orifice of the integrating member such that the turbine is rotationally supported by the integrating member.

26. The spray apparatus of claim 11, wherein the turbine shaft is integrally formed with the turbine head.

27. The spray apparatus of claim 11, wherein the shaft is disposed for nutation within the orifice of the integrating member.

28. The spray apparatus of claim 11, wherein the eccentric member is carried about the shaft for rotation within the orifice of the integrating member, whereby spinning of the turbine about the axis of the shaft results in nutation of the turbine.

29. The spray apparatus of claim 11, wherein the shaft is a crankshaft having a first end portion mounted to the turbine head and a second end portion being axially offset from the axis of the shaft by a bend in the crankshaft to form the eccentric member.

30. The spray apparatus of claim 1, wherein:

the eccentric member has a sloping vertical profile; and further comprising:

a means for adjusting the elevation of the integrating member relative to the eccentric member so as to induce engagement of the integrating member with varying elevations of the sloping vertical profile of the eccentric member, whereby the range of oscillatory movement of the integrating member resulting from rotation of the turbine may be adjusted.

31. The spray apparatus of claim 1, further comprising an additional planar member supported for limited rotation about the central axis within the housing, the additional planar member comprising a plurality of noncentral angularly-oriented slots for engaging portions of the respective flexible tubes intermediate the downstream and upstream portions thereof by the extension of the flexible tube portions through the plurality of noncentral slots of the third planar member, the additional planar member being rotatable with respect to the housing for moving the flexible tube portions.

32. The spray apparatus of claim 31, wherein the additional planar member is rotatable with respect to the housing for moving the flexible tube portions inwardly or outwardly with respect to the central axis.

33. The spray apparatus of claim 32, further comprising an actuator carried by the housing for rotating the additional planar member.

34. The spray apparatus of claim 1, further comprising an adjustable manifold disposed within the housing above the planar member for directing fluid from the inlet to a member selected from the group consisting of:

an outer sub-plurality of the noncentral orifices of the planar member;

an inner sub-plurality of the noncentral orifices of the planar member; and a combination thereof.

35. The spray apparatus of claim 1, wherein the integrating member engages each of the flexible tubes at a similar location on each tube.

36. The spray apparatus of claim 35, wherein the engagement location is at or near a downstream portion of each flexible tube.

37. The spray apparatus of claim 35, wherein the engagement location is intermediate downstream and upstream portions of each flexible tube.

38. The spray apparatus of claim 1 wherein a downstream portion of each of the tubes extends at least partially through one of the outlets, and each of the outlets is equipped with an 0-ring through which a portion of each of the tubes intermediate the upstream and downstream portions is pivotally carried.

39. The spray apparatus of claim 38, further comprising a plurality of sleeves each fitted about one of the tubes intermediate the integrating member and the outlet through which the tube extends.

40. The spray apparatus of claim 1, wherein oscillating of the integrating member effects a coordinated oscillating of the downstream portion of each of the flexible tubes.

41. The spray apparatus of claim 40, wherein the oscillating of the downstream portion of each of the flexible tubes comprises at least one of circular, elliptical, and linear movement.

42. The spray apparatus of claim 41, wherein movement of downstream portions of the flexible tubes results in a generally conical fluid spray pattern for each flexible tube.

43. The spray apparatus of claim 1, wherein the flexible tubes are integrally formed with the integrating member.

44. The spray apparatus of claim 1, wherein the integrating member is planar.

45. The spray apparatus of claim 1, further comprising an actuator for restricting oscillatory movement of the integrating member so as to restrict movement of the flexible tubes.

46. The spray apparatus of claim 1, further comprising a means for selectively pointing downstream end portions of the plurality of tubes.

47. The spray apparatus of claim 46, wherein the pointing means comprises:

a set of spaced-apart protuberances on an outer surface of each of the coupled tubes defining a side recess between the protuberances, each of the flexible tubes being disposed in the noncentral orifices of the integrating member in such a manner that the integrating member is connected to the plurality of flexible tubes via the side recesses; and an internally-threaded sleeve carried for rotation about an externally-threaded sidewall portion of the housing, the sleeve having an annular groove formed in an inner surface thereof within which the integrating member is circumferentially carried, whereby rotation of the sleeve induces vertical movement thereof that applies a vertical force to the flexible tubes at the respective side recesses.

48. The spray apparatus of claim 1, wherein the turbine comprises a head that is rotationally imbalanced.

49. A spray apparatus, comprising:

a housing having a fluid inlet;

a plurality of tubes for dispensing fluid from the housing;

an integrating member operatively coupled to at least a subset of the plurality of tubes for effecting coordinated movement of the coupled tubes in response to movement of the integrating member; and an actuator for inducing movement of the integrating member, wherein the integrating member comprises a plurality of angularly-oriented slots for engaging portions of the respective coupled tubes intermediate the upstream and downstream portions thereof by the extension of the coupled tube portions through the plurality of angularly-oriented slots, the integrating member being rotatable by the actuator with respect to the housing for moving the coupled tube portions.

50. The spray apparatus of claim 49, wherein the actuator comprises a slidable lever extending through a slot in a side wall of the housing, the lever having an inner portion that engages the integrating member and an outer portion disposed outside the housing.

* * * * *